US011643603B2

(12) United States Patent
Nikooyeh et al.

(10) Patent No.: US 11,643,603 B2
(45) Date of Patent: May 9, 2023

(54) NON-AQUEOUS EXTRACTION AND SEPARATION OF BITUMEN FROM OIL SANDS ORE USING PARAFFINIC SOLVENT AND DEASPHALTED BITUMEN

(71) Applicant: SUNCOR ENERGY INC., Calgary (CA)

(72) Inventors: Kasra Nikooyeh, Edmonton (CA); Richard McFarlane, Edmonton (CA); John Bleile, Edmonton (CA); Ali Abbaspour, Calgary (CA); Ruoyu Cheng, Calgary (CA); Iftikhar Huq, Calgary (CA); Brian Doucette, Calgary (CA)

(73) Assignee: SUNCOR ENERGY INC., Calgary (CA)

( * ) Notice: Subject to any disclaimer, the term of this patent is extended or adjusted under 35 U.S.C. 154(b) by 254 days.

(21) Appl. No.: 16/994,211

(22) Filed: Aug. 14, 2020

(65) Prior Publication Data

US 2021/0047570 A1 Feb. 18, 2021

(30) Foreign Application Priority Data

Aug. 14, 2019 (CA) ..... 3051955

(51) Int. Cl.
*C10G 1/04* (2006.01)

(52) U.S. Cl.
CPC ..... *C10G 1/045* (2013.01); *C10G 2300/206* (2013.01); *C10G 2300/4081* (2013.01); *C10G 2300/44* (2013.01)

(58) Field of Classification Search
CPC ..... C10G 1/045; C10G 2300/44
See application file for complete search history.

(56) References Cited

U.S. PATENT DOCUMENTS 4,719,008 A * 1/1988 Sparks ..... C10G 1/04 208/390
5,092,983 A * 3/1992 Eppig ..... B09C 1/02 208/336

(Continued)

FOREIGN PATENT DOCUMENTS

CA 1069451 A 1/1980
CA 1085763 A 9/1980

(Continued)

OTHER PUBLICATIONS

U.S. Appl. No. 16/811,929, filed Mar. 6, 2020.

*Primary Examiner* — Prem C Singh
*Assistant Examiner* — Juan C Valencia
(74) *Attorney, Agent, or Firm* — Marshall, Gerstein & Borun LLP

(57) ABSTRACT

A non-aqueous extraction (NAE) process for producing bitumen from oil sands ore can include a multistage bitumen extraction step where paraffinic solvent and deasphalted oil are added at a downstream stage of extraction at solvent-to-bitumen ratios below asphaltene precipitation onset threshold to remove bitumen from the solid mineral material, while the ore is added to a first stage to mix with the solvent-bitumen mixture and produce solvent diluted bitumen. The process includes recovering the solvent diluted bitumen and the solvent diluted tailings from the extraction step. The solvent diluted bitumen is subjected to deasphalting to produce solvent diluted deasphalted bitumen that is used as a source of the paraffinic solvent and deasphalted oil supplied to extraction. The tailings and asphaltene fraction from deasphalting can be subjected to washing and the washed material can then be subjected to sand solvent recovery. The NAE process can be operated within an operating envelop for effective and efficient performance.

35 Claims, 19 Drawing Sheets

(56) References Cited

U.S. PATENT DOCUMENTS

| | | | |
|---|---|---|---|
| 5,316,659 | A | 5/1994 | Brons et al. |
| 8,226,820 | B1 | 7/2012 | Wegner |
| 8,980,080 | B2 | 3/2015 | Keseoglu et al. |
| 9,266,730 | B2 | 2/2016 | Kresnyak |
| 9,650,578 | B2 | 5/2017 | De Klerk et al. |
| 2005/0150844 | A1 | 7/2005 | Hyndman et al. |
| 2013/0098735 | A1 | 4/2013 | Corscadden et al. |
| 2014/0069641 | A1 | 3/2014 | Kosik et al. |

FOREIGN PATENT DOCUMENTS

| | | | | |
|---|---|---|---|---|
| CA | 1098466 | A | 3/1981 | |
| CA | 1107670 | A | 8/1981 | |
| CA | 1148104 | A | 6/1983 | |
| CA | 1160586 | A | 1/1984 | |
| CA | 1249976 | A | 2/1989 | |
| CA | 1291435 | C | 10/1991 | |
| CA | 2147943 | C | 12/1996 | |
| CA | 2149737 | C | 3/1999 | |
| CA | 2263858 | A1 | 9/2000 | |
| CA | 2217300 | C | 8/2002 | |
| CA | 2706665 | A1 | 6/2009 | |
| CA | 2582078 | C | 12/2010 | |
| CA | 2773089 | A1 | 3/2011 | |
| CA | 2580098 | C | 5/2011 | |
| CA | 2689469 | A1 | 6/2011 | |
| CA | 2761555 | A1 | 6/2011 | |
| CA | 2728986 | A1 | 7/2011 | |
| CA | 2785852 | A1 | 7/2011 | |
| CA | 2520943 | C | 11/2011 | |
| CA | 2704927 | A1 | 11/2011 | |
| CA | 2759610 | A1 | 5/2012 | |
| CA | 2718308 | A1 | 7/2012 | |
| CA | 2783845 | A1 | 1/2013 | |
| CA | 2783773 | A1 | 2/2013 | |
| CA | 2783837 | A1 | 2/2013 | |
| CA | 2645267 | C | 4/2013 | |
| CA | 2753811 | C | 10/2013 | |
| CA | 2740935 | C | 12/2013 | |
| CA | 2762444 | C | 5/2014 | |
| CA | 2740468 | A1 | 7/2014 | |
| CA | 2741280 | A1 | 8/2014 | |
| CA | 2747004 | C | 9/2014 | |
| CA | 2740670 | C | 10/2014 | |
| CA | 2724806 | C | 2/2015 | |
| CA | 2751719 | A1 | 2/2015 | |
| CA | 2803977 | C | 2/2015 | |
| CA | 2740481 | A1 | 4/2015 | |
| CA | 2797513 | A1 | 4/2015 | |
| CA | 2599741 | C | 5/2015 | |
| CA | 2738194 | A1 | 6/2015 | |
| CA | 2875040 | A1 | 6/2015 | |
| CA | 3021685 | A1 * | 6/2015 | ..... C10G 1/002 |
| CA | 2771236 | C | 8/2015 | |
| CA | 2804232 | A1 | 8/2015 | |
| CA | 2744611 | A1 | 9/2015 | |
| CA | 2747913 | A1 | 11/2015 | |
| CA | 2832931 | C | 2/2016 | |
| CA | 2833353 | C | 2/2016 | |
| CA | 2837968 | C | 3/2016 | |
| CA | 2852087 | A1 | 4/2016 | |
| CA | 2963782 | A1 | 4/2016 | |
| CA | 2913614 | C | 6/2016 | |
| CA | 2912884 | A1 | 7/2016 | |
| CA | 2913617 | C | 7/2016 | |
| CA | 2913619 | C | 7/2016 | |
| CA | 2640448 | C | 11/2016 | |
| CA | 2863487 | A1 | 1/2017 | |
| CA | 2907155 | A1 | 1/2017 | |
| CA | 2937325 | A1 | 2/2017 | |
| CA | 2867357 | A1 | 10/2017 | |
| CA | 2895118 | C | 10/2017 | |
| CA | 2864021 | C | 12/2017 | |
| CA | 2953038 | C | 1/2018 | |
| CA | 2870944 | C | 2/2018 | |
| CA | 2789383 | C | 3/2018 | |
| CA | 2814707 | A1 | 6/2018 | |
| CA | 2937235 | A1 | 6/2018 | |
| CA | 2857131 | A1 | 9/2018 | |
| CA | 2979231 | A1 | 10/2018 | |
| CA | 2771733 | A1 | 11/2018 | |
| CA | 2961594 | A1 | 12/2018 | |
| CA | 2932863 | C | 1/2019 | |
| CA | 3021685 | C | 2/2019 | |
| CA | 2932853 | C | 3/2019 | |
| CA | 2855693 | C | 6/2019 | |
| WO | WO-2013/103447 | A3 | 1/2014 | |
| WO | WO-2018/102831 | A1 | 6/2018 | |

* cited by examiner

NON-AQUEOUS EXTRACTION AND SEPARATION OF BITUMEN FROM OIL SANDS ORE USING PARAFFINIC SOLVENT AND DEASPHALTED BITUMEN

TECHNICAL FIELD

The technical field generally relates to processing oil sands ore, and more particularly to techniques using paraffinic solvent to facilitate the extraction and separation of bitumen from mined oil sands.

BACKGROUND

Conventional methods for the extraction of bitumen from oil sands rely on mixing the oil sands with water to form an aqueous slurry and then separating the slurry into fractions including bitumen froth and aqueous tailings. The bitumen froth is then treated to remove residual water and solids, while the aqueous tailings are stored in tailings ponds and/or subjected to further processing. Water-based extraction methods have various challenges related to water demand and processing requirements; energy requirements to heat aqueous streams to operating temperatures to facilitate extraction; as well as the production, handling and disposal of aqueous tailings materials.

SUMMARY

Paraffinic solvent can be used to extract bitumen from mined oil sands in a non-aqueous extraction (NAE) process. Precipitation of asphaltenes on the bulk sand during extraction and washing stages may result in loss of yield and cause challenges during recovery of the solvents used for bitumen extraction and possible operational and maintenance issues in material handling in the process (e.g., fouling of process equipment).

In the present technology, asphaltene precipitation can be avoided by operating the extraction stage at solvent-to-bitumen ratio below an asphaltene precipitation onset threshold. This can be performed by contacting the oil sands with a mixture of deasphalted bitumen and paraffinic solvent during the bitumen extraction and/or pre-washing stage, which facilitates increasing the liquid-to-solids ratio and avoiding asphaltene precipitation during extraction. The extraction stage can produce a solvent diluted bitumen material that can be subjected to solvent deasphalting to produce a solvent diluted deasphalted bitumen. The solvent diluted deasphalted bitumen can, in turn, be recycled back into the extraction and/or pre-washing stage as the source of the mixture of deasphalted bitumen and paraffinic solvent.

The use of deasphalted bitumen and paraffinic solvent for NAE can enhance extraction by leveraging higher liquid-to-solid ratios, higher asphaltene precipitation onset threshold with respect to the concentration of paraffinic solvent, low solvent-to-oil ratios, and the relatively low boiling point of paraffinic solvent to facilitate solvent recovery. Implementations of the NAE process can be used to process oil sands ore or various other bitumen-containing materials that have a relatively high mineral solids content.

In one aspect, a non-aqueous extraction process for producing bitumen from oil sands material including bitumen and solid mineral material is provided. The non-aqueous extraction process includes subjecting the oil sands material to a multistage bitumen extraction step including a first extraction stage receiving the oil sands material and a subsequent extraction and/or pre-washing stage, including:

supplying a paraffinic solvent and a deasphalted oil at a solvent-to-bitumen ratio that is below asphaltene precipitation onset into the subsequent extraction and/or pre-washing stage to remove bitumen from the solid mineral material to produce a solvent-bitumen mixture and a solvent diluted tailings material; and supplying the solvent-bitumen mixture to the first extraction stage to contact the oil sands material and induce extraction of bitumen from the solid mineral material and produce a solvent diluted bitumen material and a first stage solid mineral material depleted in bitumen that is supplied to the subsequent extraction and/or pre-washing stage; recovering the solvent diluted bitumen material from the multistage bitumen extraction step; and recovering the solvent diluted tailings material from the multistage bitumen extraction step.

In some implementations, the subsequent extraction and/or pre-washing stage comprises a pre-washing stage. In some implementations, the deasphalted oil is a partially deasphalted oil. The deasphalted oil and the paraffinic solvent can be added to the oil sands as a solvent diluted deasphalted hydrocarbon stream. The sole source of the paraffinic solvent in the multistage bitumen extraction step can be the solvent diluted deasphalted hydrocarbon stream. The process can further include subjecting a first portion of the solvent diluted bitumen material to solvent deasphalting to produce a bottom asphaltene fraction and solvent diluted deasphalted bitumen; and recycling the solvent diluted deasphalted bitumen back into the multistage bitumen extraction step as the solvent diluted deasphalted hydrocarbon stream. The process can also include subjecting a second portion of the solvent diluted bitumen material to a solid/liquid separation stage to remove suspended solids and produce a clarified solvent diluted bitumen material. The process can also include recovering solvent from the clarified solvent diluted bitumen material to produce a bitumen product stream. The solid/liquid separation stage can be a filtration stage and the clarified solvent diluted bitumen material can be a filtered solvent diluted bitumen material. The solvent deasphalting can be performed to partially deasphalt the first portion of the solvent diluted bitumen material such that the solvent diluted deasphalted bitumen is partially deasphalted. In addition, all of the paraffinic solvent that is added to the oil sands in the multistage bitumen extraction step can be from the solvent diluted deasphalted bitumen. Furthermore, all of the solvent diluted deasphalted bitumen can be recycled back into the subsequent extraction and/or pre-washing stage.

In some implementations, the solvent-to-bitumen ratio in the first extraction stage is maintained between 0.25 and 4, between 0.25 and 2, between 0.5 and 2, or between 0.5 and 1.5. The solvent-to-bitumen ratio in the first extraction stage can be maintained between 1.5 and 2 for hexane as the paraffinic solvent, for example. In another example, the solvent-to-bitumen ratio in the first extraction stage can be maintained above 1.5 for hexane as the paraffinic solvent. The solvent-to-bitumen ratio in the first extraction stage can be maintained sufficiently high to provide a fine mineral solids content below 0.5% in the solvent diluted bitumen material. In some implementations, a liquid-to-solids ratio in the first extraction stage is maintained at a predetermined range or value, optionally between 0.5 and 1.5 or between 0.75 and 1.25.

In some implementations, the multistage bitumen extraction step comprises: the first extraction stage operated in a first vessel receiving the oil sands material, and producing a first stage tailings stream and a first stage diluted bitumen stream as the solvent diluted bitumen material; and a second extraction stage as the subsequent extraction and/or pre-washing stage and operated in a second vessel, the second extraction stage receiving the first stage tailings stream directly from the first extraction stage and also receiving the solvent diluted deasphalted bitumen, and producing a second stage tailings stream as the solvent diluted tailings material and a second stage solvent diluted bitumen stream that is supplied directly to the first extraction stage as the solvent-bitumen mixture to provide the paraffinic solvent and deasphalted bitumen to the first extraction stage.

In some implementations, the process further includes washing the solvent diluted tailings material with a paraffinic solvent wash to produce a solvent wash liquor and a washed tailings material. The washing can comprise using shear and high impact jets. The process can also include subjecting the washed tailings material to solvent recovery to produce a recovered solvent stream and a solvent recovered tailings material. The process can further include recycling the solvent wash liquor back into the solvent diluted bitumen material to increase the solvent-to-bitumen ratio and induce deasphalting thereof.

In some implementations, the paraffinic solvent comprises pentane, hexane or a mixture of pentane and hexane. In some implementations, the paraffinic solvent comprises a mixture of hexane and other natural gas condensates, a mixture of hexane and light or heavy gas oils, or a mixture of hexane and at least one non-condensable gas.

In some implementations, the multistage bitumen extraction step is performed in a counter-current arrangement. The multistage bitumen extraction step can be performed at 25° C. to 80° C. or at 25° C. to 60° C. Other temperatures for the extraction stage as well as the deasphalting stage are also possible, as described herein.

In another aspect, a system for non-aqueous extraction for producing bitumen from oil sands material including bitumen and solid mineral material is provided. The system includes a multistage bitumen extraction unit including: an oil sands inlet for receiving the oil sands material; a solvent inlet for receiving a paraffinic solvent containing material that includes deasphalted oil; multiple extraction sites for corresponding multiple extraction stages for allowing direct contact between the oil sands and the paraffinic solvent containing material under extraction conditions to induce extraction of bitumen from solid mineral material to produce a solvent diluted bitumen material and a solvent diluted tailings material; a liquid outlet for removing the solvent diluted bitumen material from the extraction chamber; a tailings outlet for removing the solvent diluted tailings material from the extraction chamber; and a controller configured to control a solvent-to-bitumen ratio that is below an asphaltene precipitation onset within the multiple extraction chambers; and wherein the multiple extraction chambers include: a first extraction chamber in fluid communication with the oil sands inlet and the liquid outlet; a subsequent extraction chamber in fluid communication with the solvent inlet, the tailings outlet, and the first extraction chamber for receiving a partially extracted mineral solids material therefrom and providing a solvent-bitumen mixture thereto.

In some implementations, the system further includes a deasphalting unit configured to receive a first portion of the solvent diluted bitumen material and to produce a solvent diluted deasphalted bitumen and a bottom asphaltene fraction; and a recycle system configured to recycle the solvent diluted deasphalted bitumen back into the extraction unit via the solvent inlet.

In some implementations, the system further includes a solid/liquid separation unit configured to receive a second portion of the solvent diluted bitumen material to remove suspended solids therefrom and produce a separated solvent diluted bitumen material. The solid/liquid separation unit can be a filtration unit and the separated solvent diluted bitumen material can be a filtered solvent diluted bitumen material. In some implementations, the system further includes a solvent recovery unit configured to receive the separated solvent diluted bitumen material to produce a recovered solvent stream and a bitumen product stream.

In some implementations, the deasphalting unit is configured to partially deasphalt the first portion of the solvent diluted bitumen material such that the solvent diluted deasphalted bitumen is partially deasphalted. The recycle system and the extraction unit can be configured such that all of the paraffinic solvent that is added to the subsequent extraction chamber is from the solvent diluted deasphalted bitumen supplied by the recycle system. The recycle system also can be configured such that all of the solvent diluted deasphalted bitumen produced by the deasphalting unit is recycled back into the subsequent extraction chamber.

In some implementations, the controller is configured to maintain the solvent-to-bitumen ratio in the extraction unit between 0.25 and 4, between 0.25 and 2, between 0.5 and 2, or between 0.5 and 1.5. The controller can be configured to maintain the solvent-to-bitumen ratio in the extraction unit between 1.5 and 2, or above 1.5 for hexane as the paraffinic solvent. In some implementations, the controller is configured to maintain the solvent-to-bitumen ratio in the extraction unit sufficiently high to provide a fine mineral solids content below 0.5% in the solvent diluted bitumen material that is withdrawn from the liquid outlet. The controller can be configured to provide a liquid-to-solids ratio in the extraction unit at predetermined ranges or values.

In some implementations, the extraction unit comprises a first stage extraction vessel that includes the first extraction chamber and is configured to receive the oil sands material, and produce a first stage tailings stream as the partially extracted mineral solids material and a first stage diluted bitumen stream as the solvent diluted bitumen material; and a second stage extraction vessel that includes the subsequent extraction chamber and is configured to receive the first stage tailings stream and the solvent diluted deasphalted bitumen, and produce a second stage tailings stream as the solvent diluted tailings material and a second stage solvent diluted bitumen stream as the solvent-bitumen mixture; a connection line fluidly communicating between the first and second stage extraction vessels, the connection line being configured to supply the second stage solvent diluted bitumen stream to the first stage extraction vessel to provide the paraffinic solvent and deasphalted bitumen thereto.

In some implementations, the deasphalting unit is operated at 25° C. to 120° C. although other temperatures up to 160° C. are also possible. The deasphalting unit can be operated at a higher temperature compared to extraction. The deasphalting unit can be operated in the range of 25° C. to 60° C. or in the range of 70° C. to 130° C., or 80° C. to 120° C., for example.

In some implementations, the system includes a washing unit configured to receive the solvent diluted tailings material and a paraffinic solvent wash to enable removal of residual bitumen from the solvent diluted tailings material, and to produce a solvent wash liquor and a washed tailings material. The washing unit can comprise shear devices and high impact jets. In some implementations, the system also has a solvent recovery unit configured to receive the washed tailings material and to produce a recovered solvent stream and a solvent recovered tailings material. In some implementations, the system has a wash recycle system configured to recycle the solvent wash liquor back into the solvent diluted bitumen material to increase the solvent-to-bitumen ratio and induce deasphalting thereof in the deasphalting unit.

The system can be operated where the paraffinic solvent comprises hexane, a mixture of pentane and hexane, a mixture of hexane and other natural gas condensates, a mixture of hexane and light or heavy gas oils, or a mixture of hexane and at least one non-condensable gas, for example, or other paraffinic species or mixtures thereof.

In some implementations, the multiple extraction sites are multiple extraction chambers. The multiple extraction sites can alternatively be regions within a single extraction chamber. In addition, the direct contact between the oil sands and the paraffinic solvent containing material can be a counter-current contact. At least one of the multiple extraction stages can be operated at 25° C. to 80° C. or at 25° C. to 60° C., for example.

In yet another aspect, there is provided the use of paraffinic solvent and deasphalted oil as an extraction liquid for extracting bitumen from mined oil sands in a multistage bitumen extraction step including a first extraction stage and at least one subsequent extraction and/or pre-washing stage where the extraction liquid is added to at least one of the at least one subsequent extraction and/or pre-washing stage and the mined oil sands is added to the first extraction stage. The at least one subsequent extraction and/or pre-washing stage can comprise a pre-washing stage; the deasphalted oil can comprise a solvent diluted deasphalted bitumen stream obtained from deasphalting of solvent diluted bitumen extracted from the mined oil sands; and/or the deasphalted oil and the paraffinic solvent can be used so that the extraction occurs below asphaltene precipitation onset threshold.

In yet another aspect, a non-aqueous extraction process for producing bitumen from oil sands material including bitumen and solid mineral material is provided. The non-aqueous extraction process includes subjecting the oil sands material to a multistage bitumen extraction step comprising a first extraction stage and at least one subsequent extraction and/or pre-washing stage, the multistage bitumen extraction step comprising: supplying a paraffinic solvent and a deasphalted bitumen into at least one of the at least one subsequent extraction and/or pre-washing stage to remove bitumen from solid mineral material to produce a solvent-bitumen mixture and a solvent diluted tailings material with reduced asphaltene content; and supplying the oil sands material and the solvent-bitumen mixture to the first extraction stage under extraction conditions to induce extraction of bitumen from the solid mineral material and produce a solvent diluted bitumen material and a first stage solid mineral material depleted in bitumen that is supplied to the at least one subsequent extraction and/or pre-washing stage; recovering the solvent diluted bitumen material and the solvent diluted tailings material from the multistage bitumen extraction step; subjecting at least a portion of the solvent diluted bitumen material to solvent deasphalting to produce a bottom asphaltene fraction and solvent diluted deasphalted bitumen; and recycling at least a portion of the solvent diluted deasphalted bitumen back into the corresponding subsequent extraction and/or pre-washing stage to provide a source of the paraffinic solvent and deasphalted bitumen thereto.

In some implementations, the subsequent extraction and/or pre-washing stage comprises a pre-washing stage. In some implementations, the paraffinic solvent and the deasphalted bitumen are supplied to provide solvent-to-bitumen ratios in the first extraction stage and the subsequent extraction and/or pre-washing stage that are below asphaltene precipitation onset threshold. In some implementations, the multistage bitumen extraction step is performed in a counter-current arrangement.

In yet another aspect, a non-aqueous extraction process for producing bitumen from oil sands material including bitumen and solid mineral material is provided. The non-aqueous extraction process includes subjecting the oil sands material to a multistage bitumen extraction step comprising a first extraction stage and at least one subsequent extraction and/or pre-washing stage, the multistage bitumen extraction step comprising: supplying a paraffinic solvent and a deasphalted oil into at least one of the at least one subsequent extraction and/or pre-washing stage at a solvent-to-bitumen ratio below asphaltene precipitation onset threshold to remove bitumen from solid mineral material to produce a solvent-bitumen mixture and a solvent diluted tailings material; and supplying the oil sands material and the solvent-bitumen mixture to the first extraction stage at a solvent-to-bitumen ratio below asphaltene precipitation onset threshold and under extraction conditions to induce extraction of bitumen from the solid mineral material and produce a solvent diluted bitumen material and a first stage solid mineral material depleted in bitumen that is supplied to the at least one subsequent extraction and/or pre-washing stage; recovering the solvent diluted bitumen material and the solvent diluted tailings material; subjecting at least a portion of the solvent diluted bitumen material to solvent deasphalting to produce a bottom asphaltene fraction and solvent diluted deasphalted bitumen; and recycling a first portion of the solvent diluted deasphalted bitumen back into the multistage bitumen extraction step as a source of the paraffinic solvent and the deasphalted oil.

In some implementations, the at least one subsequent extraction and/or pre-washing stage comprises a pre-washing stage.

In some implementations, the process further includes obtaining oil sands ore from a mine; crushing and sizing the oil sands ore to produce a sized oil sands material; supplying the sized oil sands material into the first extraction stage; and providing inerting conditions in the multistage bitumen extraction step.

In some implementations, the multistage bitumen extraction step is performed in a single extraction vessel.

In some implementations, the process includes subjecting a second portion of the solvent diluted deasphalted bitumen to solvent recovery to produce a recovered solvent stream and a bitumen product. The process can also include preheating the solvent diluted bitumen material prior to the solvent deasphalting. The deasphalting can be performed at a higher temperature compared to extraction, e.g., up to 10° C., 20° C., 30° C., 40° C., 50° C. or 60° C. higher than the extraction temperature. In some implementations, the recovered solvent stream is used to indirectly preheat the solvent diluted bitumen material prior to the solvent deasphalting.

In some implementations, the process includes subjecting the solvent diluted tailings to solvent and bitumen removal to produce a cleaned tailings material as well as removed solvent and bitumen. The solvent and bitumen removal can include a bulk solvent and bitumen removal step to remove solvent and residual bitumen from the solvent diluted tailings and produce a bitumen depleted tailings comprising residual solvent and precipitated asphaltene, and a recovered solvent-bitumen stream; and a residual solvent removal step to remove residual solvent from the solvent depleted tailings to produce a tailings material for disposal. The bulk solvent removal step can include at least one liquid/solid separation stage, at least one washing stage or a combination thereof. The liquid/solid separation stage can be a filtration stage. In some implementations, at least a first portion of the removed solvent and bitumen can be recycled back into the extraction stage. At least a second portion of the removed solvent and bitumen can be recycled back into the solvent deasphalting stage.

In some implementations, the process includes subjecting the solvent diluted tailings to filtration to produce a filtered tailings and a filtrate; and subjecting the filtered tailings to washing using a solvent wash to produce a washed tailings and a solvent wash liquor. At least a portion of the filtrate can be recycled back into the extraction stage. All of the filtrate can also be recycled back into the extraction stage. In some implementations, at least a portion of the solvent wash liquor is recycled back into the solvent diluted bitumen material to increase the solvent-to-bitumen ratio thereof and induce asphaltene precipitation in the deasphalting stage. At least a portion of the solvent wash liquor can recycled back into the bottom asphaltene fraction.

In some implementations, the washing comprises a first washing stage that receives the filtered tailings and first stage solvent wash, and produces a first stage washed tailings and a first stage solvent wash liquor; and a second washing stage that receives the first stage washed tailings and a second stage solvent wash, and produces a second stage washed tailings and a second stage solvent wash liquor. At least a portion of the first stage solvent wash liquor can be added to the solvent diluted bitumen material to increase the solvent-to-bitumen ratio and induce asphaltene precipitation in the deasphalting stage. At least a portion of the second stage solvent wash liquor can be reused in the first washing stage. The second stage solvent wash liquor can be supplied directly to the first washing stage. The second stage solvent wash liquor can be mixed with the bottom asphaltene fraction produced in the solvent deasphalting stage. The second stage solvent wash liquor and the bottom asphaltene fraction can be mixed together and then fed back as a combined stream into the first washing stage. The second stage solvent wash can comprise solvent that has been recovered from the solvent diluted deasphalted bitumen. The second stage solvent wash can further comprise make-up solvent.

In some implementations, at least a portion of the solvent wash liquor is mixed with the bottom asphaltene fraction produced in the solvent deasphalting stage. The washed tailings can be subjected to sand solvent recovery to produce a recovered solvent vapour and a solvent-lean tailings material. The sand solvent recovery can be a drying stage and the solvent-lean tailings material can be a dried tailings material. In some implementations, the bottom asphaltene fraction is subjected to solvent removal along with the solvent diluted tailings material.

In some implementations, the multistage bitumen extraction step is performed in an extraction vessel and the first portion of the solvent diluted deasphalted bitumen is supplied directly into the subsequent extraction and/or prewashing stage of the extraction vessel. In some implementations, the paraffinic solvent is supplied to the multistage bitumen extraction step via multiple streams derived from downstream unit operations processing the solvent diluted bitumen material. In some implementations, the multistage bitumen extraction step is performed in a counter-current arrangement.

In some implementations, the multiple bitumen extraction step is operated at 25° C. to 80° C., or 25° C. to 60° C. In some implementations, the deasphalting stage is operated at 25° C. to 120° C. or 25° C. to 60° C.

In yet another aspect, a process for separating bitumen from an oil sands material that includes bitumen, water and mineral solids is provided. The process includes subjecting the oil sands material to a bitumen extraction stage, including contacting the oil sands material with a paraffinic solvent at a solvent-to-bitumen ratio ($S/B_E$ ratio) between 0.7 and 2 and below an asphaltene precipitation onset, and under extraction conditions to induce extraction of bitumen from solid mineral material to produce a solvent diluted bitumen material and a solvent diluted tailings material, the extraction stage being operated at 25° C. to 60° C. or 25° C. to 80° C.; separating the solvent diluted bitumen material from the solvent diluted tailings material; subjecting at least a portion of the solvent diluted bitumen material to solvent deasphalting to produce a bottom asphaltene fraction including precipitated asphaltenes and solvent diluted deasphalted bitumen having a solvent-to-bitumen ratio ($S/B_{DAO}$ ratio) between 2 and 3, or between 1.7 and 4, the deasphalting being operated at 25° C. to 120° C., or between 25° C. and 160° C., for example; recycling a first portion of the solvent diluted deasphalted bitumen into the bitumen extraction stage to provide at least a portion of the paraffinic solvent and increasing the asphaltene precipitation onset threshold and to provide a ratio of DAO-to-bitumen (DAO/ore-bitumen ratio) in the ore in extraction stage between 0.3 and 3; and recovering solvent from a second portion of the solvent diluted deasphalted bitumen to produce a bitumen product having an asphaltene content between 4 wt % and 12 wt %.

In some implementations, the extraction stage is operated at 25° C. to 60° C. In some implementations, the deasphalting is performed at 25° C. to 60° C. as well, at the same or higher temperature as the extraction stage. In some implementations, the extraction stage and the deasphalting are operated at 35° C. to 45° C. Other temperatures are also possible. In some implementations, the $S/B_E$ ratio is between 1 and 1.7 or between 1.3 and 1.5. In some implementations, the asphaltene content of the bitumen product is 6 wt % to 10 wt % or 7 wt % to 9 wt %. In some implementations, the $S/B_{DAO}$ ratio is between 2.5 and 2.9 or between 2.6 and 2.8. In some implementations, the extraction stage and the deasphalting are operated above 30° C. and below the boiling point of the paraffinic solvent under operating pressures. In some implementations, the DAO/ore-bitumen is between 0.5 and 2, between 1 and 2, or between 1.4 and 1.7. In some implementations, the oil sands material fed into the extraction stage has a bitumen content between 5 wt % and 13 wt %. In some implementations, the extraction stage is operated so that the solvent diluted tailings material has a liquid-to-solid ratio of at least 1.

In some implementations, the solvent diluted tailings material is subjected to filtration to produce a filtrate and a filtered tailings. The process can also include subjecting the filtered tailings to washing using a solvent wash to produce a washed tailings and a solvent wash liquor. At least a portion of the filtrate can be recycled back into the extraction stage. For instance, all of the filtrate can recycled back into the extraction stage. At least a portion of the solvent wash liquor can also be recycled back into the solvent diluted bitumen material to increase the solvent-to-bitumen ratio thereof and induce asphaltene precipitation in the deasphalting stage. At least a portion of the solvent wash liquor can be recycled back into the bottom asphaltene fraction.

In some implementations, the washing comprises a first washing stage that receives the filtered tailings and first stage solvent wash, and produces a first stage washed tailings and a first stage solvent wash liquor; and a second washing stage that receives the first stage washed tailings and a second stage solvent wash, and produces a second stage washed tailings and a second stage solvent wash liquor. At least a portion of the first stage solvent wash liquor can be added to the solvent diluted bitumen material to increase the solvent-to-bitumen ratio and induce asphaltene precipitation in the deasphalting stage. At least a portion of the second stage solvent wash liquor can be reused in the first washing stage. The second stage solvent wash liquor can be supplied directly to the first washing stage. The second stage solvent wash liquor can be mixed with the bottom asphaltene fraction produced in the solvent deasphalting stage. The second stage solvent wash liquor and the bottom asphaltene fraction can also be mixed together and then fed back as a combined stream into the first washing stage. The second stage solvent wash can comprise solvent that has been recovered from the solvent diluted deasphalted bitumen and can also comprise make-up solvent. In addition, at least a portion of the solvent wash liquor can be mixed with the bottom asphaltene fraction produced in the solvent deasphalting stage.

In some implementations, the washed tailings are subjected to sand solvent recovery to produce a recovered solvent vapour and a solvent-lean tailings material. The sand solvent recovery can be a drying stage and the solvent-lean tailings material is a dried tailings material.

In some implementations, the bottom asphaltene fraction is subjected to solvent removal along with the solvent diluted tailings material.

In some implementations, the extraction stage is a multistage bitumen extraction step comprising a first extraction stage and at least one subsequent extraction and/or pre-washing stage, wherein the first portion of the solvent diluted deasphalted bitumen is recycled back into the subsequent extraction and/or pre-washing stage and the oil sands material is supplied to the first extraction stage. In some implementations, the at least one subsequent extraction and/or pre-washing stage comprises a pre-washing stage.

In some implementations, the process comprises obtaining oil sands ore from a mine; crushing and sizing the oil sands ore to produce a sized oil sands material; supplying the sized oil sands material into the bitumen extraction stage; and providing inerting conditions in the bitumen extraction stage.

In some implementations, the bitumen extraction stage is performed in a single extraction vessel. In some implementations, the bitumen extraction stage is performed in a counter-current arrangement.

In some implementations, the process further includes pre-heating the solvent diluted bitumen material prior to the solvent deasphalting. The solvent recovered from the second portion of the solvent diluted deasphalted bitumen can be used to indirectly preheat the solvent diluted bitumen material prior to the solvent deasphalting. In some implementations, the paraffinic solvent comprises or is hexane.

In yet another aspect, a non-aqueous extraction process for producing bitumen from oil sands material including bitumen and solid mineral material is provided. The non-aqueous extraction process includes subjecting the oil sands material to a bitumen extraction stage, including contacting the oil sands with a paraffinic solvent at a solvent-to-bitumen ratio that is below an asphaltene precipitation threshold and under extraction conditions to induce extraction of bitumen from solid mineral material to produce a solvent diluted bitumen material and a solvent diluted tailings material; separating the solvent diluted bitumen material from the solvent diluted tailings material; subjecting at least a portion of the solvent diluted bitumen material to solvent deasphalting to produce a bottom asphaltene fraction including precipitated asphaltenes and solvent diluted deasphalted bitumen; subjecting the solvent diluted tailings material to multistage washing using a paraffinic solvent wash to produce a solvent wash liquor and a washed tailings material; recycling a first portion of the wash liquor back into at least a portion of the bottom asphaltene fraction to produce a solvent diluted asphaltene material; recycling a second portion of the wash liquor into the solvent diluted bitumen material to enable the solvent deasphalting; and supplying the solvent diluted asphaltene material to the washing step or subjecting the solvent diluted asphaltene material to solvent recovery separate from the solvent diluted tailings material.

In some implementations, the solvent diluted asphaltene material is supplied to the multistage washing. The solvent diluted asphaltene material can be laid on top of the solvent diluted tailings material prior to subjecting to the multistage washing. The solvent diluted asphaltene material can be mixed with the solvent diluted bitumen material prior to subjecting to the multistage washing. The solvent diluted asphaltene material can be supplied into the multistage washing. The solvent diluted asphaltene material can also be subjected to solvent recovery separate from the solvent diluted tailings material.

In some implementations, the process also includes recycling a portion of the solvent diluted deasphalted bitumen back into the bitumen extraction stage.

In some implementations, all of the bottom asphaltene fraction is mixed with the first portion of the wash liquor to form the solvent diluted asphaltene material.

In some implementations, the multistage washing comprises a first washing stage and a second washing stage, the first washing stage receiving the solvent diluted tailings material and a first stage solvent wash and producing a first stage washed tailings and a first stage wash liquor, the second washing stage receiving the first stage washed tailings and a second stage solvent wash and producing a second stage washed tailings and a second stage wash liquor. At least a part of the first stage solvent wash can include at least a portion of the second stage wash liquor.

In some implementations, the process further includes subjecting the solvent diluted tailings material to a solid/liquid separation stage prior to the multistage washing. The solid/liquid separation stage can be a filtration stage. The solvent diluted asphaltene material can be supplied to the filtration prior to the multistage washing.

In some implementations, the bitumen extraction stage is performed in a counter-current arrangement. The extraction stage can be operated at 25° C. to 80° C., for example, or 25° C. to 60° C. In some implementations, the deasphalting is performed at 25° C. to 120° C., 25° C. to 60° C., or other temperatures. The deasphalting can be performed at higher temperatures compared to the extraction, as described in more detail herein.

In yet another aspect, a non-aqueous extraction process for producing bitumen from oil sands material including bitumen and solid mineral material is provided. The non-aqueous extraction process includes subjecting the oil sands material to a bitumen extraction stage, including contacting the oil sands with a paraffinic solvent at a solvent-to-bitumen ratio that is below an asphaltene precipitation threshold and under extraction conditions to induce extraction of bitumen from solid mineral material to produce a solvent diluted bitumen material and a solvent diluted tailings material; separating the solvent diluted bitumen material from the solvent diluted tailings material; subjecting at least a portion of the solvent diluted bitumen material to solvent deasphalting to produce a bottom asphaltene fraction including precipitated asphaltenes and solvent diluted deasphalted bitumen; and subjecting the solvent diluted tailings material and the bottom asphaltene fraction to a washing stage using a paraffinic solvent wash to produce a solvent wash liquor and a washed tailings material including precipitated asphaltenes. In some implementations, the bitumen extraction stage is performed in a counter-current arrangement.

In some implementations, the oil sands material can be crushed and sized oil sands ore obtained from an oil sands mine.

In several implementations, substantially no extraneous water is added to the various parts of the process such that the only water that is present is from the oil sands ore itself. It should nevertheless be noted that water could be added to various parts of the process for particular purposes, such as enhancing fluidity of certain streams, enhancing solid separation, displacing solvent and bitumen, or performing other functions, such as enhanced agglomeration and settling. In some cases, steam can be used to perform certain functions such as heating and/or pressurizing. Liquid water can be added into the dried solvent depleted tailings to aid in dust suppression and transport, for example. Liquid water can also be added to ores that have low water content to suppress the suspension of fine solids during non-aqueous extraction.

Furthermore, operating parameters for process implementations can be provided for enhanced performance or efficiencies. For instance, it is noted that the deasphalting stage can be operated at a temperature range between 25° C. and 160° C., between 50° C. and 140° C., between 80° C. and 130° C., between 90° C. and 120° C., while the extraction stage can be operated at a lower temperature, such as 20° C. to 60° C. lower or 30° C. to 50° C. lower, and the washing stage can also be an approximately the same temperature as the extraction stage or within similar operating temperatures as described herein for extraction. The S/B ratio in the deasphalting stage can be between 1.7 and 4, between 2 and 3.5, between 2.8 and 3.2, or at approximately 3 when the solvent is hexane, for example. Other parameters—such as S/B ratios of certain streams, solid-to-liquid ratios, and the like—can also be provided and adapted based on the particular process design. Certain example operating parameters are described herein and can also be adapted based on various factors, such as equipment design, solvent selection, process design, and the like.

Several innovative process aspects and configurations are described herein for NAE and separation of bitumen from oil sands and other bitumen-containing materials.

DETAILED DESCRIPTION

Figure 1:
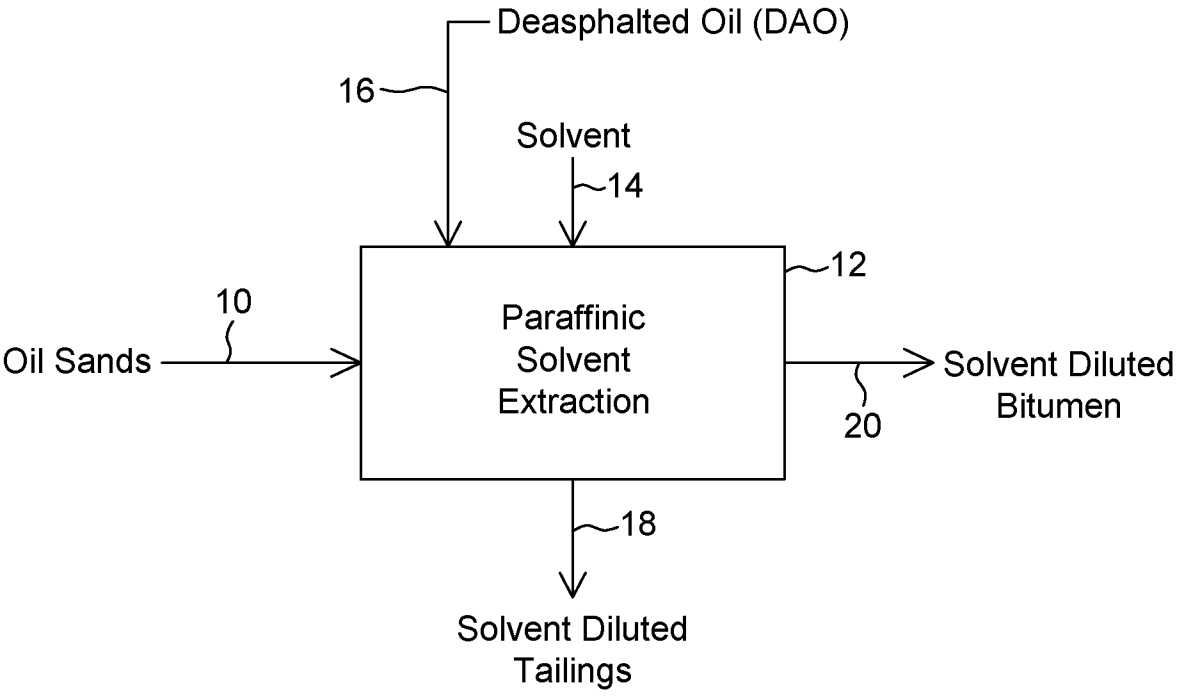
FIG. 1 is a block diagram of a process for extracting bitumen from oil sands using paraffinic solvent and deasphalted hydrocarbons.

Techniques described herein leverage the use of paraffinic solvent to extract and separate bitumen from materials that include bitumen, mineral solids and water, such as oil sands ore. Various implementations are configured for the extraction of bitumen from mined oil sands.

Non-aqueous extraction (NAE) of bitumen can be carried out using a low boiling point paraffinic solvent that has good solubility for bitumen extraction and allows easy separation from the bitumen after extraction. During extraction of bitumen from the oil sands, the paraffinic solvent can also be used at solvent-to-bitumen (S/B) ratios below asphaltene precipitation onset. Operating below asphaltene precipitation onset means that asphaltenes do not precipitate in the form of flocs or aggregates during the extraction stage. This can be facilitated by contacting the oil sands with a mixture of deasphalted bitumen and solvent during solvent extraction in order to increase the liquid-to-solids (L/S) ratio, expand the operating envelope by increasing the S/B ratio at onset, and avoid asphaltene precipitation during the extraction. Extraction can produce a solvent diluted bitumen material and a solvent diluted tailings material, which are separated from each other. The solvent diluted bitumen material can then be subjected to solvent deasphalting to produce a solvent diluted deasphalted bitumen that, in turn, can be recycled back into the extraction stage as a source of the deasphalted bitumen and paraffinic solvent.

Various process configurations can be implemented to facilitate the separation of bitumen from mineral solids and water, where deasphalted bitumen and paraffinic solvent are used to aid separation. In general, the deasphalted bitumen and paraffinic solvent can be produced as a solvent diluted deasphalted bitumen from a deasphalting stage, and then used in a extraction stage to provide conditions that favour bitumen separation from the mineral solids and water while avoiding asphaltene precipitation. The use of a stream that includes deasphalted bitumen and paraffinic solvent can leverage the deasphalting stage to provide desirable L/S ratios, S/B ratios, overall solvent requirements, and favourable extraction and separation conditions for enhanced performance. There are a number of configurations and aspects that can be used to treat various feed materials according to the techniques described herein.

Paraffinic solvents, which can also be referred to as aliphatic solvents, have relatively low boiling points compared to aromatic and naphthenic compounds with identical carbon numbers and have a lower tendency to keep fine inorganic solids such as clays suspended. Therefore, an NAE process that uses paraffinic solvents can facilitate the production of relatively clean diluted bitumen with low contents of inorganic solids and water. Inorganic solids are mainly present as sand, silt and clay in oil sands ore and the streams derived from oil sands. One challenge of using aliphatic solvents is the low overall recovery of bitumen extraction from oil sands as a result of asphaltene precipitation upon mixing of oil sands with these solvents. This issue can be mitigated by operating the extraction stage below asphaltene precipitation thresholds, which can be facilitated by adding deasphalted oil to the extraction stage. In one implementation, the process can include a solvent deasphalting stage and the resulting solvent diluted deasphalted bitumen can be used as the solvent containing material that is supplied to the extraction stage. Furthermore, the combination of partial deasphalting and recycling or reuse of at least a portion of the resulting deasphalted fluid facilitates operating the process at relatively low solvent-to-bitumen ratios as well as effective washing of the residual solids after extraction.

With the imposition of new regulations on tailings management and water use in the oil sands industry, NAE processes have interesting potential for bitumen production. Extraction of bitumen from oil sands using organic solvent reduces or eliminates the need for fresh water use and can produce dry tailings that may be reclaimed upon removal of residual solvent, thereby reducing or eliminating the need for tailing ponds. The use of solvent also facilitates extraction of bitumen from challenging resources, such as medium and low-grade oil sands as well as any oil sands that process poorly in hot water extraction, which is often not considered as economically viable ores for conventional processes.

NAE processes would ideally use a low-cost solvent that is effective at relatively low solvent contents, produce bitumen at a high yield and low fines content, and assure efficient solvent recovery. Some of the challenges involved in the development of a commercial scale NAE process relate to fines and clay removal as well as solvent recovery. Fine clay particles are suspended in the liquid extract and need to be removed from the final bitumen product. In addition, the gravitational forces of enhanced gravity settling particularly in cases where a non-paraffinic solvent is used for extraction may not be sufficiently effective in obtaining a final liquid product with adequately low solids content. Separation or removal of such fine particles from a diluted bitumen stream can be challenging for mixtures with high clay content after gravity settling.

Solvent recovery from the tailings sand after extraction can also be a complex process, particularly because of the large scale of the operations. Use of a light solvent may have a significant impact on the energy intensity and the complexity of the process by lowering the required temperatures for the solvent recovery operations.

In terms of NAE of bitumen from oil sands, paraffinic solvents have been proposed as a solvent for the extraction process. Clays can settle more efficiently in a paraffinic environment and a mixture of lighter paraffinic hydrocarbons is relatively low cost and easy to obtain, and can be recovered from the solids at relatively low temperatures. However, the tendency of paraffinic solvents to precipitate asphaltenes at higher S/B ratios can result in increased complexity of the processes using such solvents. In particular, asphaltene precipitation in the extraction stage can lead to reduced yield due to formation of free asphaltene precipitates that are lost to the tailings stream as well as deposition of asphaltenes onto the oil sands which can reduce access to additional bitumen. As paraffinic solvents appear in some ways to be relatively suitable for NAE of bitumen from oil sands, there is a need for a paraffinic solvent-based process that can operate smoothly without the risk of asphaltene precipitation at each stage. The proposed techniques presented herein facilitate the use of paraffinic solvent for extraction and separation of bitumen.

In the context of the present work, asphaltene precipitation is avoided at certain process stages by maintaining the ratio of the solvent to bitumen (S/B ratio) below the onset threshold for asphaltene precipitation. The separation process can also be performed in multiple stages and using a counter-current scheme to limit the impact of unwanted asphaltene rejection in any stage.

In particular, it was found that recycling deasphalted bitumen back into the extraction stage gave more than a simply additive effect with respect to increasing the asphaltene precipitation onset and thus provided notable enhancements in terms of process performance and efficiency. In addition, it was shown that deasphalting could effectively remove suspended solids from a solvent diluted bitumen stream even when little to no water was present. Therefore, the deasphalting stage can enable solids removal from the solvent diluted bitumen produced by a non-aqueous extraction stage, and then the solvent diluted deasphalted bitumen can be recycled back into the extraction stage to raise the onset and enhance the extraction. Furthermore, this DAO recycle strategy widens the window of operation and facilitates operating the extraction while processing oil sands ore having variable composition (e.g., bitumen content) while maintaining adequate S/B ratios below precipitation onset.

Basic Paraffinic Extraction Process from Oil Sands

Referring to FIG. 1, oil sands 10 that include bitumen, mineral solids and naturally occurring water can be supplied to a bitumen extraction stage 12 that uses both paraffinic solvent 14 and deasphalted oil 16 to produce solvent diluted tailings 18 and solvent diluted bitumen 20. The deasphalted oil 16 facilitates a relatively high liquid-to-solids ratio to be present in the extraction stage 12, and this aids the extraction of bitumen from the mineral solids as well as the separation of the extracted bitumen from the solids while ensuring a low overall S/B ratio, where the bitumen (B) includes the bitumen in the oil sands ore and the deasphalted oil, and preventing or limiting asphaltene precipitation. The amount of deasphalted oil 16 provided during extraction can be manipulated based on desired liquid-to-solids ratios and the conditions to avoid asphaltene precipitation, which can depend on various factors, such as extraction temperature, type of paraffinic solvent, bitumen properties, and S/B ratio.

The paraffinic solvent 14 and the deasphalted oil 16 can be supplied to the extraction stage 12 from single sources and/or as a combined single stream that includes both components. Alternatively, the paraffinic solvent 14 and the deasphalted oil 16 could be provided as separate streams. The deasphalted oil 16 can be derived from the solvent diluted bitumen 20, for example, by processing solvent diluted bitumen 20 to remove at least some asphaltenes. It is also noted that the paraffinic solvent 14 and the deasphalted oil 16 can be obtained from various downstream sources and can be provided to the extraction stage 12 in the form of several streams that each include both solvent and deasphalted hydrocarbons in various proportions. Thus, the paraffinic solvent 14 and the deasphalted oil 16 can be generated and supplied to the extraction stage 12 in various ways.

Figure 2:
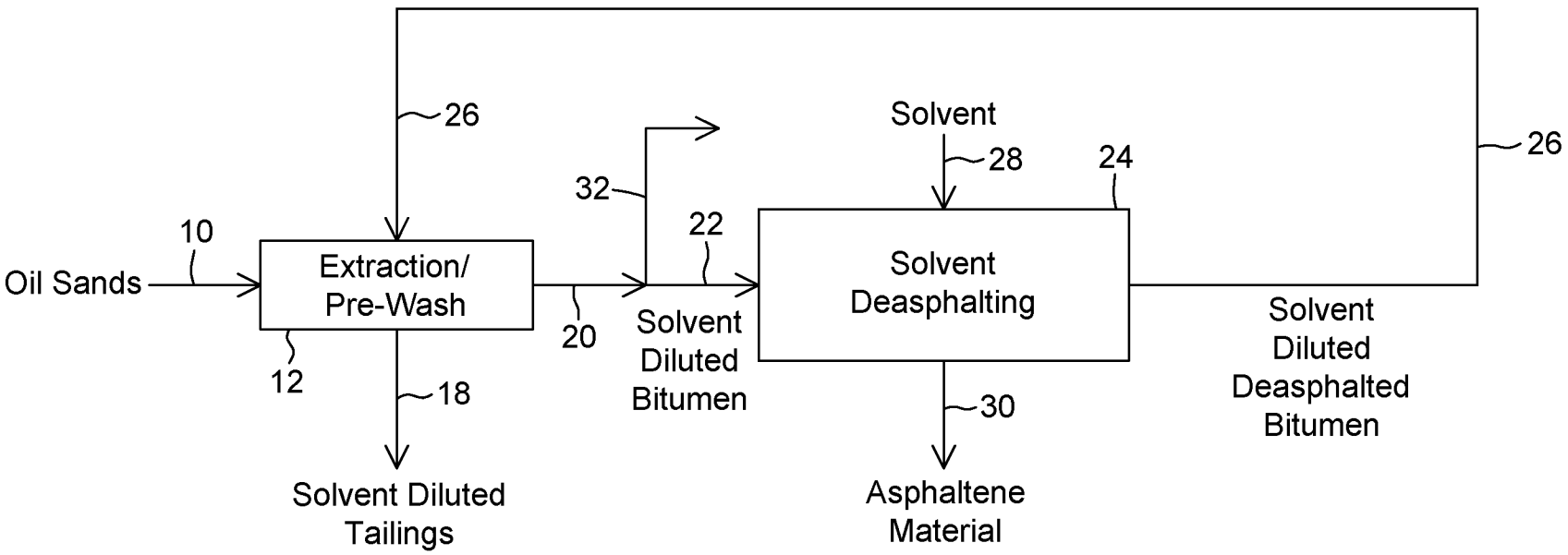
FIG. 2 is a block diagram of a process for extracting bitumen from oil sands using paraffinic solvent and including an extraction and/or pre-wash stage and a solvent deasphalting stage where the solvent diluted deasphalted bitumen is recycled back into the extraction stage.

Turning to FIG. 2, an implementation of the process is shown where the deasphalted oil that is supplied to the extraction and/or pre-wash stage 12 is derived from the solvent diluted bitumen 20 by supplying a first portion 22 of the solvent diluted bitumen 20 to a deasphalting stage 24 to produce a solvent diluted deasphalted bitumen 26 that is recycled back into the extraction and/or pre-wash stage 12. In the solvent deasphalting stage 24, the first portion 22 of the solvent diluted bitumen 20 is contacted with additional deasphalting paraffinic solvent 28 to fully or partially deasphalt the bitumen that is in the solvent diluted bitumen 20. Asphaltenes precipitate and can be recovered from the deasphalting stage 24 as a bottom fraction including precipitated asphaltenes 30. A second portion 32 of the solvent diluted bitumen 20 can be diverted as a bitumen containing product stream and subjected to further downstream processing, such as filtration and solvent recovery, to produce a final bitumen product. The stream 32 could be mixed with a portion of stream 26 to form a product stream.

Figure 3:
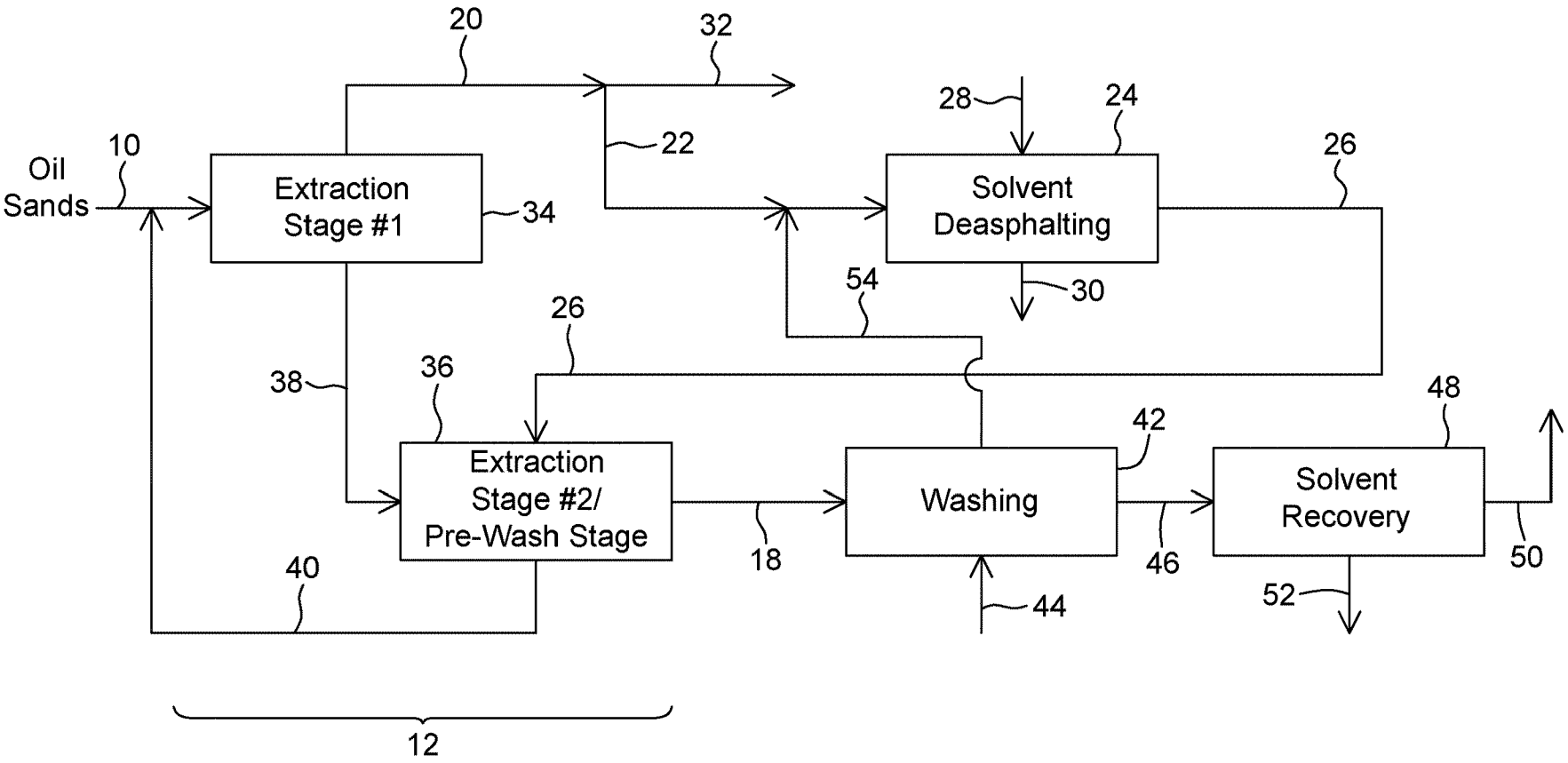
FIG. 3 is a block diagram of a process including multistage extraction and/or pre-wash, solvent deasphalting and washing of tailings from the extraction.

Referring now to FIG. 3, another implementation of the process can include multiple extraction stages, e.g., a first extraction stage 34 and a second extraction and/or pre-wash stage 36, which make up the overall bitumen extraction stage 12 in FIG. 1. In this two-stage arrangement, the oil sands 10 can be fed into the first extraction stage 34, which produces a first stage solvent diluted bitumen as the solvent diluted bitumen 20 and a first stage tailings 38 that contains mineral solids, water, solvent and remaining bitumen. The first stage tailings 38 can be fed into the second extraction and/or pre-wash stage 36 to enable further extraction of bitumen to produce a second stage tailings as the solvent diluted tailings 18 and a second stage solvent-bitumen stream 40. The second extraction and/or pre-wash stage 36 can receive the solvent diluted deasphalted bitumen 26 as the source of paraffinic solvent and deasphalted oil, for example. The second stage solvent-bitumen stream 40, which includes deasphalted bitumen, extracted bitumen and paraffinic solvent, can then be used as the source of paraffinic solvent and deasphalted oil for the first extraction stage 34. It is noted that the extraction operation could also have three or more stages.

Still referring to FIG. 3, the solvent diluted tailings 18 can be supplied to a washing stage 42 into which solvent wash 44 is supplied for removing residual bitumen from the mineral solids and producing washed tailings material 46. The washed tailings material 46 can then be sent to tailings solvent recovery 48 for producing recovered solvent 50 and solvent recovered tailings 52. The washing stage 42 also produces a solvent wash liquor 54 that includes paraffinic solvent and bitumen that was removed from the tailings. The solvent wash liquor 54, which contains relatively high levels of solvent, can be used in the deasphalting stage 24, e.g., by adding the solvent wash liquor 54 to the first portion 22 of the solvent diluted bitumen 20. In this case, the solvent wash liquor 54 can be the source of paraffinic solvent used for deasphalting. Depending on the operating conditions and the deasphalting level that is desired, additional solvent 28 can be added or the solvent wash liquor 54 can be the sole source of solvent for deasphalting.

This NAE process for extracting bitumen from oil sands can potentially operate at low S/B ratios, extract bitumen effectively, produce a liquid extract with low water and clay contents, and use a light aliphatic hydrocarbon as the solvent. One implementation of the process includes extraction of bitumen from oil sands using a recycled stream containing a mixture of paraffinic solvent and partially deasphalted bitumen. The process facilitates a high L/S ratio particularly in the first stage of extraction. The process also enables high bitumen recovery, and operates at a low S/B ratio to prevent asphaltene precipitation in the extraction steps. While the process could be operated with varying degrees of mixing energy, the extraction process can be operated with mixing that is of lower intensity in which case the solvent diluted bitumen would have lower suspended fines content which could be removed more easily.

Still referring to FIG. 3, this implementation will be described in further detail with respect to optional aspects and properties of the process. The extraction step can be conducted in multiple stages, e.g., two stages. In the first stage of extraction 34, oil sands are mixed with a recycled stream 40 from the second extraction and/or pre-wash stage 36. The recycled stream 40 can be a mixture of one or more aliphatic solvents (e.g., pentane, hexane, or a mixture thereof) and partially deasphalted bitumen. A portion of the bitumen is extracted from the oil sands and the supernatant liquid from this stage will have a lower S/B ratio than the feed. The product of the first extraction stage 34, which can be referred to as the solvent diluted bitumen material 20, is divided into two streams (e.g., equal in size) shown as 22 and 32 in FIG. 3. One portion 32 (e.g., half) can be viewed in this implementation as the product stream and is sent to fines removal and solvent recovery, while the other portion 22 (e.g., half) is recycled. Other proportions of streams 22 and 32 can be used, where stream 22 has a greater flow rate than 32 or vice versa. The use of the recycled deasphalted stream 26 rather than pure solvent can increase the asphaltene precipitation onset threshold, thereby avoiding asphaltene precipitation in the first extraction stage 34. Asphaltene precipitation at this stage of extraction from the oil sands may negatively impact the bitumen recovery and the efficiency of the downstream process of solvent recovery from the solids.

Referring still to FIG. 3, in some implementations the solvent diluted deasphalted bitumen 26 can have any S/B ratio higher than the ratio required for asphaltene precipitation onset. As an example, stream 26 can have an S/B ratio of 2.5:1 or 3:1 or higher, for example when hexane is used as the paraffinic solvent. When different solvents and other operating parameters (e.g., temperature) are used, the S/B ratios can be different. The recycled stream 40 is produced by mixing stream 26 with the liquid entrained in the solids of the first stage tailings 38, and therefore the recycled stream 40 will include deasphalted oil, bitumen and solvent with an overall S/B ratio that is less than stream 26. Stream 20 will have still lower S/B ratios than stream 40, for example stream 20 could have an S/B ratio of 1:1 to 1.5:1. These S/B ratios are volume based, as are any S/B ratios in the Example section below.

Still referring to the implementation of FIG. 3, the residual solids-rich phase (which can be referred to as first stage tailings 38) from the first extraction stage 34 is sent to the second extraction stage and/or pre-wash stage 36. There, the recycled stream (also referred to as the solvent diluted deasphalted bitumen 26) from the deasphalting stage 24 with an aliphatic S/B ratio of ~2.5-3:1 or higher (or lower) is mixed with the partially extracted sand from the first stage 34 to remove more bitumen from the sand in the second extraction stage and/or pre-wash 36. The tailings or solids-rich phase of this second extraction stage and/or pre-wash 36 can be referred to as second stage tailings and can be sent to the washing stage 42. It is also noted that the second stage of extraction could be referred to as an initial washing stage, as some washing can occur simultaneously with additional extraction.

In the washing stage 42, the sand and small amounts of residual bitumen can be washed by the equivalent of 1.5 times the original volume of bitumen in the oil sands or higher, for example. Washing can be performed in multiple stages and in some cases in a counter-current fashion. This extensive washing can facilitate removal of most of the remaining oil in the solvent diluted tailings 18 to produce the washed tailings 46. As the entrained liquid in tailings stream 18 is already diluted by partially deasphalted oil, the residual bitumen would have a lower asphaltene content than the original bitumen. Asphaltenes in the residual oil may precipitate in this washing process and the loss of yield in this washing stage may be in the range of 0 to 5 wt % (or 1 to 2 wt %, for example, depending on various factors, such as the bitumen content in ore, amount of entrained liquid in the solids, and the S/B ratio and it may vary significantly) of total bitumen, mainly in the form of precipitated asphaltenes. This asphaltene precipitation may represent 0 to 0.5 wt % of the solids. This would be in the range of the level of residual bitumen in the sand in any solvent extraction scheme and is not expected to significantly impact the solvent recovery process. The washed asphaltene-containing sand, which stream may be referred to as the washed tailings 46, can be sent to tailings solvent recovery 48 to remove entrained and absorbed paraffinic solvent (e.g., hexane). The product of the washing stage 42 can be a dilute bitumen-in-solvent mixture that has been deasphalted, and may be referred to as the solvent wash liquor 54. Depending on how quickly the washing occurs and whether or not the liquid has gone through a settling stage, it may still contain some or most of the asphaltenes.

This solvent wash liquor 54 stream can be added to the portion of the solvent diluted bitumen that is to be deasphalted and recycled, i.e., to stream 22 shown in FIG. 3. Mixing of the two streams 22 and 54 is intended to induce asphaltene precipitation, due to the relatively high solvent content of the solvent wash liquor 54. It is also noted that the deasphalting process effectively removes fine solids and connate water, which can contain high concentrations of chlorides, present in the solvent diluted bitumen produced in the first extraction stage 34. Asphaltene precipitation and rejection removes the emulsified water and fines, including clays, that may have been transferred to the solvent-bitumen mixture 54 as a result of extensive washing in the washing stage 42. In other words, the washing stage 42 can be performed under extensive or aggressive conditions to promote washing of residual bitumen from the tailings to enhance bitumen recovery, and if this leads to higher fines content in the solvent wash liquor 54 then the fines can be removed as part of the solvent deasphalting stage, resulting in overall low fines levels in the bitumen product. It is also noted that it may be desirable to minimize fines in the recycled stream 40 since high fines levels being recycled back to the first extraction stage 34 can reduce performance, and therefore the washing stage can be conducted to produce a relatively low fines wash liquor and/or the wash liquor could be subjected to settling or other solids removal steps before recycling back to the extraction stage. The cleaned deasphalted product from this deasphalting process may be referred to as solvent diluted deasphalted bitumen 26 and can be recycled to mix with the oil sands in the first and/or second extraction stages 34, 36, for example as illustrated in FIG. 3.

Implementations of this process have various advantages, some of which will be listed as follows. First, by incorporating recycling, a high L/S ratio in the first extraction stage is achieved while maintaining a low overall S/B ratio. Higher L/S ratios can provide conditions for enhanced extraction and separation of the bitumen from the mineral solids. Second, recycling of a partially deasphalted mixture of aliphatic solvent and bitumen facilitates solubility of the whole bitumen (i.e., all bitumen sub-fractions including asphaltenes) in the solvent in the first extraction stage, i.e., no asphaltene precipitation occurs in the first stage. Third, a high L/S ratio in the extraction stages and extensive washing of the resulting tailings can facilitate achieving high bitumen recovery. Fourth, the use of a light paraffinic solvent could lower the energy requirements, and possibly the complexity and cost, of the solvent recovery process compared to extraction schemes that use less volatile solvents (e.g., naphtha) to avoid asphaltene precipitation. Fifth, the bitumen product obtained from this process will have a lower viscosity, density, and chlorides than the original bitumen as a result of partial deasphalting. Sixth, displacement of the extracted bitumen with a mixture of DAO/solvent mixtures lowers the asphaltene content of the entrained liquid in the tailings sent to the counter-current washing with pure solvent lowering the likelihood and amount of asphaltenes precipitated on the bulk sand thereby increasing the efficiency of the drying process.

In work directed to the process implementation shown in FIG. 3, a focus was on the yield of recovered bitumen using a recycled deasphalted stream and the possibility of obtaining a product with low levels of fines and emulsified water content. Implementations of the process that were developed and tested have a number of features that may be attractive in the context of NAE of bitumen from oil sands. For example, the process implementation can be configured to operate at a volumetric S/B ratio of 1.5-2.0 (i.e. approximately 1.0-1.3 mass ratio) in the first extraction stage, which is lower than many of the S/B ratios used in the paraffinic froth treatment. The process implementation can readily extract 90-95% of the bitumen in 15 minutes without the need for high shear mixing. The process implementation can also use a cheap and readily available solvent such as natural gas condensates. Some of this solvent may be left in the produced bitumen for pipelining. This simplifies the process of solvent recovery from the bitumen. The process implementation can use a relatively light solvent, such as heptane, hexane, pentane, or an equivalent mixture, thereby lowering the energy requirements for solvent recovery from the sand. The process implementation can produce a bitumen product with lower fines (including clay) and water contents by gravity settling only. The process implementation can also lower the diluent addition requirements for pipelining the bitumen as a result of partial deasphalting, which decreases viscosity and density of the product.

One challenge associated with the development of technologies in this area are related to solvent and inorganic fines management. The process implementation described above can be viewed as advantageous over most available processes in dealing with fines management because of using a paraffinic solvent and this can facilitate commercialization. Furthermore, recovery of paraffinic solvents is less challenging as a result of the relatively low boiling point of these materials compared to various other hydrocarbon solvents. The yield and process complexity issues associated with the use of paraffinic solvents are also addressed by the implementation of partial deasphalting.

It is noted that, in some implementations, various streams can be used as at least part of the deasphalted material that is supplied into the extraction stage to increase precipitation onset thresholds. The main example presented above is the solvent diluted deasphalted bitumen stream that is the product of the solvent deasphalting stage. It is also noted that downstream fractions of the bitumen can also be recycled and used to increase precipitation onset thresholds. For instance, distillate fractions of bitumen or deasphalted oil (e.g., light or heavy gas oils) can increase the asphaltene precipitation solvent/oil ratio and therefore could be used as long as the solvent can induce asphaltene precipitation from bitumen at a reasonably low S/B ratio. Thus, the deasphalted bitumen that is obtained from the process can be further processed, for example in a fractionation tower, and one or more distillate fractions can be recycled back as a deasphalted material to increase precipitation onset thresholds in the extraction stage.

Figure 18:
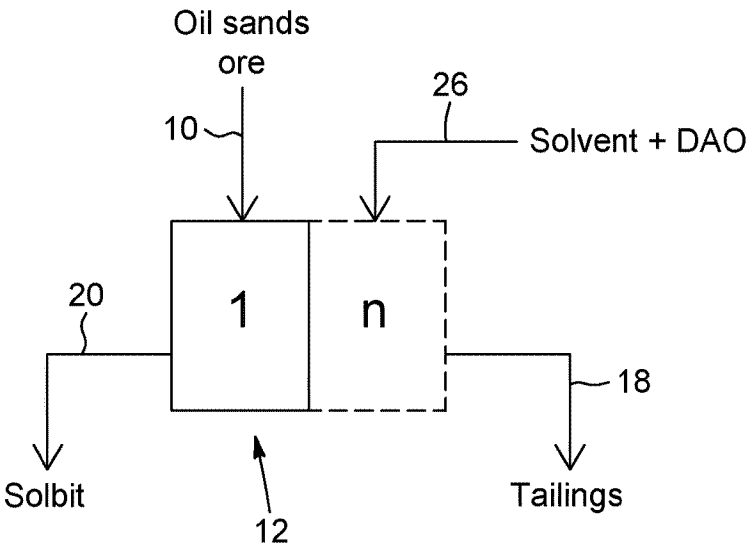
FIG. 18 is a diagram of a multistage extraction step.
Figure 19:
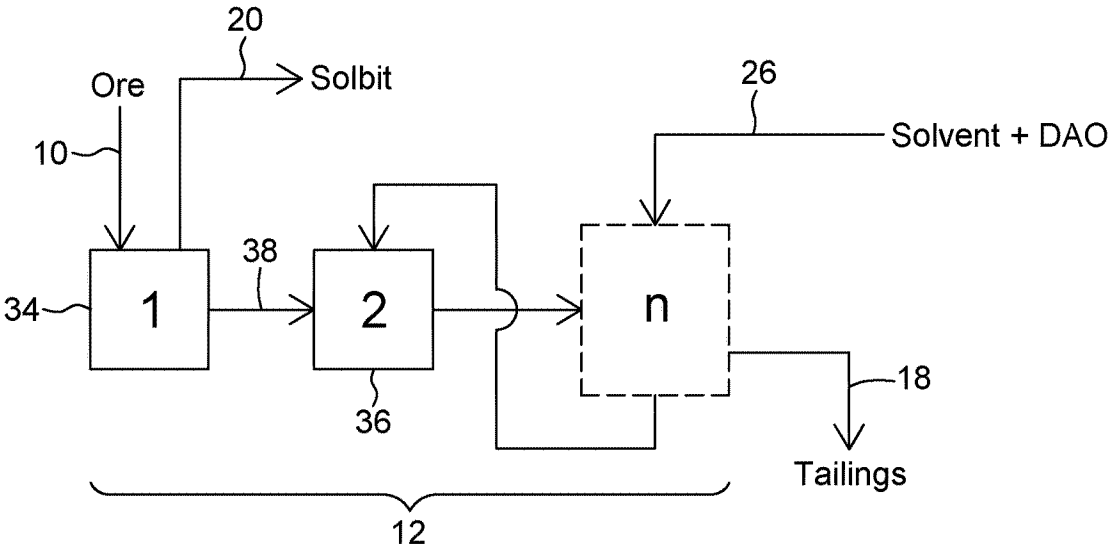
FIG. 19 is another diagram of a multistage extraction step.

Referring now to FIGS. 3, 18 and 19, it is noted that the solvent diluted deasphalted bitumen 26 can be recycled back into a downstream stage of the extraction and/or pre-wash, which can facilitate enhanced performance. In FIG. 3, the solvent diluted deasphalted bitumen 26 is recycled back into the second stage of a two-stage extraction scheme. FIGS. 18 and 19 illustrate that there may be "n" stages and the solvent diluted deasphalted bitumen 26 is recycled back into the $n^{th}$ stage. Each stage produces a tailings material that becomes more bitumen depleted, and a solbit material that becomes more bitumen enriched as it flows toward the first stage until the final solbit stream 20 is generated by the first stage 34. It is also noted that the multistage extraction and/or pre-wash can be provided so that one or more stages are performed in distinct dedicated extraction vessels, which have appropriate inlets and outlets interconnected by piping to transport material therebetween, as shown in FIG. 19.

Alternatively, the multistage extraction can be provided so that one or more stages are performed in a single extraction vessel so that the solids and solbit materials are transported counter-currently within the vessel, as schematically shown in FIG. 18. It is noted that the "stages" within a single extraction vessel do not have to correspond with distinct structural zones delineated from each other within the vessel, but may be defined as theoretical zones within the extraction vessel. For example, in a two-stage arrangement, the first stage tailings 48 from a first extraction stage 34 can be transported downstream to a second extraction and/or pre-wash stage 36 within the single extraction vessel, whereas the second stage solvent-bitumen stream 40 generated from the second extraction and/or pre-wash stage 36 can be transported upstream in a counter-current arrangement within the vessel, for use in the first extraction stage 34. Likewise, the first stage tailings 48 could be moved in an upstream direction, whereas the second stage solvent-bitumen stream 40 may travel in a downstream direction. Similar counter-current arrangements can be used for multistage counter-current extractions having "n" stages, by increasing the number of sequential stages accordingly.

The multistage extraction therefore provides a scheme where the mixture of DAO and solvent (e.g., solvent diluted deasphalted bitumen 26) is added to a solids material after a previous stage of solid-liquid separation to displace entrained liquid in the sands to provide washing functionality prior to the washing stages in which the tailings can be washed counter-currently with substantially pure solvent. Therefore, the tailings of the extraction stage sent to the washing stage contains entrained liquid similar to the DAO-solvent mixture, rather than entrained raw bitumen which can be the case for a single stage extraction scheme. Since the bitumen content in tailings 18 would include DAO instead of raw bitumen, the washing stage 44 will precipitate a smaller amount of asphaltenes due to the lower amount of asphaltenes in the DAO rather than the higher asphaltene content that would be present in the raw bitumen. The multistage extraction approach, whether single-current or counter-current, therefore provides an effective way of replacing the entrained raw bitumen (i.e., bitumen from the ore) with DAO in the tailings that are subsequently subjected to washing, thereby reducing the asphaltene rejection onto the sand during washing and, in turn, reducing the overall bitumen loss (i.e., due to asphaltene rejection) and bitumen/asphaltene content on the bulk sand sent to the drying/solvent recovery.

This multistage extraction approach can enable several functions. First, as mentioned above, it can decrease the likelihood and amount of asphaltenes precipitating on bulk sand by replacing the bitumen entrained in the solids by deasphalted bitumen prior to washing with pure solvent in the washing stage. Second, this multistage extraction approach can decrease the S/B ratio of the liquid sent to upstream extraction stages by first mixing the DAO/solvent mixture (which has a high S/B ratio) with the liquid entrained in the solids produced by an upstream extraction stage (extraction stage product with lower S/B ratio) before providing it to the upstream extraction stage. This further decreases the likelihood of asphaltene precipitation in the overall extraction stage.

The multistage extraction can have two, three or more stages and can be implemented in various ways. The solvent diluted deasphalted bitumen 26 can be fed into the nth stage (i.e., the most downstream stage) of the multistage extraction and/or pre-wash, or can be fed into one or more stages that are considered downstream of the primary or first stage of extraction. It is also noted that some solvent and/or DAO could also be fed into the first extraction stage, if desired, in addition to feeding the solvent diluted deasphalted bitumen 26 to at least one downstream stage.

Implementations with Process Integrations for Bitumen Production

Various process configurations and implementations can be envisioned where paraffinic solvent is used along with deasphalted oil for the extraction of bitumen from oil sands. Certain process implementations involve integration strategies for leveraging different process features to enhance product quality, reduce energy requirements, lower solvent demand, and/or provide other enhancements to the NAE process.

For example, the process can be configured so that substantially all of the solvent diluted bitumen produced in the extraction stage is supplied to the deasphalting stage, and only a portion of the solvent diluted deasphalted bitumen is recycled back to the extraction stage with the remaining non-recycled portion of the solvent diluted deasphalted bitumen being subjected to solvent recovery to produce the bitumen product stream. Since this bitumen product stream has been subjected to deasphalting, the water and mineral solids have been removed and it does not require further solids-removal treatments, such as filtering or centrifuging. In the process implementation of FIG. 3, it may be more challenging for the product stream 32 to meet fungible pipeline product specifications and would require filtration or other processing steps to further remove solids. In contrast, deasphalting the entirety of the solvent diluted bitumen generated by the extraction stage 12 and then recycling a portion of the deasphalted stream, as per FIG. 4, facilitates the production of a fungible bitumen product while leveraging benefits of recycling solvent and deasphalted oil back into the extraction stage. Other examples of distinct features in this process implementation include the filtration and washing stages for cleaning the solvent diluted tailings 18, the integration options for the resulting filtrate and solvent wash liquor within the process, as well as heat integration where a hot recovered solvent is used for pre-heating another stream, e.g., the feed stream entering the deasphalting stage.

Figure 4:
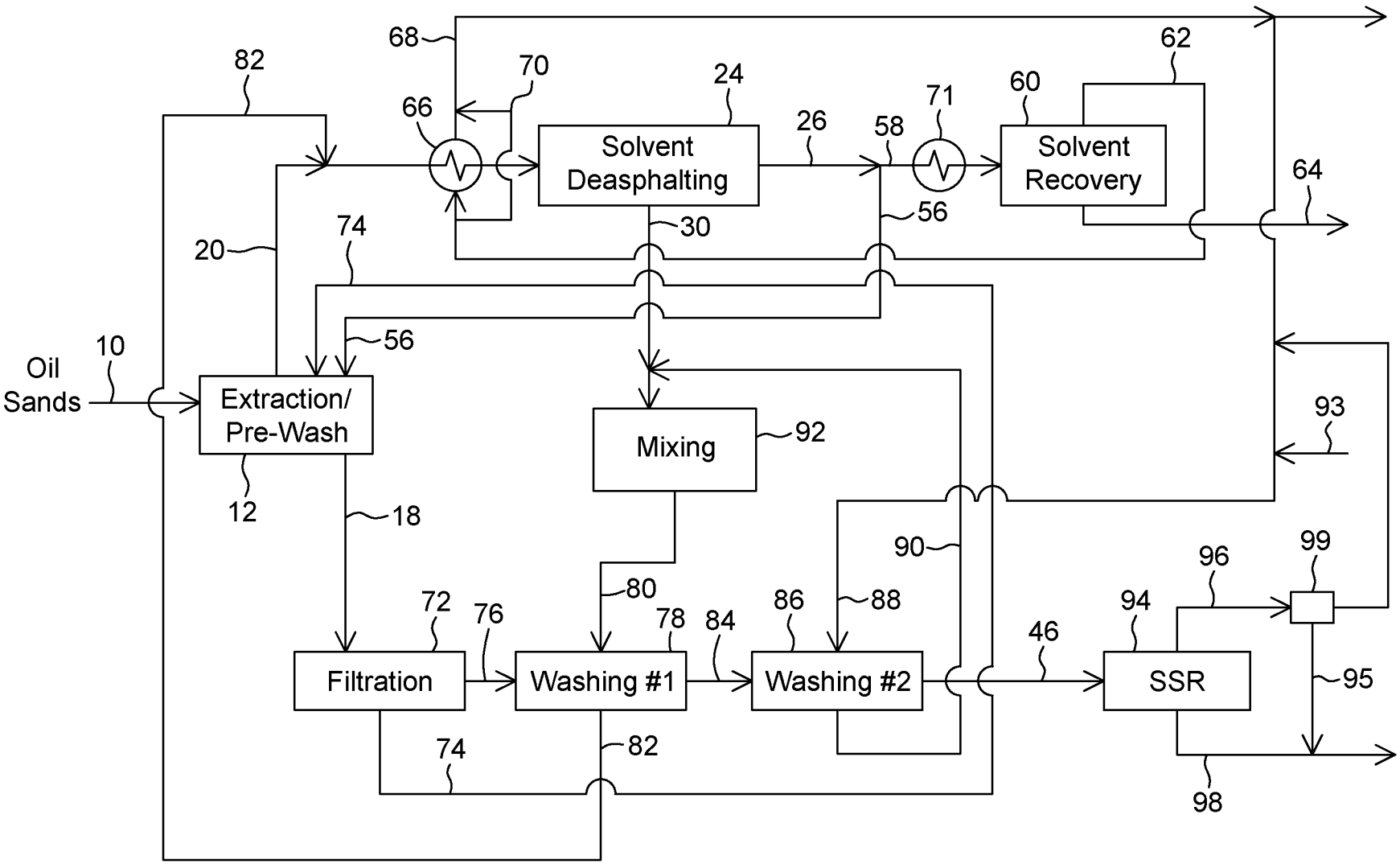
FIG. 4 is a block diagram of a process for producing bitumen from oil sands using paraffinic solvent and having various process integration features.

Referring to FIG. 4, in some implementations the solvent diluted bitumen 20 can be supplied substantially or in its entirety to the solvent deasphalting stage 24, and a recycle portion 56 of the solvent diluted deasphalted bitumen 26 is supplied back into the extraction and/or pre-wash stage 12. The remaining portion 58 of the solvent diluted deasphalted bitumen 26 can be supplied to solvent recovery 60 to produce a recovered solvent 62 and a solvent recovered bitumen 64 that can be a fungible bitumen product after solvent recovery. For example, all of the solvent diluted bitumen 20 or at least 90%, 95% or 99% of it can be supplied to the deasphalting stage 24 in this process configuration. Alternatively, a smaller proportion of the solvent diluted bitumen 20 can be supplied to the deasphalting stage (e.g., 20%, 30%, etc.). The remaining portion of the solvent diluted bitumen 20 not sent to deasphalting could be subjected to other treatments or could bypass the deasphalting stage and rejoin with the deasphalted stream. This type of bypassing could facilitate control of solbit processing depending on desired specifications for the product bitumen. For instance, if lower asphaltene content is desired, substantially all of the solvent diluted bitumen 20 be supplied to the deasphalting stage 24; but if higher asphaltene contents are permissible or desired, then a portion of the solvent diluted bitumen 20 can bypass the deasphalting stage and rejoin the solvent diluted deasphalted stream.

Still referring to FIG. 4, the recovered solvent 62 is at a relatively higher temperature compared to other streams and thus can be used for heating other process streams. For example, the recovered solvent 62 can be used for indirect pre-heating of the solvent diluted bitumen 20 to which deasphalting solvent may have been added prior to the deasphalting stage 24. At least a portion of the recovered solvent 62 can be passed through a heat exchanger 66 to produce a preheated solvent diluted bitumen and a cooled solvent stream 68. In addition, a bypass line 70 can be provided so that a portion of the recovered solvent can bypass the heat exchanger 66, which can be useful for controlling the operation of the heat exchanger. Depending on the heating requirements, the flow rate of the recovered solvent 62 that is used for pre-heating can be controlled by varying the flows through the heat exchanger 66 and the bypass line 70. Another option is to use some or all of the recovered solvent 62 for preheating the remaining portion 58 of the solvent diluted deasphalted bitumen 26 prior to solvent recovery 60, using a heat exchanger 71.

In some implementations, the solvent diluted tailings 18 withdrawn from the extraction and/or pre-wash stage 12 can be supplied to a solid/liquid separation stage, such as a filtration stage 72, to produce a filtrate 74 that includes solvent and residual bitumen and a filtered tailings material 76. The filtrate 74 can be recycled back into the extraction and/or pre-wash stage 12 to provide part of the paraffinic solvent used for extraction. The filtered tailings material 76 can then be subjected to washing, which can include a multistage washing arrangement. Indeed, there are a number of options to recycle a portion of various streams to previous stages (e.g., various solvent-bitumen mixtures can be recycled back to different parts of the extraction and/or pre-wash stage 12 to supply solvent thereto; a portion of stream 20 can be recycled back to the extraction stage 12 to increase the L/S ratio and control the S/B ratio in the extractor, and so on).

For example, the filtered tailings material 76 can be supplied to a first washing stage 78 that receives a first stage solvent wash 80 and produces a first stage wash liquor 82 and a first stage washed tailings 84. The first stage washed tailings 84 can then be supplied to a second washing stage 86 that receives a second stage solvent wash 88 and produces a second stage washed tailings as the washed tailings 46 and a second stage wash liquor 90. The second stage wash liquor 90 can be supplied to mix with the bottom asphaltene fraction 30 generated by the deasphalting stage 24 and then supplied to a mixing stage 92. The mixing stage 92 is provided to mix the precipitated asphaltenes with solvent to disperse the asphaltenes and form a slurry therefrom to recover entrained bitumen from the asphaltene phase and facilitate distribution of the material in the washing stage. In addition, distributing the precipitated asphaltenes over the sand in the washing stage can be challenging if the asphaltene material is insufficiently fluid, and so mixing solvent with the asphaltene rich fraction can help with fluidity and therefore distribution in the washing stage.

The mixing stage 92 can also serve as a solvent quenching step where the second stage wash liquor 90 is used to quench and thus reduce the temperature of the bottom asphaltene fraction 30 prior to introduction into the washing stage, for example. It is noted that a separate quenching step using a solvent containing stream used as the quench liquid could be performed prior to or after the mixing stage 92, and the quenching itself could include multiple stages in series or parallel. The solvent quench liquid, which may be or include at least part of the second stage wash liquor 90, can be pre-cooled by passing through a cooler prior to its addition to the asphaltene fraction 30. In one example, the solvent quench liquid could be cooled close to ambient temperature, e.g., around 25° C., and then added to the hot asphaltene fraction 30 to bring its temperature down by 20° C. to 50° C. compared to the SDA stage's operating temperature. The solvent quench liquid could be pre-cooled by 20° C. to 40° C., for example, prior to quenching the hot asphaltene fraction so that the resulting stream is close to the temperature of the washing stage. Of course, the solvent quench liquid could include one or more of various solvent streams, such as make-up solvent, second stage wash liquor 90, and other solvent sources.

The asphaltene-solvent slurry that is withdrawn from the mixing stage 92 can be fed, at least in part, as the first stage solvent wash 80, as illustrated in FIG. 4. Additional solvent wash streams (not illustrated here) can also be provided to the first washing stage. In the implementation illustrated on FIG. 4, the asphaltene-solvent slurry is distributed onto the tailings coming from filtration and passing into the first washing stage, to provide solvent to that washing stage and to introduce the precipitated asphaltene material into the washing stage.

There are many options for using fresh solvent and liquid product of each stage to be added to various streams in this scheme; for example, fresh solvent may be used along with liquid product from the later stages of washing of the sand to wash the asphaltenes. It is also noted that the bottom asphaltene fraction 30 could be incorporated into the washing stage in various other ways. For example, the bottom asphaltene fraction 30 could be mixed with the solvent diluted tailings 18 prior to introduction into the filtration or washing stage, could be mixed with the filtered tailings 76 (e.g. in the mixing stage 92) before being introduced into the washing stage as a mixed stream comprising solvent, mineral solids, residual bitumen and precipitated asphaltenes.

Asphaltenes from deasphalting stage 24 may be washed in multiple stages separately or together with the rest of solids from the extraction stage 12. The solids from stage 92 may be settled separately and sent directly to solvent recovery.

FIG. 4 shows that the second stage solvent wash 88 can be obtained as a portion of the cooled recovered solvent 68, fresh make-up solvent 93, and/or other solvent sources. The second stage solvent wash 88 may be the purest solvent material that is introduced into the overall process, and as such it can provide good final cleaning of the mineral solids to wash off residual bitumen. A small amount of asphaltenes (e.g., 1-2 wt. % of the bitumen in the ore) may be produced in the second stage of washing as a result of contact between residual bitumen in first stage wash tailings 84 and substantially pure solvent 88.

The washed tailings 46 can then be sent to a sand solvent recovery (SSR) stage 94 to remove solvent from the solid mineral material. In the sand solvent recovery stage 94, heat can be used to evaporate solvent from the solids to produce a solvent vapour 96 and a dried solids material 98. The sand solvent recovery stage 94 can thus be operated at higher temperatures compared to most of the other unit operations of the process. The sand solvent recovery stage 94 can also be referred to as a tailings solvent recovery stage, and can be implemented using a sand solvent recovery unit (SSRU). The washed tailings 46 can be in the form of a cake-like material and therefore solids handling can be implemented for this material as well as the dried solids material 98 from the sand solvent recovery stage 94. The solvent can be recovered from the washed cake material by any number of multiple solvent recovery techniques and the solvent can be recycled for further bitumen extraction. Steam stripping, rotary drying and other techniques have been successfully tested for solvent removal from washed tailings. The product stream exiting the SSRU will be "dry tailings" with very low solvent and bitumen content and can be directly back hauled to the mine for reclamation, for example, although other transport methods are also possible. The solvent vapour 96 can be fed to a condenser 99 to produce condensed solvent that is added back into solvent stream 88. Condensed water stream 95 can be added to the dry tailings stream 98 to make the dry tailings stream 98 more hydrophilic, for example if required by a reclamation process.

Figure 5:
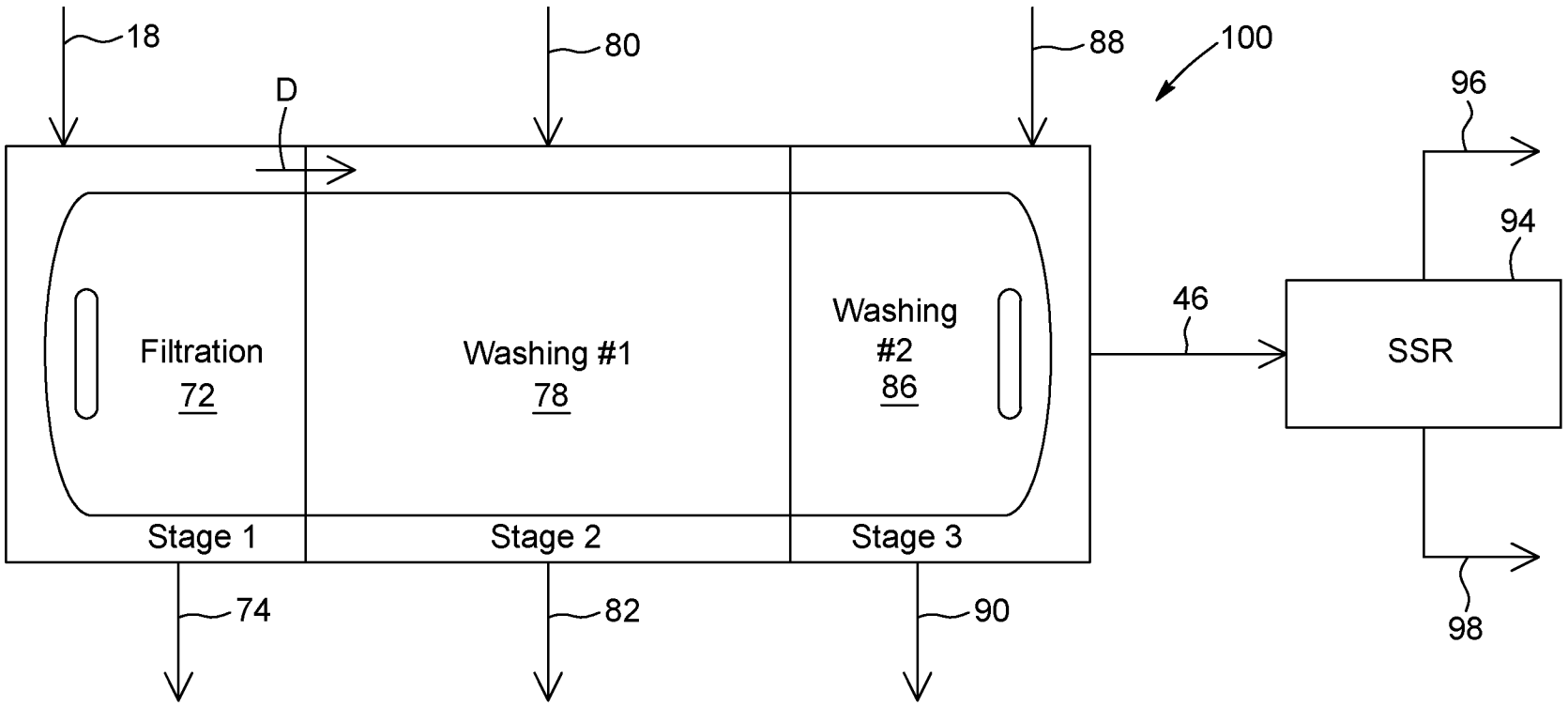
FIG. 5 is a block diagram of a part of the process showing a solid/liquid separation (in this example, filtration), washing and sand solvent recovery stages.
Figure 14:
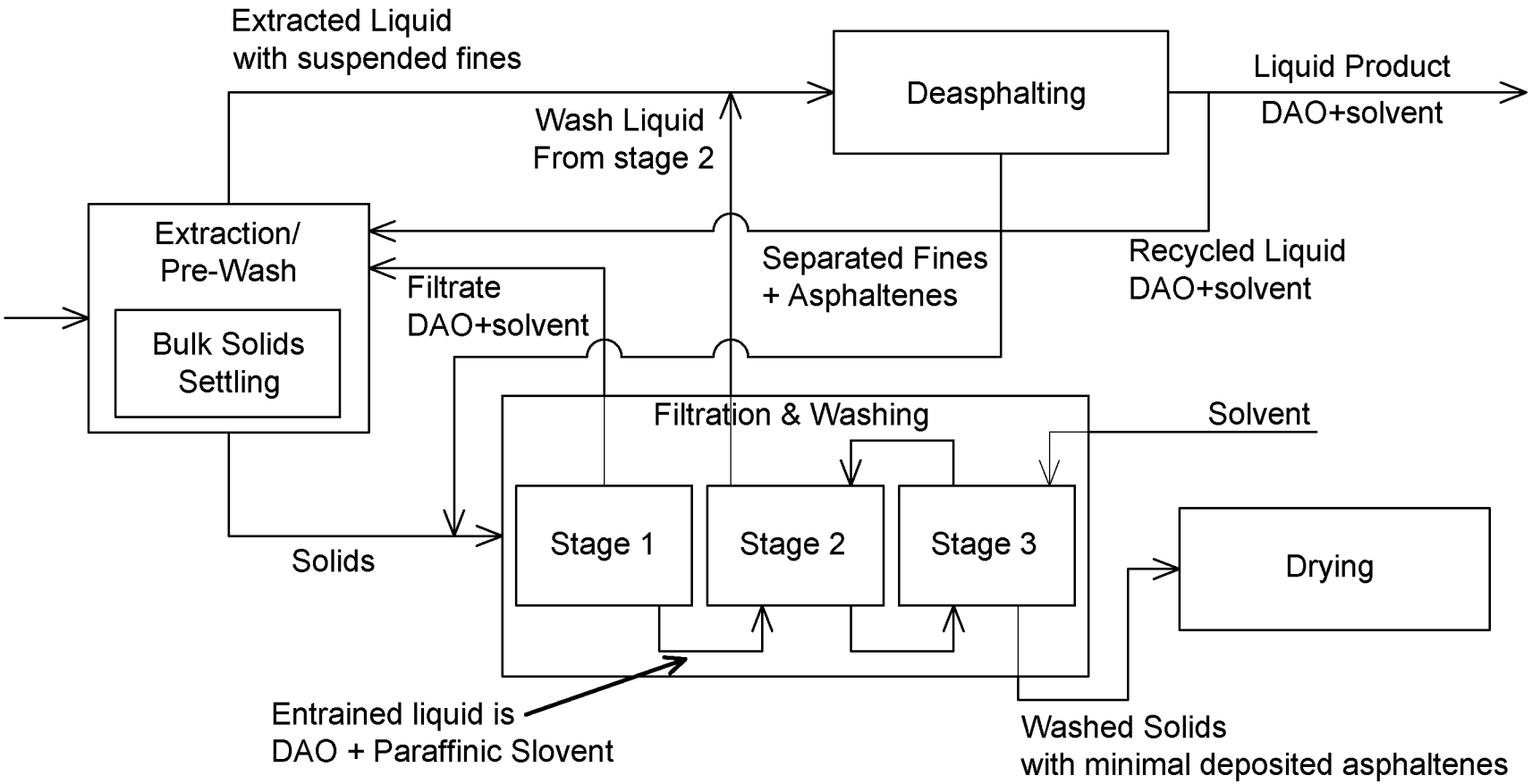
FIG. 14 is another block diagram of a process for producing bitumen from oil sands using paraffinic solvent and having process integration features.

The solid/liquid separation (e.g. filtration) and washing stages can each be performed in a distinct vessel or unit, or they can be performed in an integrated unit that is configured to enable multiple functionalities. FIGS. 5 and 14 schematically illustrate an integrated filtration and washing unit 100 for enabling filtration and washing stages. FIG. 5 illustrates the tailings material moving in direction (D) while solvent drains downward as it washes the tailings and carries residual bitumen with it out of the unit for integration elsewhere in the process. The unit operations that are conducted on the solvent diluted tailings 18 produced by the extraction stage 12 can be configured in various ways to enable solvent and bitumen removal from the mineral solids. For instance, operations such as draining and washing can be used to recover the desired fluids and produce a tailings material that is ready for final solvent recovery to prepare the mineral solids for disposal.

Referring now to FIG. 14, one implementation of the process is shown where filtration is used along with washing stages. FIG. 4 illustrates a similar process configuration where the input and output streams of the filtration and washing stages are integrated with certain other stages. FIG. 14 shows a filtration stage as the first solvent removal stage for the solvent diluted tailings followed by washing stages. It is also noted that the filtration stage can be combined with a washing stage such that filtration and washing occur simultaneously.

Figure 15:
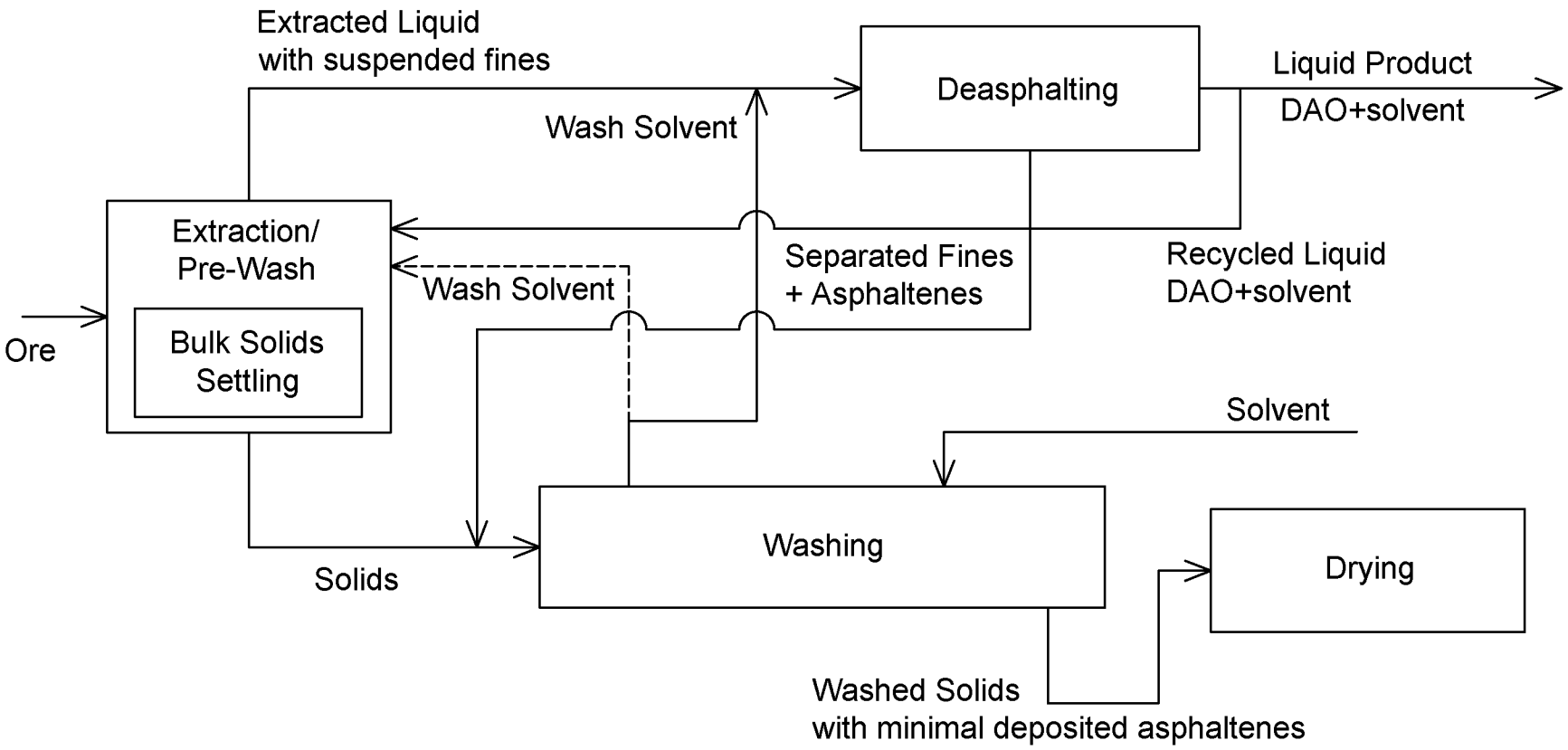
FIG. 15 is yet another block diagram of a process for producing bitumen from oil sands using paraffinic solvent and having process integration features.

Referring to FIG. 15, another implementation of the process includes feeding the solvent diluted tailings from the extraction stage directly into a washing operation without filtration. Removing filtration can reduce process complexity by removing a unit operation. Alternatively, other forms of solid/liquid separation may be used in place of filtration.

It is also noted that solvent removal from the mineral solids can include various steps, unit operations and equipment. For example, there may be an initial bulk solvent removal step followed by a residual solvent removal step. The bulk solvent removal step can be conducted at lower temperatures and energy input levels compared to the residual solvent removal step, for example. One example of the bulk solvent removal step is drainage through a filter, with or without displacement of the liquid by an inert gas or solvent vapour. One example of residual solvent removal uses drying which could reduce the remaining solvent concentration to below 100 ppmw or another threshold (e.g., below 50 ppmw, 20 ppmw, 10 ppmw or 5 ppmw), and could allow for direct disposal of the sands to the mine for immediate reclamation. Practically speaking, the bulk solvent removal is often accompanied by residual bitumen recovery from the solids. Various conventional methods for solvent recovery, beyond free drainage of solvent from the solids, could include the following: thermal drying with steam, direct contact heating and/or electrical heating, gas stripping, washing and/or displacement with an environmentally benign fluid. To reduce the level of suspended fines, the fluid could be filtered, or the fines allowed to settle under normal or enhanced gravity conditions (e.g., centrifuges). Settling rates for the fines could also be enhanced by flocculation with the aid of additives. However, by supplying the solvent wash liquor to the deasphalting stage, the fines entrained in the liquor can be removed via precipitation with the asphaltene aggregates, which means that intermediate processing (e.g., fines removal) can be avoided. Nevertheless, mineral solids could be removed by dedicated steps and equipment at any point in the process, if desired; for most diluted mixtures gravity settling may be adequate for fines removal with the removed fines being added back to the bulk solids and fed through subsequent washing and drying stages. In terms of solids removal, streams that have lower bitumen content are easier to remove solids from while higher bitumen content streams are more challenging and thus processing and equipment can be adapted accordingly based in part on the bitumen content.

The processes described herein can facilitate certain enhancements over conventional methods. For instance, the process can enable a controlled level of deasphalting of the extracted bitumen in specific areas of the overall operation, which can be done by avoiding asphaltene precipitation during the extraction stage and then performing asphaltene precipitation in a dedicated deasphalting stage. As mentioned above, deasphalting is achieved using a paraffinic solvent (e.g., pentane, hexane, heptane or mixtures thereof). The solvent may contain small fractions of non-paraffinic components as long as it can induce asphaltene precipitation from bitumen at a reasonably low S/B ratio). The conventional hot water extraction (HWE) process has been shown to be highly sensitive to the clay content in the ore, economic only for oil sands with at least 7 wt % bitumen content, and to produce wet suspended tailings that are challenging to settle and dispose of, resulting in tailings ponds and associated tailings management costs. The HWE process is also constrained by available water of suitable quality for the extraction process. In contrast, NAE of bitumen with hydrocarbon solvents has the potential to be economic over a broad range of ore qualities (e.g., 5 wt %-13 wt % bitumen, 20-40% fines), to produce dry trafficable tailings and less land disturbance, and to lower the greenhouse gas (GHG) emissions per barrel of bitumen compared to aqueous extraction. Another main advantage of the process is that as the produced bitumen from the ore is displaced with a liquid containing partially deasphalted oil prior to subsequent stages of washing with pure solvent, the amount of asphaltenes precipitating on the bulk sand during the washing process is minimized.

In the present paraffinic solvent assisted NAE process, mined oil sands ore can be prepared for extraction using various techniques. For example, the mined oil sands ore can be crushed and sized to a desired lump size range. Then, bitumen is extracted from sized oil sands in an extraction stage, which uses at least one extractor, in the presence of paraffinic solvents and an additional bitumen-based liquid. The extra bitumen that is added during extraction can be obtained or derived from various sources and can have various properties. For example, the bitumen-based liquid can include bitumen that has been partially deasphalted to different degrees or fully deasphalted. The deasphalted bitumen used in extraction can be obtained from downstream processing of the solvent diluted bitumen produced by the extraction stage within the same process train, as shown in FIG. 4, or it can be obtained from a parallel process train or another process. In addition, before being fed into the extractor, the sized oil sands feed is inerted (oxygen removed). Inerting is performed for safely managing the volatile solvent to avoid formation of certain flammable solvent-air mixtures.

The use of deasphalted bitumen during the extraction stage facilitates increasing the asphaltene onset threshold due to the asphaltene solubility in deasphalted bitumen components while leveraging the bitumen extraction properties of the paraffinic solvent. With this mixture of solvent and deasphalted bitumen that forms a solvating mixture, the paraffinic S/B ratio can be well controlled in the extractor to avoid asphaltene precipitation in the extraction stage.

Referring still to FIG. 4, the extraction and/or pre-wash stage 12 can be performed using an extractor, which can have various design and operational features. For example, the extractor can be configured to have certain mixing or shear components in order to encourage removal of bitumen from the solid mineral particles of the oil sands. The extractor can also be configured to add heat to the slurry for example by recirculating steam lines. The extractor is also equipped with inlets and outlets to enable the addition of the oil sands, solvent and deasphalted bitumen as well as the removal of the product and tailings streams. The product and tailings streams can be removed as overflow and underflow streams, respectively, but various other arrangements are also possible. The inlets and outlets of the extractor can be provided and located depending on the extractor design. The extraction stage can also be operated so that the oil sands and the solvating mixture are mixed with sufficient energy and for a sufficient period of time to extract at least 90% of the bitumen or at least 91%, 92%, 93%, 94% or 95% of the bitumen. The shear and mixing can also be provided in order to mitigate the suspension of fines in the solvent diluted bitumen.

It is also noted that the extraction stage can be conducted in a single counter-current extractor that is sized and configured for extracting at least 90% of the bitumen in the oil sands. Alternatively, as described further above, the extraction stage can be performed in multiple extractors arranged in series, such as the two-stage extraction implementation, where the overall bitumen extraction level is at least 90%.

In some implementations, the solvent diluted bitumen 20 is removed from the extractor as an overflow stream and is mainly composed of bitumen, solvents and a small amount of water and solids. This solvent diluted bitumen 20 can also be referred to as "solbit" herein. The solvent diluted tailings 18 can be removed from the extractor as a bottom slurry that mainly contains mineral solids, water, solvents and bitumen. The solvent diluted tailings 18 can have fluidity to be pumpable to the subsequent processing stage.

After extraction, the solbit 20 can be heated to a target operating condition (e.g., temperature, pressure, etc.) and mixed with more paraffinic solvents at a prespecified ratio before being fed to a deasphalting unit, in which a controlled deasphalting process takes place to meet desired product specification. The pre-heating can be conducted before adding the paraffinic solvent to ensure that little to no precipitated asphaltenes are present in the fluid that passes through the heat exchanger, thereby reducing fouling issues in the heat exchanger. In this regard, the extraction stage can be operated and controlled so that the S/B ratio of the solbit 20 is low enough to avoid asphaltene precipitation upon heating to a higher temperature, since heating can induce precipitation at certain S/B ratios. Alternatively, as shown in FIG. 4, the heat exchanger can be downstream of solvent addition into the solbit 20.

In the deasphalting stage, the settling rates, which affect the process throughput and equipment sizing, are controlled by operating at specific temperatures and S/B ratios. The key product specifications include fines and water contents. The water content is also related to chlorides content. The overflow from the deasphalting unit (also referred to as "supernatant") can be used as the mixture of deasphalted oil and solvent with very low solids and water content, a portion of which is recycled back into the extraction stage. The underflow of the deasphalting unit mainly contains mineral solids, precipitated asphaltenes and some bitumen and solvents.

In some implementations, the underflow stream of the deasphalting unit (also referred to as the bottom asphaltene fraction 30 herein) can be combined with the extractor bottom slurry 18 at an intermediate step for further bitumen and solvent recovery. The underflow stream 30 of the deasphalting unit and the extractor bottom slurry 18 can be pre-combined together before being fed downstream for further processing, or they can be fed individually into different stages of the downstream process. FIG. 4 illustrates one implementation where the underflow or bottom fraction 30 of the deasphalting unit is first supplied into a mixing stage 92 and then into a washing stage, while the extractor bottom slurry 18 is fed into a filtration stage 72 and then into the washing stage. FIGS. 14 and 15 show another implementation where the underflow stream 30 of the deasphalting unit is fed into the extractor bottom slurry 18, and then the combined stream is fed into the filtration and/or washing stages. It is noted that these two streams 18, 30 can be combined in various ways in the downstream processing units to efficiently recover bitumen and solvent therefrom.

In some implementations, a supercritical fluid that has solvent properties (e.g., $CO_2$) could be applied to the recovery of bitumen and solvent from various tailings streams, such as the extractor bottom slurry stream or cakes from the filtration and/or washing stages. Compared with fresh oil sands, this supercritical fluid application can have higher efficiency for hydrocarbon extraction when it is applied to the process streams described above. Known methods using supercritical fluid could be applied to such solids rich tailings streams for bitumen and/or solvent recovery. A recovery stage using supercritical fluid could replace the washing and/or drying stages, for example. Other displacement fluids that could be used include water and steam.

As noted above, solvent that remains in the extractor bottom slurry and precipitated asphaltene streams is recovered. Possible recovery steps include solid/liquid separation (e.g. filtration) and washing. The sand and asphaltenes can then be fed to a sand solvent recovery unit (SSRU) to recover remaining solvents and meet solvent loss requirements. The dry tailings produced from the SSRU have only trace solvent content and residual bitumen content and are readily disposable into a mine pit, for example, as reclamation material. The solvent and bitumen contents are within limits to enable the material to be disposable into mine pits as are defined by regulatory bodies. Thus, mine reclamation can occur immediately after the mining operations, thereby significantly reducing tailings management costs and longer-term reclamation issues.

Various implementations of the processes described herein address challenges of NAE of bitumen from oil sands. For example, such challenges include the safe, cost effective separation of bitumen from oil sands, the recovery of the solvents from the various streams and mixtures, and technology scale-up to commercial scale operations. Accordingly, the NAE process can be implemented so that the oil sands digestion and bitumen extraction operations occur in equipment which can be operated safely, reliably and cost competitively compared to other sources of bitumen. This can be done using process simplification and process intensification, e.g., conducting multiple operations in fewer processing units and smaller equipment than the current HWE process. The NAE process can be implemented so that it produces a fungible (e.g., pipelineable to multiple customers on common carrier pipelines), low fines bitumen product. The NAE process can also be implemented so that high levels of solvent recovery are enabled, while maintaining a low or minimum level of process complexity to deliver low capital and operating costs. The presence of asphaltenes may lead to some preferred process implementations for the filtration, washing and drying processes. Since the presence of asphaltenes may slow filtration and/or washing, these stages can be adapted accordingly by, for example, increasing residence time, providing higher solvent flow rates for washing, providing higher vacuum conditions for the belt filter, and/or increasing pore size or open area of the belt filter. Asphaltene precipitates could come from two sources: the precipitated asphaltenes from the solvent deasphalting stage (also referred to as SDA asphaltenes) and deposited asphaltenes on the sand itself due to contact with wash fluids with high solvent content. The SDA asphaltenes could be washed and dried separately from the bulk sand instead of adding it to the mineral solids, and this could be done using separate washing and drying equipment that could have a reduced size compared to the equipment for washing and drying the mineral solids. Asphaltenes deposited on the sand could lower porosity and permeability of solid cake, and thus the washing and drying stages could be adapted accordingly. The NAE process can also be operated to have comparable or lower GHG emissions compared to existing HWE processes.

Implementations of the process can have additional features that facilitate efficient production of bitumen using NAE techniques. For example, process simplification can be used as a design strategy, such that several process steps are combined to reduce overall cost and process complexity. For instance, oil sands digestion and bitumen extraction can be combined in a single processing unit in which crushed oil sands ore is further digested to enable size reduction to relatively small particles using mixing and shear, and bitumen extraction from the small particles is facilitated by solvation and mixing. Alternatively, the digestion and extraction could be conducted in different units.

In addition, the integration of solvent deasphalting to precipitate asphaltenes from the solvent diluted bitumen and simultaneously remove fine solids that were entrained during extraction can facilitate production of a clean dry bitumen product that contains less than 0.5 wt % bottom solids and water (BS&W) (e.g., ideally solids content of less than 300 ppmw). This results in a higher value, pipelineable product that requires less diluent than straight bitumen.

It is noted that the properties of the different materials and compounds present in the extraction stage can be characterized in various ways. For example, the extraction stage can have an L/S ratio, which refers to the ratio of the liquid phase to the solids phase in the extraction stage or a given extraction vessel. The liquid phase would include the paraffinic solvent, the deasphalted oil, as well as some moisture and liquid-phase bitumen from the oil sands itself; while the solids phase would mainly include the mineral solids of the oil sands, which includes sand, silt and clay. However, it is also noted that the contents of the extraction stage can be characterized in other ways, such as by a ratio of solvent and deasphalted oil (which can be referred to as "S-DAO") to oil sands ore input into the extraction stage or vessel, i.e., S-DAO/ore ratio. The L/S ratio, the S-DAO/ore ratio, or both, can be controlled to provide desired extraction conditions. Increasing the S-DAO/ore ratio would generally lead to a corresponding increase in the L/S ratio, although these ratios can be independent and can also depend on other factors, such as the moisture and bitumen content of the ore. As an example, the L/S ratio can be increased by having a higher residence time for the liquid compared to the solid phase and/or by recycling a portion of the liquid product back into the extraction stage.

It is noted that the ratio of DAO/ore can also be controlled for the extraction stage. For example, the DAO/ore ratio can be between 0.02 and 0.20, between 0.05 and 0.15, or between 0.08 and 0.12. The DAO/ore ratio that is used for a given implementation of the process can depend on various factors, including the desired L/S ratio in the extraction stage and the processes used to recover residual bitumen from the solvent diluted tailings. It is also noted that other DAO/ore ratios could be used in extraction vessels, depending on operating conditions. These DAO/ore values are based on the total DAO and ore fed into the overall extraction stage that can include one or more sub-stages.

In terms of S/B ratios used in the extraction stage, this will depend on the type of solvent, the precipitation onset for given operating conditions, and the DAO/bitumen ratio in the extraction stage. The S/B ratio in the extraction stage can be between 0.25 and 4, or between 0.25 and 2, or between 0.4 and 2, or between 0.5 and 2 or between 0.5 and 1.5, or between 0.7 and 1.5, for example. Another way to define the S/B ratio in the extraction stage is to be at most 85% of the DAO-modified onset-S/B, which is the S/B ratio at the same operating conditions at which the first particles of asphaltenes are detectable (e.g., by eye, filtration or microscopy) when the DAO is present. The extraction S/B ratio (also called $S/B_E$ ratio) can also be up to 50% more than the original onset-S/B (i.e., without DAO being present), which is the S/B ratio at the same operating conditions at which the first particles of asphaltenes are detectable (e.g., by eye, filtration or microscopy) when no DAO is present and thus the only bitumen present is that from the oil sands ore. Nevertheless, it is noted that depending on the operating parameters various S/B ratios and other characteristics can be used.

In some implementations, parameters such as the S/B ratios in extraction and deasphalting and L/S ratio in extraction, are provided to enable at least 92% bitumen recovery from the oil sands ore. In some alternative implementations, the S/B ratio in extraction may also be below the precipitation onset, but if the minimum bitumen recovery is achieved it could be above the onset and therefore there may be some precipitation. Nevertheless, in the main implementations, the operating conditions in the extraction stage are below the onset and not too close to the onset such that a change in ore composition could lead to reaching the onset. Since oil sands ore can have a bitumen content variation of about 3% (e.g., 10±3 wt %), the S/B ratio and DAO recycle can be provided to ensure that the conditions are below the onset even if a sudden 3% change in bitumen content were to occur (e.g., from 12 wt % of the ore to 9 wt % of the ore). Thus, the conditions can be provided in the extraction stage to be at least about 15-20% below the onset to make sure that the variation in the ore composition does not lead to the S/B ratio in the extractor to surpass that of the onset.

As mentioned above, the deasphalting stage can be operated to enable partial deasphalting of the solvent diluted bitumen, and the level of asphaltene rejection can depend on various factors and operating conditions. For example, the asphaltene rejection can be provided depending on the bitumen product specification that is desired. In some implementations, the partial deasphalting is performed to enable between 2 wt % and 10 wt % asphaltene rejection based on the total bitumen in the oil sands ore. Since bitumen can often include about 16 wt % asphaltenes, the asphaltene content of the bitumen would be reduced from 16 wt % down to approximately 14% to 6 wt % in this scenario, noting that bitumen losses can be considered to relate asphaltene rejection with asphaltene content in the product. The deasphalting stage can also be operated to enable asphaltene rejection based on the fines content of the ore to ensure desired fines removal. For example, for high fines oil sands ores, a higher asphaltene rejection (e.g., about 4 wt % to 6 wt %) may be performed to ensure desired fines removal. Thus, the ore grade can be a relevant factor in determining the asphaltene rejection of the process, as can be the conditions of the extraction stage and the fines content of the solvent diluted bitumen produced by the extraction stage. Furthermore, asphaltenes may also precipitate during the washing process, thereby contributing to the total amount of asphaltenes removed and the overall yield of the process.

It is also noted that variations of the process can be implemented during different operating modes. For example, during startup mode the DAO and solvent can be obtained from separation sources instead of from the solvent deasphalting stage. In this scenario, the DAO and solvent can be input into the extraction stage as distinct streams or they can be premixed and then fed into the extraction stage as a mixture. If the DAO is added separately, it could be heated or otherwise treated to ensure it has a lower enough viscosity. The DAO and solvent can be obtained from various sources. For example, the DAO could be obtained from a separate process operating at the same facility, bought from the market, or made by batch for dedicated use in the startup of this NAE process. DAO streams can be obtained, for example, from PFT operations or upgrading operations.

Regarding the control of the extraction stage below asphaltene precipitation onset, it is noted that the S/B and DAO provided in the extraction aim to avoid bulk asphaltene precipitation. In some cases, the conditions are provided to avoid or minimize both bulk and localized asphaltene precipitation within the extraction vessel, for instance by ensuring that there are little to no localized S/B ratios that exceed the onset. However, in some other cases, there may be localized asphaltene precipitation to some extent. Even if there is some localized precipitation, once the precipitates move to a region where the S/B ratio is below the onset level, the precipitated asphaltenes can dissolve back into the solbit, at least in part, particularly when little to no water is present in the system.

Potential Process Configurations for Bitumen Containing Materials

Referring now to FIGS. 2, 3, 4, 14, 15 and 17, various process implementations can be used for processing bitumen containing materials in order to produce a bitumen product from which water and solids have been substantially removed while leveraging the production and use of a stream that includes paraffinic solvent and deasphalted oil.

Figure 17:
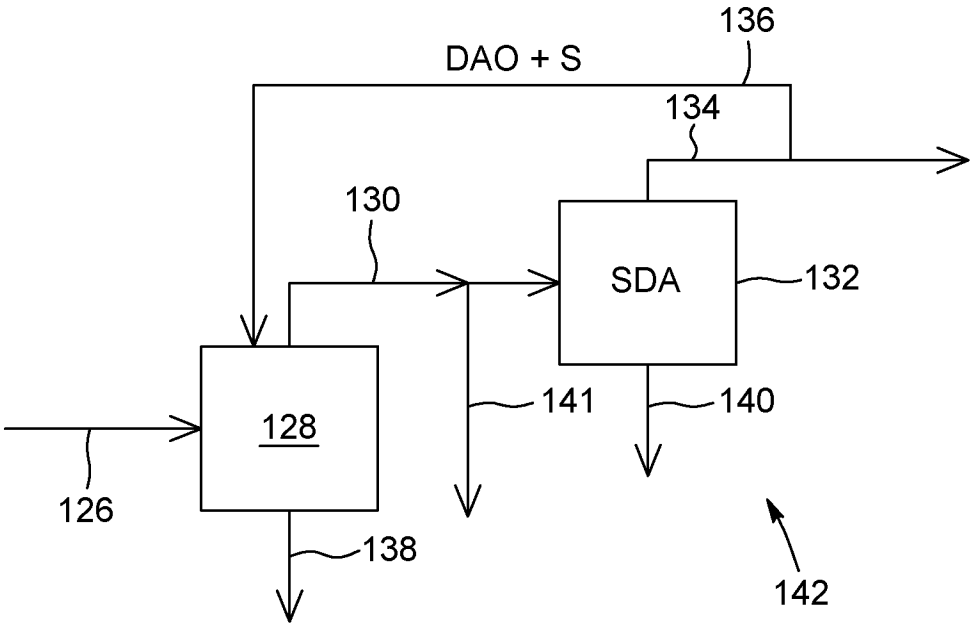
FIG. 17 is a block diagram of a process for treating a bitumen containing material using a recycle configuration.

FIG. 17 in particular shows a "recycle-type" process configuration 124 where the feed stream 126 is fed into a first separation stage 128 to produce first stage product 130 that is then subjected to solvent deasphalting in a second separation stage 132 to produce a solvent diluted deasphalted product 134, at least a portion 136 of which is recycled back into the first separation stage 128 to facilitate that separation process. The first separation stage 128 can be operated under conditions below asphaltene precipitation onset, which is facilitated by the presence of the deasphalted oil in the solvent diluted deasphalted product 134 of the second stage 132. The first and second stages also generate respective tailings streams 138, 140. A first stage product stream 141 can be split off of the first stage product 130.

The "recycle-type" process configuration can be used for processing oil sands ore and other bitumen containing materials having relatively low bitumen content, e.g., below 20%, with the remaining components being water and mineral solids for example, or for processing bitumen containing materials having higher bitumen content. When processing oil sands ore, the first stage can enable both extraction and separation of the bitumen from the sand. When processing materials in which the bitumen has previously been extracted from the mineral solids, the first stage can be a separation stage.

Potential Feed Materials

There are a number of different hydrocarbon containing materials that could be used as the feed to the processes described herein. Some examples are described below.

In terms of feed materials with relatively high mineral solids content and relatively low bitumen content, oil sands ore would be the primary feed material envisioned for this NAE process, particularly for the recycle-type process configuration. However, it is noted that there are several other materials that include hydrocarbons and solids that could be processed.

By way of example, normal or high grade oil sands ore that has been crushed and sized is one feed material that could be used. Alternatively, low grade oil sands ore could be used as a feed material for extraction of bitumen. Various types of oil sands ore could be used, such as oil sands from the Athabasca region in Canada. This NAE process extracts high levels of bitumen over a wide range of ore grade and therefore it may cost effectively extract bitumen from low grade oil sands, which would also expand mine life. In this regard, any water-wet oil sands could be processed using this NAE process.

Another example of a feed material is other oil sands that are not economically processable by hot water extraction methods. For instance, this NAE process could be applied to other types of oil sands from other deposits around the world. This includes oil sands from Utah in the United States that are not water-wet like Athabasca oil sands and therefore not readily extracted by aqueous processes. Thus, oil-wet oil sands or other types of oil sands could be processed using these NAE techniques.

A further alternative application of this technology would be contaminated soil remediation. Hydrocarbon-contaminated soils from spills or leaks as well as industrial sites (e.g., manufacturing, service and storage) contaminated with leaked liquid hydrocarbon can also be ameliorated and cleaned up using this NAE hydrocarbon recovery process. The contaminated soil would be the feed material that is fed into the process for extracting hydrocarbons from the soil.

In terms of feed materials with lower mineral solids content and relatively high bitumen content, materials such as emulsion streams derived from tailings like mature fine tailings, that include hydrocarbons and solids that could be processed using these techniques.

Digestion, Extraction and Separation

In the context of removing bitumen from other components, such as water and mineral solids, there are a number of different process configurations that can be used to perform desired operations. When processing oil sands ore, for example, the overall process implementation can be designed to provide digestion, extraction and separation operations.

"Digestion" can be considered to involve disintegrating the lumps in the sized oil sands material to smaller and smaller sizes using shear based means or a combination of mechanical, fluid, thermal, and chemical energy inputs, with the aim of providing a digested material where the lumps are reduced to individual grains that are coated with bitumen. Breaking down the adherence between the solid mineral grains can involve shearing with dynamic or static mixer devices and/or mobilization of interstitial bitumen using heat or solvent dissolution, for example.

"Extraction" can be considered to involve dissociating bitumen from the mineral solids to which the bitumen is adhered. Bitumen is present in the interstices between the mineral solid particles and as a coating around particles. Extraction entails reducing the adherence of the bitumen to the solid mineral materials so that the bitumen is no longer intimately associated with the minerals. Effective digestion enhances extraction since more of the bitumen is exposed to extraction conditions, such as heat that mobilizes the bitumen and solvent that dissolves and mobilizes the bitumen. Effective extraction, in turn, aims to enhance separation performance in terms of maximizing recovery of bitumen from the oil sands ore and minimizing the bitumen that reports to the tailings. In commercial implementations, target extraction and yield levels can be predetermined.

"Separation" in this context can be considered to involve removing the extracted bitumen from mineral solids, for example, forming a distinct stream or material that is enriched in bitumen and depleted in solid mineral material. Separation mechanisms can include gravity separation in which density differences cause lighter solvent diluted bitumen to rise while heavier solid mineral material sinks within a vessel. In separation, there is a displacement of bitumen enriched, solids depleted material away from bitumen depleted, solids enriched material. In the context of FIG. 4, for example, the extraction stage also includes separation resulting in the production of the solvent diluted bitumen and the solvent diluted tailings. Separation can also involve separating the extracted bitumen from water.

"Washing" can be considered as a displacement of bitumen in liquid phase from the sand slurry to replace bitumen with solvent after bitumen has been extracted from the mineral solids. Washing can be viewed as more akin to separation than extraction, as extracted bitumen is displaced away from the sand.

"Pre-washing" can be considered as the use of a deasphalted oil and solvent mixture as the wash liquor to displace the entrained diluted bitumen from tailings, for example coming from an extraction stage. The expression "extraction or pre-washing stage" refers to a stage in which extraction, pre-washing or both occur in order to remove bitumen from solid material. For example, if the feed to the "extraction or pre-washing stage" has already been subjected to extraction such that substantially all of the bitumen has been dissociated from the mineral solid surfaces, then the "extraction or pre-washing stage" may largely involve pre-washing. On the other hand, if the feed includes oil sands material with a significant amount of bitumen still adhered to mineral solid surfaces, then the "extraction or pre-washing stage" may largely involve extraction as well as some pre-washing.

While digestion, extraction, separation and washing are described above as distinct phenomena, some of them can of course occur to some degree simultaneously within a given process stage. Equipment can be provided for a given process implementation to facilitate the digestion, extraction, separation and washing operations to occur.

Experimentation & Calculations

Various experiments and calculations have been conducted to assess paraffinic NAE techniques and properties.

An implementation of the process similar to that shown in FIG. 3 was tested at lab scale using a medium grade oil sand ore and n-hexane as the solvent. Higher than 90% recovery of the bitumen was achieved after 10 min of moderate mixing at room temperature while producing a mixture comprising 1.5 to 2 volumes of n-hexane per volume of bitumen (solvent to bitumen ratio=1.5-2). For the S/B ratios higher than 1.8 in the final product, the produced bitumen contained less than 0.2 wt % of inorganic solids and water after 30 min of settling. The effectiveness of liquid/solid separation, overall yield of the process considering the loss of material in the deasphalting stage, and drying of solids were also investigated.

Overall, the process at lab scale was effective in producing a high quality bitumen product at high recovery rates, using a relatively volatile solvent, and at low solvent to bitumen ratios. Therefore, the proposed scheme appears to be a cost effective and efficient alternative to the water-based extraction process currently used for bitumen recovery from mined oil sands.

Experimental Procedures

A medium processing oil sands ore was obtained from a sample bank. The bitumen, water and solids content of the ore are reported in Table 1. Bitumen from 4 kg of oil sands was extracted by the Soxhlet extraction method followed by rotary evaporation. N-pentane (99%) and n-hexane (95%) used as solvents in this study were purchased from Fisher™.

Bitumen (~100 g each) obtained from Soxhlet extraction by toluene and subsequent rotary evaporation to remove the solvent was mixed with hexane at 3:1 and 4:1 volumetric ratios (~2:1 and 2.6:1 mass ratio, respectively). The mixture was sonicated for 1 h and left in a closed container at room temperature overnight for the precipitation to complete. Precipitated asphaltenes were separated by filtration, washed and quantified. The filtrate (partially de-asphalted oil) was used for extraction experiments.

TABLE 1

Composition of the medium grade oil sand used in this study

| Component | Sand | Bitumen | Water |
|---|---|---|---|
| wt % | 85.04 | 8.93 ± 0.13 | 6.03 ± 0.04 |

The amounts of asphaltene precipitated for the two solvent-to-bitumen ratios used in this study are reported in Table 2. The asphaltene precipitation rates are determined on a mass basis and converted to volumetric ratios using the densities of 1 and 1.2 g/cm$^3$ for bitumen and asphaltenes, respectively. The two deasphalted mixtures may be referred to as 3:1 and 4:1 DAO (De-Asphalted Oil) in this section of the description.

TABLE 2

Asphaltene precipitation rates vs the solvent to bitumen ratio for the Soxhlet extracted oil/n-hexane mixtures

| Solvent-Bitumen Ratio Vol/Vol | Precipitated Asphaltenes Vol % of Bitumen | Precipitated Asphaltenes wt % of Bitumen |
|---|---|---|
| 3 | 6.9 ± 0.5 | 8.3 ± 0.6 |
| 4 | 8.9 | 10.7 |

Bitumen from Soxhlet extraction was added to 3:1 and 4:1 DAO to obtain a final mixture with 1.7:1 and 2.2:1 volumetric ratios, respectively (final bitumen content: 47 and 41 wt %, respectively). The samples were mixed and left to settle and also analyzed by microscopy. No evidence of asphaltene precipitation was observed in either of the samples. Hexane would induce asphaltene precipitation at a volumetric solvent to bitumen ratio of ~1.5:1. Therefore, deasphalted oil was shown not to induce asphaltene precipitation at solvent contents higher than the precipitation onset.

Figure 6:
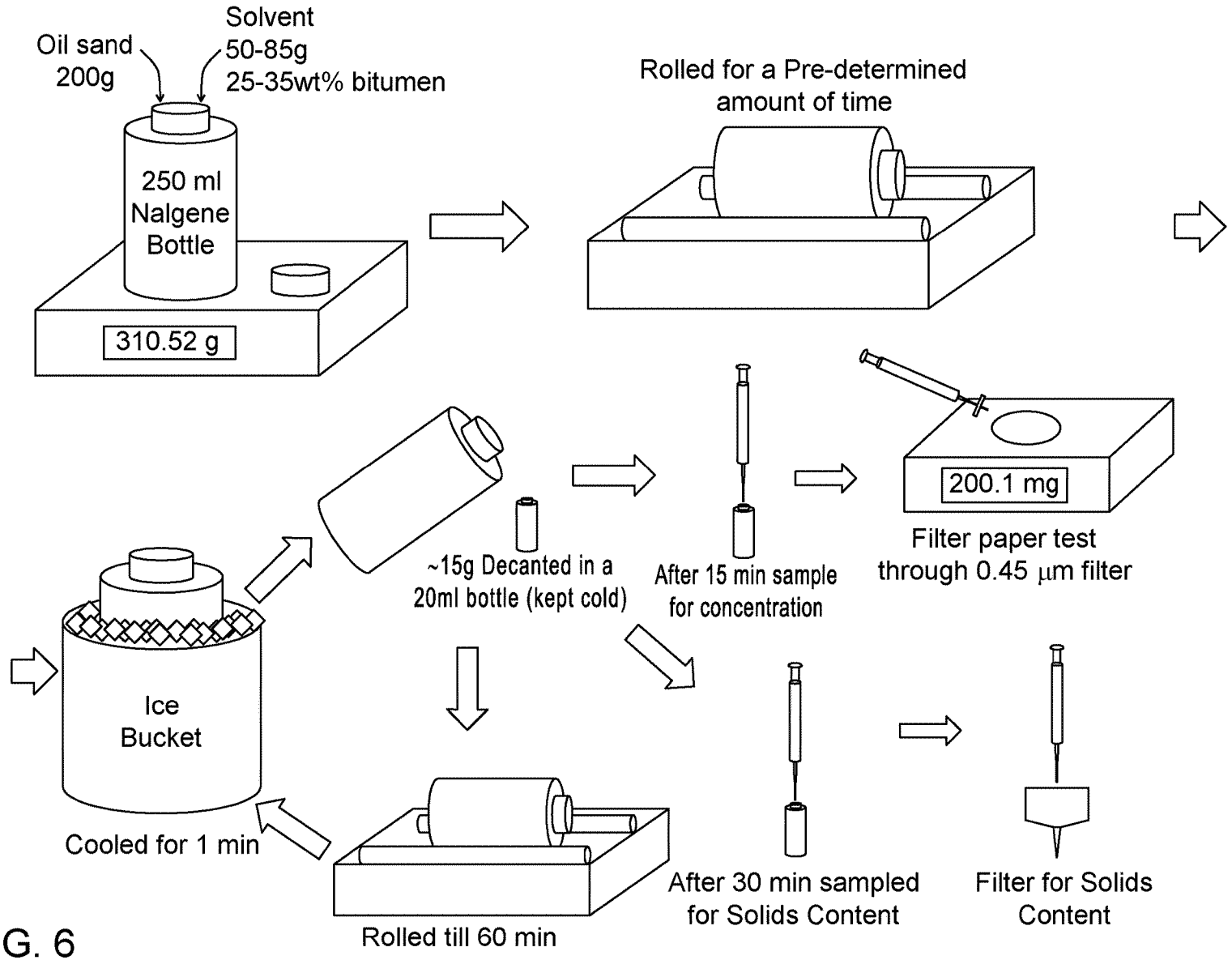
FIG. 6 is a schematic showing various steps of an experimental procedure used for solvent extraction of bitumen and analysis of the extract.

Extraction experiments were also conducted. These extraction experiments generally represent the first stage of extraction as depicted in FIG. 3 (i.e., extraction stage 34). The step-by-step procedure used in extraction experiments are plotted in FIG. 6. The deasphalted bitumen/solvent mixture (representing recycle stream 26 in FIG. 3) obtained from the previous task was used to extract bitumen from the oil sands. For this, a predetermined amount of solvent mixture was added to 200 g of oil sands in 250 mL Nalgene™ bottle. The bottle was then set on a roller at the maximum rolling speed (140 rpm) and rolled for a set period of time at room temperature. The amount of solvent mixture added to the oil sands was such that the final concentration of bitumen in the product was in the range of 49-50 wt % for the 3:1 DAO and 42-44 wt % for the 4:1 DAO once 100% extraction was achieved (equivalent of 1.5:1 and 2:1 solvent to bitumen volumetric ratios respectively). The typical amount of solvent mixture added was 60 to 85 g (65-100 mL) depending on the bitumen content in the oil sands and the liquid feed. The above information is summarized in Table 3.

TABLE 3

Summary of the composition of the feed and products for the extraction experiments.

| | Feed Solvent | | Product | | | Solvent added | |
|---|---|---|---|---|---|---|---|
| Set # | Nominal S/B, vol/vol | Bitumen content, wt % | Nominal S/B, vol/vol | Bitumen content, wt % | Oil sands Weight, g | Weight, g | Volume, ml |
| 1 | 3 to 1 | 32-37 | 1.5 to 1 | 49-50 | 200 | 60-80 | 75-100 |
| 2 | 4 to 1 | 26-32 | 2 to 1 | 42-44 | 200 | 65-85 | 85-125 |

At the end of the set period for extraction, the bottle was left in an ice bucket for 1-2 minutes to minimize solvent losses during sampling. Subsequently, 12-15 g of the liquid was decanted into a 20 mL glass bottle which was then immediately inserted into the ice bucket. The weight of the bottle before and after sampling was recorded and the Nalgene™ bottle with the oilsand and the remaining solvent was rolled further to achieve a total rolling time of 60-75 min. At the end of the second rolling period another sample was obtained in a manner identical to the first sample.

The sample bottle was left in ice for 30 min and an approximate 2 mL sample was taken to determine the bitumen content. Another 2 mL sample was obtained from the top portion of the bottle to determine the solids content. Prior to each experiment, the solvent mixture was also sampled and analyzed for bitumen content. The bitumen content of all the liquids was determined using the filter paper test method. For this test the solvent-bitumen mixture was sampled in a 6 mL syringe. The content of the syringe was then ejected onto a pre-weighed filter paper through a nylon syringe filter with nominal pore size of 0.45 μm. The weight of the dispensed liquid was determined by weighing the full and emptied syringe and filter assembly. The filter paper was left in the fume hood to dry for 75 minutes, after which it was weighed to determine the bitumen content after solvent evaporation.

To measure the solid contents, the diluted bitumen sample was dispensed using a syringe which was weighed before and after dispensing the liquid. The liquid was filtered through a pre-weighed 0.45 μm filter paper which was subsequently washed thoroughly with toluene and dried. The weight of the solids was determined by difference of the weight of the dried filter paper and the original weight.

Further testing was performed to assess asphaltene precipitation and its removal of inorganic solids from the solvent diluted bitumen obtained from extraction. In order to show that asphaltene precipitation will remove the inorganic solids from the extract obtained from a solvent-based extraction process, bitumen was extracted from the oil sands using a solvent with hexane-to-bitumen ratio of 3:1. The extract was then decanted in two 50 mL graduated cylinders for each cylinder to contain 25 mL of liquid. 25 mL of cyclohexane was added to graduated cylinder #1 and 25 mL of n-hexane was added to graduated cylinder #2. The two cylinders were then capped and mixed and left to settle under gravity for 30 min. At the end of the 30 min, 5 mL samples were obtained from the top of each cylinder and filtered to determine the solids content. The filter papers were then dried and weighed. The sample obtained from graduated cylinder #2 in which asphaltene precipitation had occurred did not contain any inorganic solids. Photographs were taken of the filter papers after filtration of the samples obtained from 30 min settling of the extract from the solvent extraction process. It was observed that the filter paper from the sample diluted with n-hexane (deasphalted) was clear while the one on the left is diluted with cyclohexane (no deasphalting) was brownish coloured.

Efficient removal of suspended clays by deasphalting allowed for aggressive final washing of the sand at the final extraction stage which can facilitate low residual bitumen content in the final sand product. Use of high shear and high impact jets in the final washing would result in suspension of a large portion of the clays in the liquid product which would either plug the filters or be recycled into the first stage of extraction in most common operational schemes. However, in one example proposed scheme, the suspended clays could be captured and settled under gravity at the deasphalting stage.

Further tests were performed to determine solid-liquid separation efficiency. Removal of bitumen from oil sands in a non-aqueous process can include two major steps: dissolution of bitumen in the solvent which was studied in the previous section and separation of the diluted bitumen stream from the sand stream. This second step in the extraction process is studied in this section.

Upon completion of the extraction experiments (65-75 min of rolling followed by sampling), the lid on the 250 mL bottle was replaced with an identical lid with a 3 cm (diameter) hole covered with 200 mesh screen. The liquid was then squeezed out of the sand by pressing on the walls of the bottle until no more liquid would come out. This step was done to obtain an estimate of the amount of liquid that would remain in the sand bed with no visible free liquid after the first stage of extraction. Fresh 3:1 or 4:1 DAO solution (depending on the solvent to bitumen ratio of the original extraction) was then added to the squeezed solids and the mixture was rolled for another 5 minutes. The liquid from the bottle was then sampled and analyzed for bitumen content and the remainder of the liquid was squeezed out using the same procedure explained above. Mixing of the fresh DAO solvent with the solids residue from the first stage represents the second extraction stage shown in FIG. 3. The bitumen content remaining in the solids after the first extraction was determined using the following equation:

$$w_{bitinsolids,s1} = \frac{x_{product,s1} \times w_{feed,s2}(x_{product,s2} - x_{feed,s2})}{(x_{product,s2} - x_{product,s1})} \quad (1)$$

where w is weight, x is the mass fraction, s1 and s2 are stage 1 and stage 2, respectively, and bit is bitumen.

The sand after the second squeezing was removed from the 250 mL bottle and laid on an aluminum plate and dried in the fume hood for 2 h followed by drying in the oven at 105° C. for 1 h (no decrease in the mass of the sample was observed after 15 min of drying using a balance with a resolution of 0.01 g). The dried solids were then weighed and mixed with an equal mass of toluene by rolling for 2 h. The toluene extract was sampled and its concentration was used to determine the residual oil content after the second stage of extraction.

Further studies were done to preliminarily assess drying of the solids. Effective removal and recovery of solvent from the solids is essential for the success of any solvent extraction process. In order to meet the goal of minimizing the solvent losses to 4 bbl per 1000 bbl of bitumen produced, the solvent content in the inorganic solids after drying should be <300 ppmw for an oil sand similar in composition to the one used in this study. The solvent trapped in the pores of the inorganic solids by the capillary forces may be recovered using adapted methods. The asphaltenes precipitated in the process have an affinity towards the solvent and may retain a larger fraction of it compared to the inorganic solids, and thus solvent recovery processes and equipment can be tailored and adapted accordingly to ensure sufficient solvent removal.

In order to quantify the above-mentioned issues, dry inorganic solids recovered from the Soxhlet extraction of bitumen were soaked in n-pentane and left at room temperature in still air to dry. The depth of the bed of solids exposed to air was 1 cm and the solids mixed with a spatula every 2 min to help in the drying process. The weight of the solids was monitored as a function of time to determine the amount of residual solvent. Once the change in the weight plateaued, the solids were placed in an oven at 80° C. for 10 min and reweighed after cooling down for 1 h to determine the impact of moderate heating. A similar procedure was followed for asphaltenes precipitated from the same oil to determine the affinity of solvent to the asphaltenes. The data obtained in this section are not necessarily representative of the performance of a drying procedure that may be suitable for a non-aqueous extraction process and are principally obtained to provide a baseline measurement for the proportion of solvent that may be bound to the solids and therefore difficult to recover.

Various results were obtained based on the experimentation that was conducted on paraffinic solvent extraction. Results are reported in the following sections:

Extraction Behavior—First Stage

Figure 7:
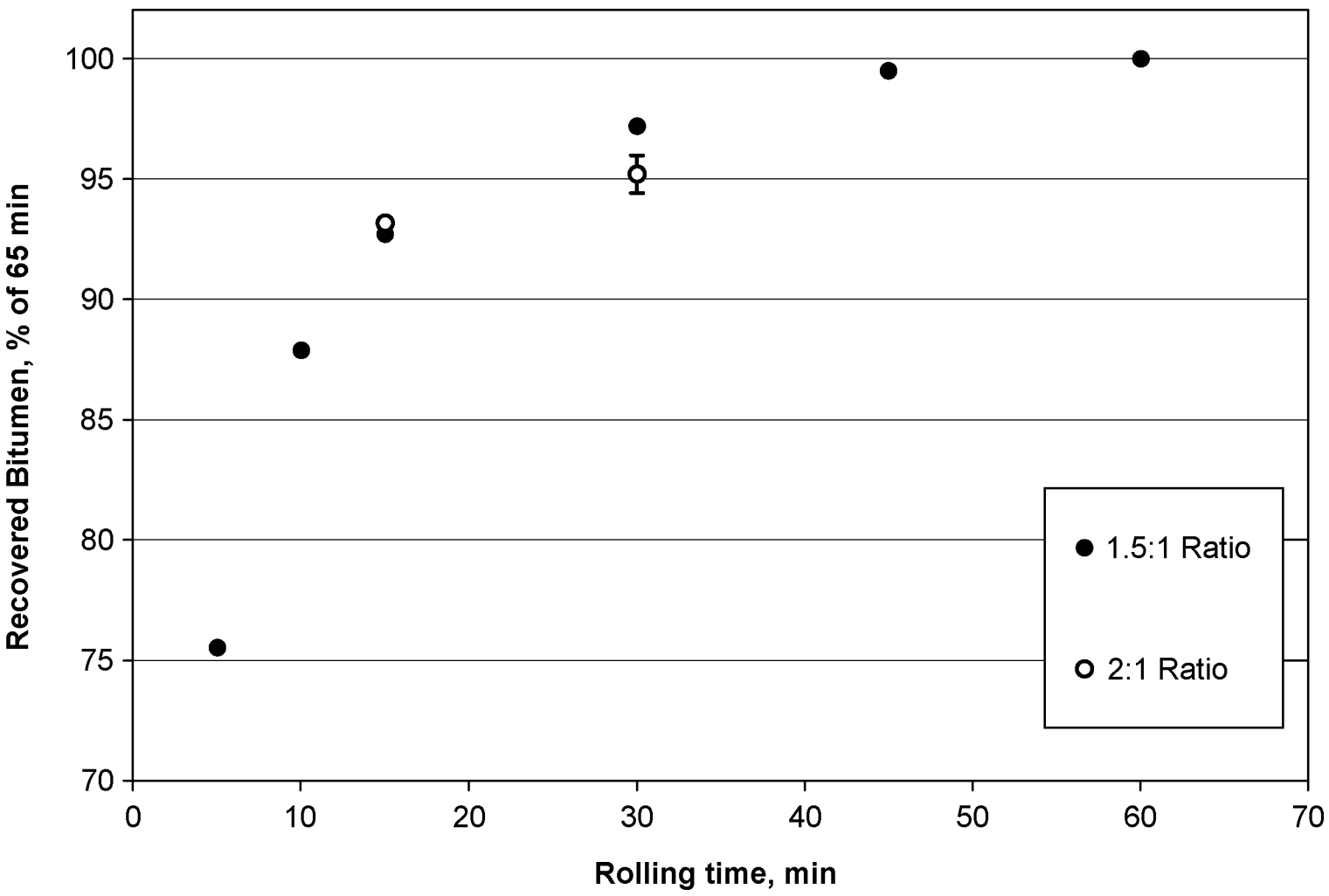
FIG. 7 is a graph developed from experimental data showing normalized levels of extraction of bitumen after 5 to 65 minutes of rolling for two solvent compositions.

This section focuses on the performance and behaviour of the first stage extraction stage 34 shown in FIG. 3 and the resulting solvent diluted bitumen material 20 that is obtained. The kinetics of extraction were studied by rolling of the deasphalted oil-oil sands mixture for 5-45 min periods. As the bitumen content may vary from one sample to another, all mixtures were also rolled for a total of 65 min and the total amount of bitumen extracted during this period was also determined. The results of % bitumen extracted are normalized by the amount extracted after 65 minutes and plotted versus the rolling time for the overall solvent-to-bitumen ratio of 1.5 and 2 in FIG. 7. 3:1 and 4:1 DAO were used as the solvent to achieve the overall solvent to bitumen ratio of 1.5 and 2, respectively. The points with error bars are the results of three or more repeat experiments while those without error bars are single measurements. As shown in the figure, 90% recovery was achieved within 10-15 min from the start of rolling for both levels of solvent addition rate. After 30 min of rolling, 95-97% of the bitumen was extracted in both cases and by rolling for ~45 min almost all of the bitumen could be extracted.

Figure 8:
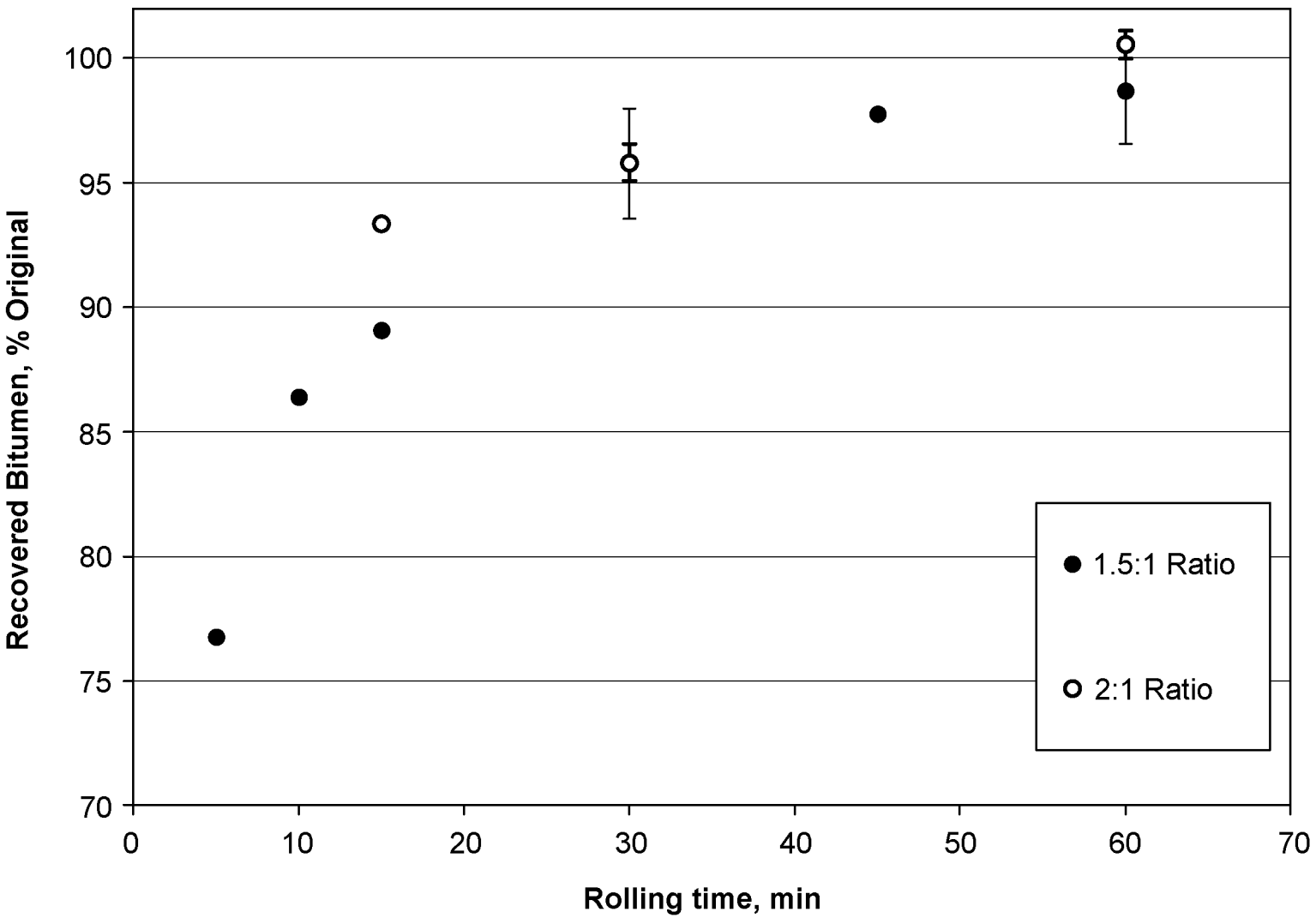
FIG. 8 is a graph developed from experimental data showing the values of the percentage of bitumen extracted based on the nominal bitumen content in the oil sands plotted versus the rolling time.

FIG. 8 shows the results of the percentage of bitumen extracted normalized by the nominal bitumen content in the oil sands. The nominal bitumen content was determined through extraction experiments with toluene for 2 hours. In all the experiments, the total bitumen extracted in 65 min was in the range of 96-103% of the nominal value reported in Table 1. Based on the nominal bitumen content, higher solvent addition rates result in a more efficient extraction for a shorter rolling period (15 minutes), while the performance at longer rolling periods does not appear to be a significant function of solvent content. The concentration of the bitumen in the liquid feed and the solid to liquid ratio varied from one experiment to another. When 4:1 DAO was used the concentration of bitumen in the added solvent was ~15-20% lower than for the case of 3:1 DAO. The liquid-to-solid ratio in the bottle was also ~10-20% higher for 4:1 DAO case.

Achieving 100% recovery in 65 minutes showed full solubility of the bitumen in the deasphalted oil (i.e., no asphaltene rejection during extraction). Based on these results, it can be concluded that above 90% bitumen recovery can be achieved by contacting of bitumen and deasphalted oil at 25° C. for under 15 minutes without the need for aggressive mixing. In addition, 95% recovery can be achieved within 30 minutes and the whole bitumen can be extracted into the solvent phase within 65 minutes.

Repeat experiments were performed for 30 minutes where the composition of the feed solvent and the liquid-to-solid ratio were varied. In order to keep the overall S/B ratio constant, the increase in the bitumen content of the feed solvent was accompanied by an increase in the ratio of the feed solvent to the oil sands. For both cases of overall S/B of 1.5 and 2, no significant change in the efficiency of extraction was observed as a result of these variations.

Settling of Clays

Further tests were conducted regarding the dilbit product, which is shown as stream 32, in FIG. 3. A major challenge in non-aqueous extraction of bitumen from oil sands is that of separating suspended clays from the supernatant product liquid. The cumulative level of inorganic solids and water in the product bitumen needs to meet the pipeline specification of below 0.5 wt %. As explained earlier, using an aliphatic solvent for bitumen extraction can result in lower solids content in the extracted liquid after gravity settling.

Figure 9:
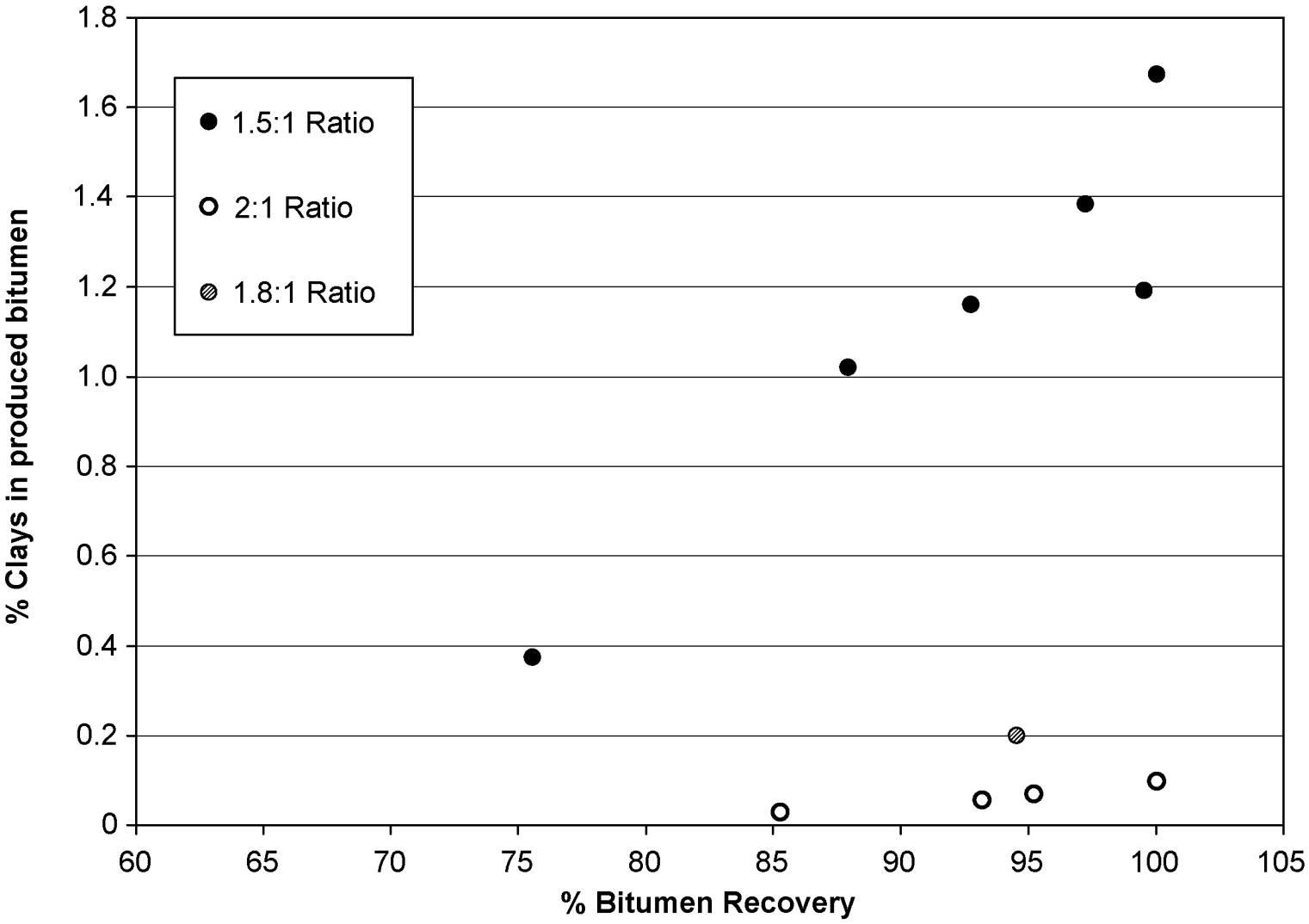
FIG. 9 is a graph developed from experimental data showing clay content in the produced bitumen after 30 minutes of settling of the diluted bitumen product of the extraction process versus the percentage of bitumen recovery for various overall solvent to bitumen ratios.

The inorganic solids content of the liquid decanted from the first stage extraction experiments and settled in an ice bath for 30 minutes (sampled from the top 20% of the liquid after settling; and the depth of the sampled liquid was 2-3 cm) were determined and plotted versus the level of bitumen recovery in FIG. 9. The percentage of clay values were calculated on a solvent free basis so that they could be compared to the set criteria (of water+solids<0.5 wt %) in all cases the water content of the liquid was in the range of 25-35% of the solids content. The clay content obtained here would be indicative of the concentration of the clay in the liquid product from the first stage of extraction. A portion of this stream will be the final product after filtration (of the clays) and solvent removal.

The amount of clays in the liquid product appear to follow the rate of bitumen recovery (and thereby the length of rolling period). However, as shown in FIG. 9 there is a clear divide between the values of solids content for the solvent to bitumen ratios of 1.5 and 2.

Figure 10:
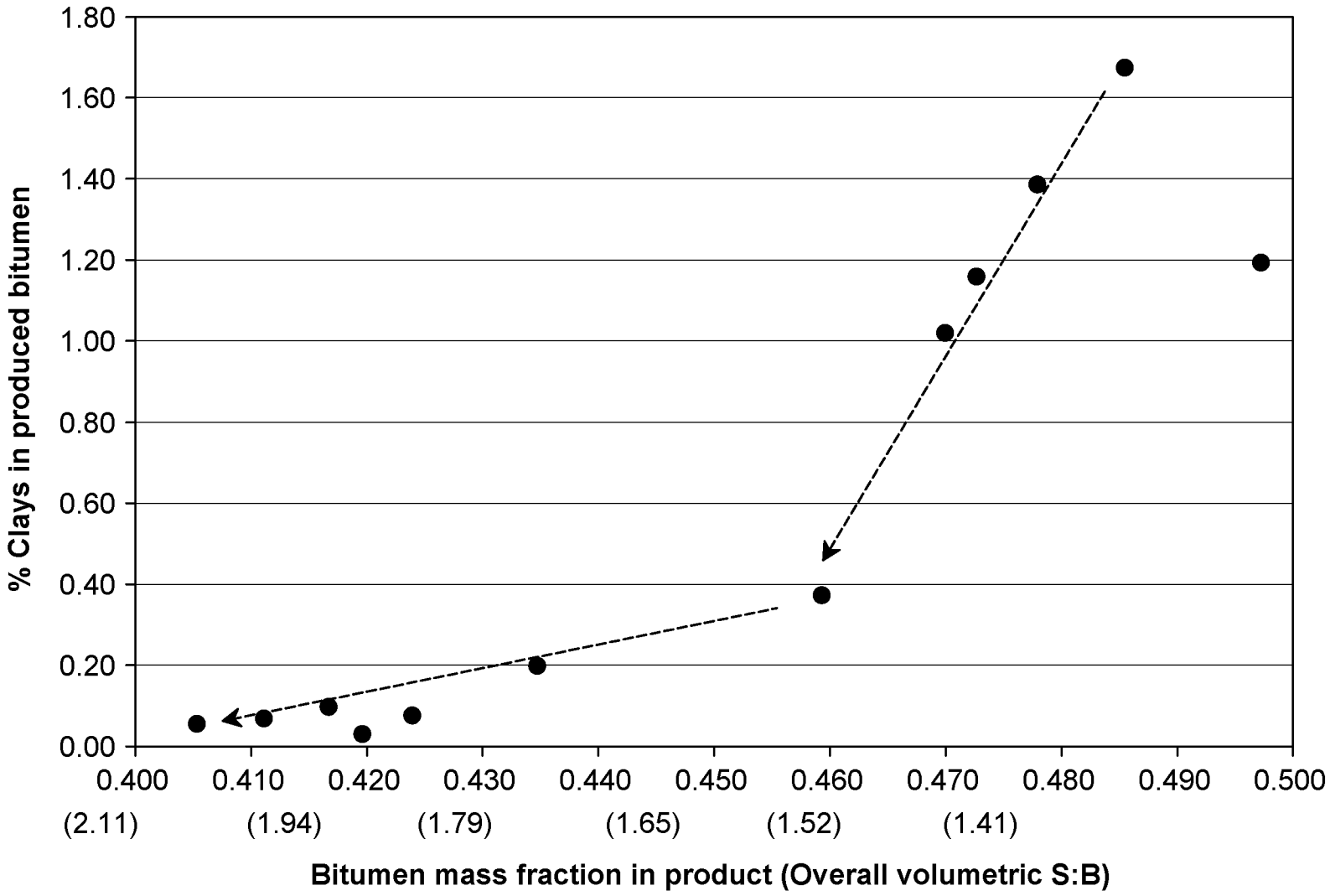
FIG. 10 is a graph developed from experimental data showing clay content in the produced bitumen after 30 minutes of settling of the diluted bitumen product of the extraction process versus the mass fraction of bitumen in the product. The values in brackets are the equivalent solvent to bitumen ratios at 100% recovery.

The data from the two levels of S/B ratio were combined and plotted versus the bitumen content in the liquid product in FIG. 10. This figure clearly shows the dependence of the rate of settling of solids on the composition of the liquid.

Lower bitumen content in the liquid would result in lower viscosity and density of the liquid phase and enhance the rate of settling of solids.

Sedimentation of bitumen coated clay particles has been reported to occur at a much faster rate in paraffinic environments because of the presence of attractive forces leading to aggregation of small particles. The clear break in the trend seen in FIG. 10 may be indicative of a change in the behavior of the clay particles at a certain threshold of aliphatic solvent content.

The clay and water content in the product of extraction with S/B of 2 was below 0.12 wt % (clay content below 0.1) in all the extraction experiments which is in the range suggested for pipelineable product without any need for further filtration or processing.

Bitumen-Sand Separation Efficiency

Additional work was done to assess the separation efficiency of the coarse mineral solids (i.e., mainly sand) from the bitumen. For example, this section relates to the separation of the sand from the bitumen which occurs in the first and second extraction stages 34, 36 of FIG. 3.

In some process implementations, removal of bitumen from sand by an organic solvent can include two main steps. First, bitumen is transferred from the solid to the liquid phase by dissolution in the solvent; this can also be referred to as extraction of bitumen from the mineral solids. Next, the liquid and solid phases need to be separated and further processed. Separation may be performed in multiple stages and may require various levels of settling, filtration and washing. The liquid content in the solvent-oil sands slurry in a non-aqueous extraction process is limited by the desire to minimize the overall solvent addition rates. Therefore, the efficiency of liquid-solid separation at each stage can have a notable impact on the complexity of the next stage. In one proposed implementation of the process, as shown in FIG. 3, since the final washing is performed by a pure aliphatic solvent that induces asphaltene precipitation, it is desirable to achieve a low enough level of bitumen content in the feed to the final washing stage to avoid high levels of asphaltene rejection.

In some scenarios, the solvent diluted tailings from the extraction stage that are fed to the washing stage have a bitumen content that is as low as possible. Depending on the process configuration, the bitumen content in the tailings from the extraction stage may vary. Filtration steps prior to washing can reduce the bitumen content in advance of final washing. The washed tailings may have a bitumen content of less than 3% of the original bitumen present as asphaltenes on the sand, for example.

Figure 11:
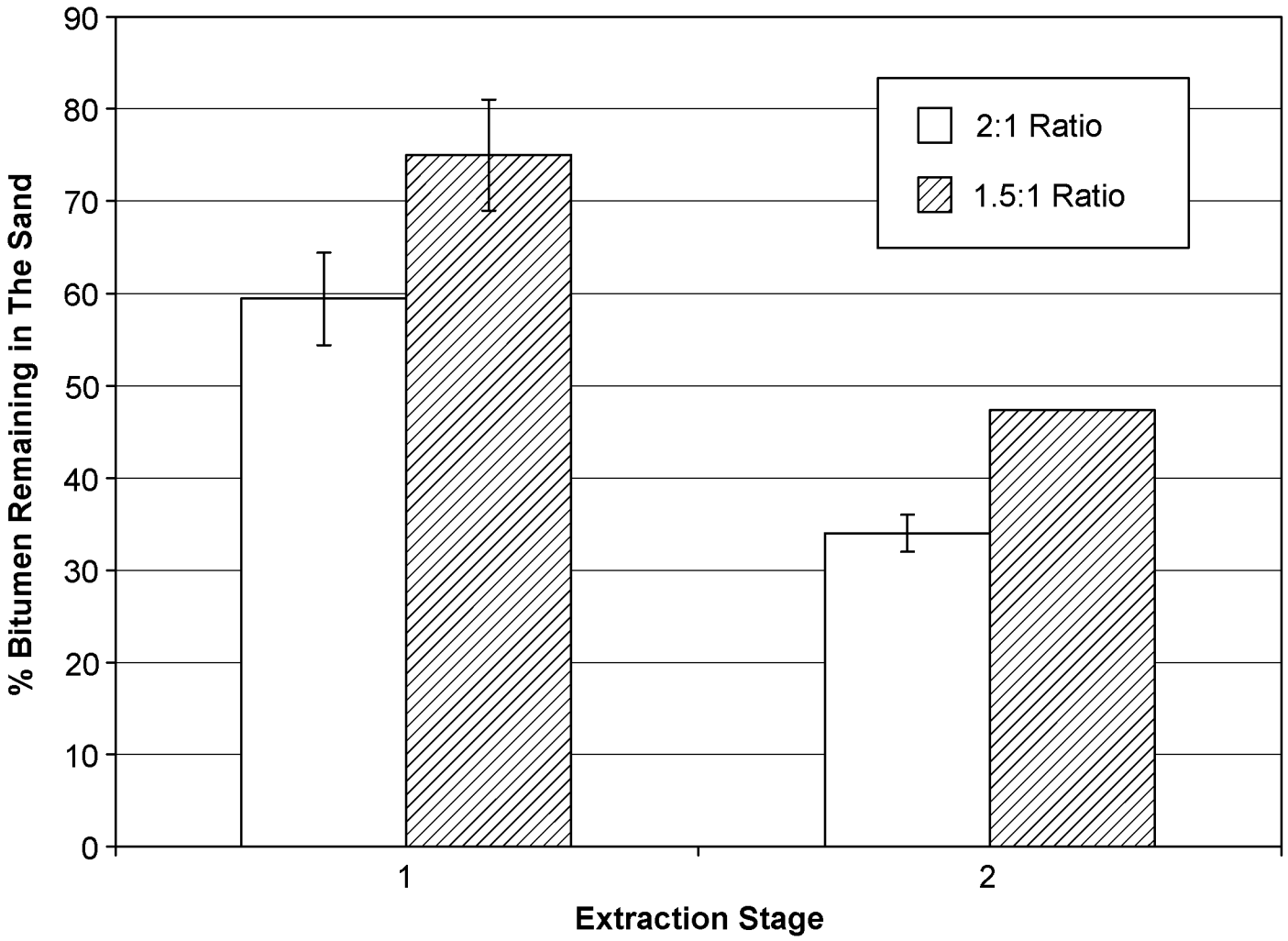
FIG. 11 is a bar graph developed from experimental data showing the percentage of the original bitumen remaining in the sand structure after each stage of extraction followed by draining of the liquid.

In order to obtain an estimate of the amount of bitumen that may remain in the sand after each stage of draining, the liquid was squeezed out of the rolling bottle at the end of the first and second stages of extraction and the amount of bitumen remaining in the sand was determined. The results for the two levels of solvent addition rates are plotted in FIG. 11. This figure shows the percentage of the original bitumen remaining in the sand structure after each stage of extraction followed by draining of the liquid through squeezing the container. For the overall S/B of 1.5, 70-80% of the original bitumen remained in the sand structure after the first extraction stage. This is a result of entrainment of a fluid containing ~50 wt % bitumen in the pores of the bed of solids. For the S/B=2 the liquid has a lower bitumen content (~43%) and is less viscous and can therefore drain more effectively. For this case ~60% of the bitumen was retained by the sand after the first stage of extraction and solid-liquid separation. After the solids are washed with the original recycled fluid (3:1 and 4:1 DAO), representing the second stage of extraction, the bitumen content is lowered to less than 50% and around 35% for the low (S/B=1.5) and high solvent (S/B=2) addition rates, respectively. These values represent the sand tailings stream that is sent to the final washing stage. The bitumen content in this stream determines the rate of asphaltene loss through the final solvent wash. As the liquid remaining in the solids after this stage is predominantly from the recycled stream and thereby has already been partially deasphalted, the final washing of the sands with pure solvent would cause 1-2.5 wt % asphaltene rejection on the bitumen volume basis.

In summary, using a higher solvent addition rate did not appear to have a significant impact on the rate of extraction. However, the efficiency of solid settling and liquid-solid separation was a significant function of the solvent addition rate. Therefore, the presented results suggest that extraction at an overall solvent to bitumen ratio higher than 1.5 and lower than 2 may provide enhancements in terms of complexity of the process and energy efficiency. These findings also support the rationale to maintain high L/S ratio in the extraction stage. The recycle of DAO can significantly reduce solvent use, and it also introduces solvent that reduces the liquid entrainment to the solids. It also reduces the asphaltene content of the liquid entrained with the sands so that in the final wash with pure solvent less asphaltene are precipitated and remain with the sands sent to solvent recovery and drying and by extension improves the yield of recovered oil.

Preliminary Study on Solvent Recovery

Additional work was done to assess solvent recovery. This section relates to the washing of the tailings in stage 42 and the resulting washed tailings 46 that would be sent to solvent recovery, as shown in FIG. 3.

As explained above, the goal of this experiment on the solvent recovery from solids was solely to determine the order of magnitude measurement of the amount of solvent that had a strong affinity towards the separated solids. Inorganic solids and asphaltenes were soaked in n-hexane and left to dry at room temperature while observing the weight change of the drying solids. The results of the residual solvent in the inorganic solids, presented as solvent loss per 1000 bbl of produced bitumen are plotted versus the time of drying in FIG. 12 The solvent loss values reported in FIG. 12 are calculated using the following formula:

$$\frac{bbl_{solvent}}{1000bbl_{oil}} = \frac{w_{solids,t} - w_{solids,dry}}{w_{solids,dry}} \times \frac{\%\ w_{solids}}{\%\ w_{oil}} \times \frac{\rho_{oil}}{\rho_{solvent}} \times \frac{1000}{\text{Recovery}} \quad (2)$$

In equation (2), w is weight, p is the density, and recovery is the overall bitumen recovery which is assumed to be 0.93.

Figure 12:
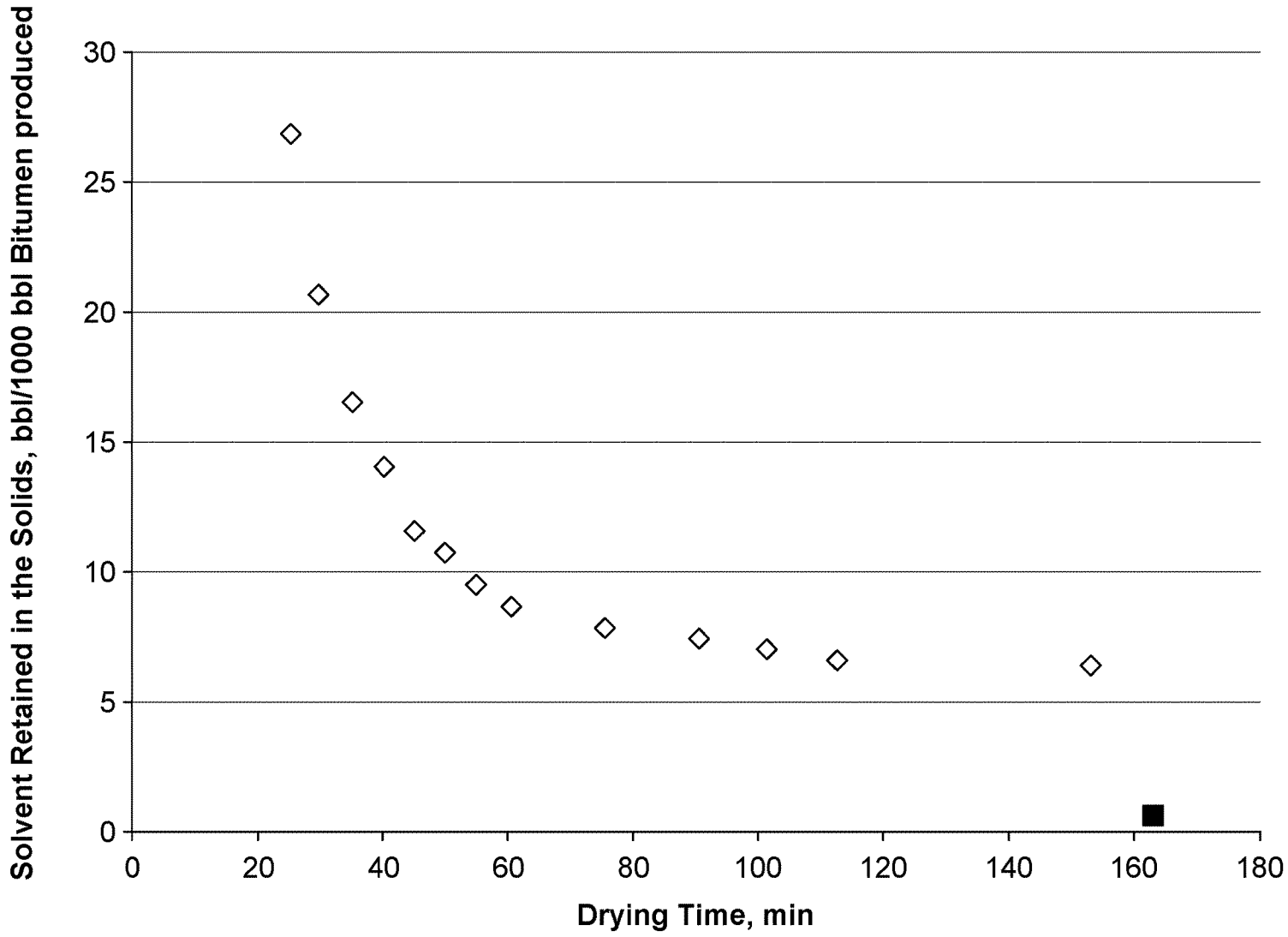
FIG. 12 is a graph developed from experimental data showing the residual solvent in the sand per produced bitumen over the course of drying at room temperature (diamonds) and with an additional 10 mins of drying at 80° C. (filled square, for comparison purposes).

As shown in FIG. 12, the curve plateaus at ~5 bbl of n-hexane per 1000 bbl of bitumen which is higher than the maximum solvent loss (4 bbl/1000 bbl of bitumen) according to the regulations on sand reclamation. However, 10 min of drying at 80° C. lowers the value to below 1 bbl/1000 bbl of bitumen (filled square).

Figure 13:
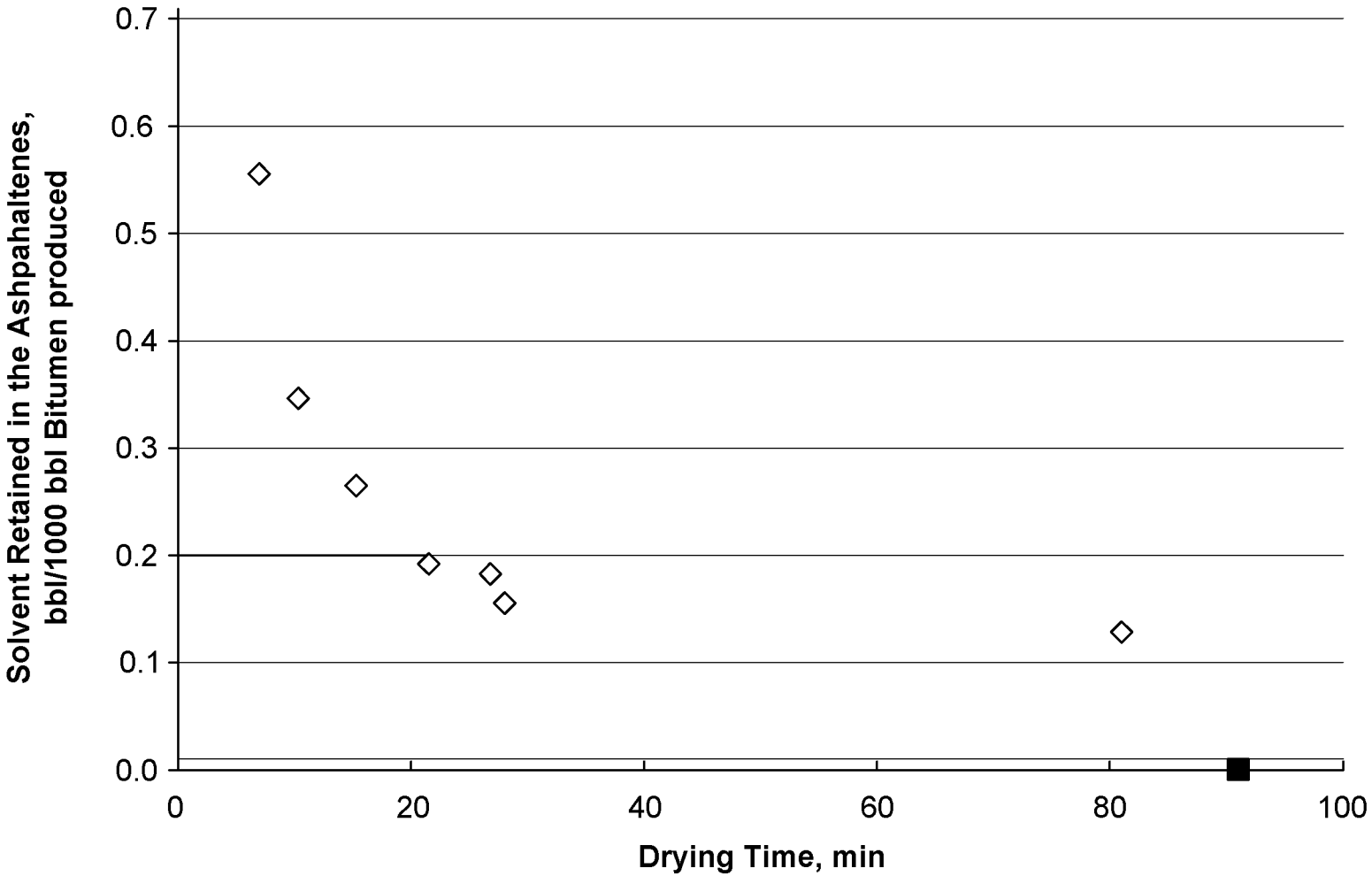
FIG. 13 is a graph developed from experimental data showing residual solvent in the asphaltenes per produced bitumen over the course of drying at room temperature (diamonds) and with an additional 10 mins of drying at 80° C. (filled square, for comparison purposes).

FIG. 13 shows residual solvent in the asphaltenes in terms of barrels of solvent per 1000 barrels of produced bitumen over the course of drying at room temperature. The filled square data point is the value of residual solvent after 10 min of drying at 80° C. On a pure absorbent basis, asphaltenes have a higher affinity towards n-hexane than the inorganic solids. However, they represent a small fraction of the solids produced during the solvent extraction process assessed in this study. Therefore, as shown in FIG. 13, the equivalent solvent loss to the asphaltene phase reaches insignificant levels quickly even at room temperature.

Based on the presented results, the deasphalting process does not appear to contribute significantly to the solvent loss in the assessed process. Equation 3 was used to calculate the values reported in FIG. 13. The mass fraction of asphaltene loss to the oil used for calculations was 0.07, which was estimated based on the results of asphaltene precipitation tests.

$$\frac{bbl_{solvent}}{1000bbl_{oil}} = \frac{w_{asphaltenes,t} - w_{asphaltenes,dry}}{w_{asphaltenes,dry}} \times \frac{w_{asphalteneloss}}{w_{oil}} \times \frac{\rho_{bitumen}}{\rho_{solvent}} \times \frac{1000}{\text{Recovery}} \quad (3)$$

All the reported ratios throughout this experimentation section are volumetric ratios unless stated otherwise.

Assessment of Implementation Benefits

Further work has also been done regarding economic and environmental benefits of this paraffinic solvent NAE process, notably with respect to a process implementation such as that of FIG. 4.

Screening level economics suggest a CAPEX intensity comparable to greenfield in-situ replication installations, a 30% lower operating cost compared to hot water extraction (HWE) and essentially no wet tailings. The mining capital could be reduced about 50% as ore blending requirements are notably reduced through this process. In addition, this process produces a higher-value fungible product, which is directly marketable and can be processed in any upgrader and many refineries. The chloride content in the bitumen is effectively reduced as connate water is either retained with the sand or removed through the deasphalting process. It also appears that the process can have lower OPEX than existing mining and extraction operations with higher margins compared to brownfield HWE.

In addition, assessments showed that this NAE process can be environmentally superior to current HWE operations with a significantly lower tailings footprint (e.g., over 90% reduction) as well as lower GHG emissions per barrel of bitumen compared to aqueous extraction.

Figure 16:
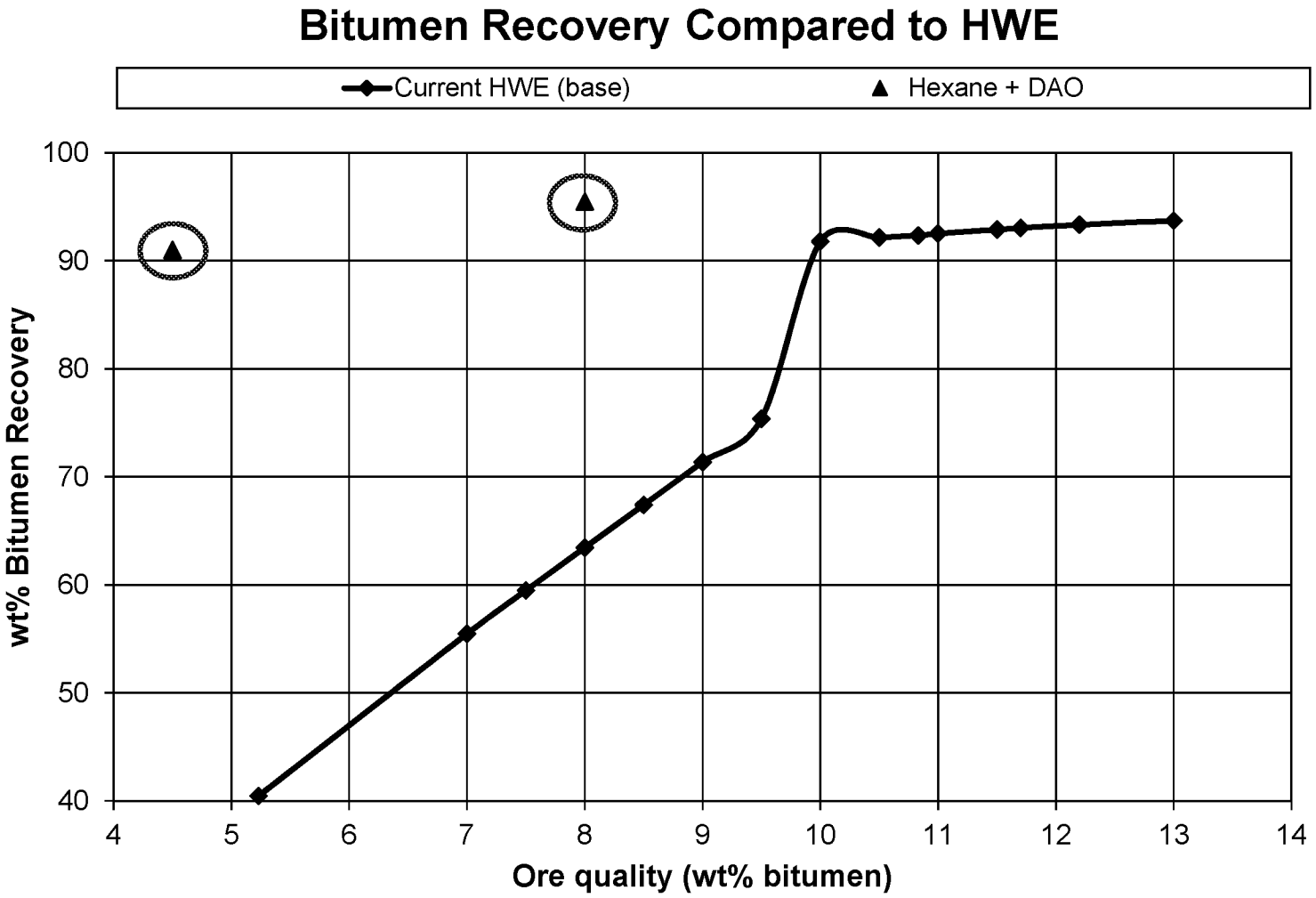
FIG. 16 is a graph bitumen recovery versus ore quality comparing different extraction methods.

Furthermore, test work has shown that the bitumen recovery is high (above 90%) regardless of the ore grade (e.g., from 4.5% to 8% ore grade), as shown in FIG. 16. In contrast, the bitumen recovery from the traditional HWE process drops off significantly below 9% ore grade. Similarly, weathered or oxidized ore is more challenging to process in HWE but NAE performance is less affected. This can have a significant beneficial impact on mined ore blending requirements.

Work was also done to determine operating performance metrics to support process evaluation, including degree and rate of bitumen extraction, required S/B ratio, impact of extraction temperature, impact of ore grade, and so on.

Studies Regarding NAE-SDA Operating Envelopes

Operating scenarios including a number of process variables were determined based on preliminary experimental work and calculations. Referring generally to FIG. 4, the process can be operated within certain operating envelopes to facilitate enhanced performance and production of a high-quality bitumen product. Operating scenarios based on the use of hexane as the paraffinic solvent were assessed in more detail and are presented below.

Bitumen product (e.g., stream 64 of FIG. 4)—The bitumen product can have a target asphaltene content of 4 wt % to 12 wt %, optionally 6 wt % to 10 wt %, or 7 wt % to 9 wt % (e.g., measured as $C_5$-asphaltene content). The bitumen product can, for example, have a target asphaltene content and other compositional features that align with other bitumen product streams, such as bitumen from a paraffinic froth treatment (PFT) operation that uses a paraffinic solvent (e.g., pentane) to treat bitumen froth. For this NAE process, this means that the SDA stage 24 is operated under partial deasphalting conditions to produce solvent diluted bitumen that is partially deasphalted and which is subjected to solvent recovery to remove solvent and produce the bitumen product. If other solvents were used (e.g., pentane or heptane), this parameter could be kept constant as a controlled variable based on product quality targets.

S/B in the extraction stage ($S/B_E$)—The $S/B_E$ can be provided based on the type of solvent that is used. For hexane, the $S/B_E$ can be between 0.7 and 2, between 1 and 1.8, between 1.2 and 1.7 or between 1.3 and 1.5 to provide enough liquid to facilitate good extraction and separation of the bitumen from the solids while also avoiding asphaltene precipitation during extraction. The "bitumen" (B) in this ratio includes both the bitumen from the ore and the bitumen in the DAO. The $S/B_E$ is related to the amount of DAO that is recycled back into the extraction stage, and thus the $S/B_E$ with hexane could be higher than 2 if higher DAO levels are provided in the extraction stage. Still, the DAO ranges that are used in the present example implementation leads to an upper threshold that is closer to 2 for hexane. For pentane the $S/B_E$ operating range would be lower compared to hexane; and for heptane the $S/B_E$ operating range would be higher compared to hexane.

S/B in the SDA stage and recycled stream ($S/B_{DAO}$)—The $S/B_{DAO}$ can be provided based on the type of solvent that is used as well as other parameters. For hexane and for a target asphaltene content of 6 wt % to 10 wt % in the bitumen product, the $S/B_{DAO}$ can be between 2.4 and 3.3, between 2.4 and 3, between 2.5 and 3.2, between 2.5 and 2.9 or between 2.6 and 2.8, for example, and this may depend on the starting asphaltene content of the bitumen which could be approximately 16 wt % for example. If the target $C_5$-asphaltene content in the bitumen product is up to about 12 wt %, then an $S/B_{DAO}$ could be lower, e.g., down to about 2. Likewise, if the target asphaltene content in the bitumen product is down to about 4 wt %, then the $S/B_{DAO}$ could be 3 or higher, in an example implementation. It should be noted that if the target asphaltene content of the bitumen product were changed, then the $S/B_{DAO}$ could be modified to be outside of these ranges. In addition, for pentane the $S/B_{DAO}$ operating range would be lower compared to hexane; and for heptane the $S/B_{DAO}$ operating range would be higher compared to hexane.

Furthermore, the $S/B_{DAO}$ could be between 2.5 and 3.3, between 2.5 and 3.0 or between 2.6 and 2.8, for example for hexane and for a target asphaltene content of 11 wt % to 13 wt % in the bitumen product starting from an input bitumen having an asphaltene content of about 19.5 wt % instead of about 16 wt %. If the target $C_5$-asphaltene content in the bitumen product is up to about 15 wt %, then an $S/B_{DAO}$ could be lower, e.g., down to about 2. Likewise, if the target asphaltene content in the bitumen product is down to about 4-6 wt %, then the $S/B_{DAO}$ could be 3.5 or higher, in an example implementation. In general, the S/B in the SDA unit can be approximately 3, plus or minus up to 10% or 20%, for hexane for example. It should also be noted that a target asphaltene rejection could be considered—with rejection being the difference between the asphaltene content of the input bitumen and the asphaltene content of the bitumen product or with rejection being related to a similar comparison—and an S/B could be determined accordingly. In other words, the amount of asphaltenes to be removed from the bitumen can be a target and the S/B in the deasphalting stage can be provided accordingly. The asphaltene rejection could be at least 5 wt %, 6 wt %, 7 wt % or 8 wt %, and up to 9 wt %, 10 wt %, 11 wt % or 12 wt %, for example, although higher or lower rejections are also possible. These percentages are based on the amount of asphaltenes in the bitumen, meaning that a 5 wt % rejection from bitumen with 16 wt % asphaltenes would result in a bitumen product having slightly higher than 11 wt % asphaltenes which is due to bitumen mass loss during the deasphalting process. The particular S/B to be implemented can depend, therefore, on the target rejection, the target asphaltene content in the bitumen product, as well as various factures such as solvent type, bitumen source, temperatures, setting characteristics, among others. The S/B for a particular process can also be tested, monitored and adjusted to provide a desired rejection and/or target content in the product, for example.

Temperature—The temperature of extraction can be the same or different as deasphalting, and can also be in the range of 25° C. to 80° C., or 25° C. to 60° C., or 25° C. to 50° C. or 35° C. to 45° C. The lower limit can be based on ambient temperatures, while the upper limit can be based on a target temperature for providing heat to cold ores and also based on the volatility of the solvent (i.e., the temperature would be sufficiently below the boiling point of the solvent to prevent evaporation). Thus, for hexane the operating range can be around 35° C. to 45° C., while for pentane the temperature could be lower (or the same) and for heptane the temperature could be higher (or the same). The temperature could also be increased if certain other conditions are used in order to provide lower viscosities for the solbit. However, it is noted that higher temperatures can also be used for the SDA stage, such as about 120° C., plus or minus up to 10% or 20% for example. It is further noted that temperatures up to, for example, 160° C. could be used for the SDA stage, in which case certain material handling and heat exchange elements could be used in the process. It is also noted that the SDA stage could be operated at a higher temperature (e.g., 50° C. to 160° C., 60° C. to 130° C., 70° C. to 120° C. or 80° C. to 110° C., for example) while the extraction stage is operated at lower temperatures (e.g., about 20° C. to 60° C. lower, or 30° C. to 50° C. lower, than SDA while being at least about 25° C.). There may be heat exchangers in between the two stages in order to heat up extracted bitumen prior to SDA and cool down recycled material from SDA back to extraction. In addition, the washing stage can be operated at a temperature that is the same or different from extraction. The washing stage can be operated in the range of 25° C. to 80° C., 25° C. to 60° C., 30° C. to 50° C. or 35° C. to 45° C., for example. Regarding the bottom asphaltene material from the SDA stage that can be sent to the washing stage, the bottoms can be relatively hot due the elevated temperature of the SDA stage and thus can be cooled prior to entering the washing stage. The bottoms cooling can be performed in various ways, one of which is via solvent quenching by adding cooler solvent containing quench liquid to the bottoms. For example, the solvent containing quench liquid can be at a temperature that is about 10° C. to 80° C. lower, or 30° C. to 70° C. lower, than the SDA bottoms temperature to reduce the SDA bottoms temperature to the washing stage's operating temperature. In one example, the SDA bottoms temperature could be about 90° C., the solvent containing quench liquid is about 25° C. and the cooled bottoms temperature is about 60° C. before being fed into the washing stage. The solvent-containing quench liquid could be itself pre-cooled prior to being added to the SDA bottoms, and the pre-cooling could be done in an indirect heat exchanger.

Ratio of DAO to bitumen in the ore in extraction (DAO/ore-bitumen)—The DAO/ore-bitumen ratio can depend on the solvent that is used as well as other variables. For example, the DAO/ore-bitumen ratio can be provided between 0.3 and 3, between 0.5 and 2.4, between 1 and 2, or between 1.4 and 1.7. The DAO/ore-bitumen ratio represents how much DAO is provided back into the extraction stage. Higher DAO/ore-bitumen ratios will result in increasing the precipitation onset and will therefore reduce the likelihood of asphaltene precipitation while increasing the liquid content of the extraction stage and the amount of paraffinic solvent that can be present while remaining below asphaltene precipitation onset. It should be noted that recycling very high levels of DAO back into the extraction stage would result in high DAO/ore-bitumen ratios, but this may also result in certain inefficiencies and costs that could be avoided using lower DAO/ore-bitumen ratios. For pentane the DAO/ore-bitumen ratio operating range could be higher compared to hexane; and for heptane the DAO/ore-bitumen ratio operating range could be lower compared to hexane.

It is also noted that the DAO/ore-bitumen ratio is a relevant parameter that affects the asphaltene precipitation onset value in the extraction stage. The higher the ratio, the higher the onset value will be elevated. However, higher DAO/ore-bitumen ratios require more recycle of DAO and more solvent is required at the deasphalting stage for asphaltene precipitation and therefore larger vessels and higher capital and operating costs can be required for such higher ratios. Thus, keeping the DAO/ore-bitumen ratio within 0.3 and 3 facilitates effective performance along with reasonable operating and capital costs.

It is also noted that it is desired to maintain a significant difference (e.g., at least 0.5) between the S/B ratio at the extraction and deasphalting stages. This S/B difference can be in the general range of 0.5 to 2, 1 to 1.7, or 1.2 to 1.5, for example. This S/B difference facilitates control of the asphaltene precipitation at the desired stage of the process and in the desired quantity. This S/B difference can be considered as another constraint for designing and operating the NAE process.

The bitumen content in the oil sands ore can vary between about 5 wt % and about 13 wt % or higher, with the NAE process being able to extract bitumen at all bitumen contents. However, it is noted that variable ore feed compositions can result in variations in the operating parameters. For example, if the bitumen content in the ore changes from 10 wt % to 5 wt % (which can be referred to as an "upset condition"), the $S/B_E$ can be controlled to maintain the same ratio or increase it to provide desired L/S in the extraction stage to facilitate extraction. In addition, the flow rate of the recycled stream would be reduced, and the $S/B_{DAO}$ could be kept constant as would the asphaltene content in the bitumen product.

It is also noted that the particular operating parameters used in the extraction and deasphalting stage can vary depending on other parts of the process, such as the filtration and/or washing stages. For example, when filtration is used to filter liquid from the tailings produced by the extraction stage, the tailings stream can be provided with a certain minimum liquid content (e.g., L/S of 1) to facilitate filtration (e.g., using belt filtration). Thus, in order to provide the desired liquid content of the tailings, the extraction stage could be operated under certain conditions in terms of DAO/ore-bitumen ratio and $S/B_E$, for example.

The following tables provide a summary of operating parameters that can be used for certain implementations of the NAE process. These parameters were determined based on a methodology that will be described further below.

Operating Parameters for NAE Using Hexane Solvent

| Operating parameters | Lower | Typical | Upper | Comments |
|---|---|---|---|---|
| S/B ratio in extractor | 0.7 | 1-1.5 | 1.7 | Normal operation for 10 wt % bitumen ore. |
| DAO/ore-bitumen ratio | 0.3 | 0.5-2 | 3 | Note this corresponds to DAO/total-ore ratio 0.03-0.3 for 10 wt % bitumen ore. |
| Temperature for extraction (° C.) | 25 | 40 | 50 | Note that hexane has a boiling point of about 68° C. |
| S/B ratio at SDA | 2 | 2.7 | 3 | The S/B ratio in the solvent-DAO product will be slightly different from that in the SDA feed due to the rejection of asphaltene. |
| $C_5$-asphaltene in the product DAO (wt %) | 12 | 6-10 | 4 | For an example bitumen of 16% asphaltene; this indicates asphaltene rejection 7-11% of bitumen or 40-65% of asphaltene. |

The following table provides operating parameters for three different operating scenarios for certain implementations of the NAE process. The methodology used to determine the parameters for these scenarios is described as follows:

A spreadsheet was used and includes a solvent/DAO/ore bitumen mass balance around the extraction stage. The S/B at the extractor was a controlled variable (CV) with set-points (e.g., 0.7-1.7), while the recycle DAO/solvent stream is a manipulated variable (MV) given a prespecified variable bitumen feed from ore (e.g., 100 mass per time). For different DAO/solvent products from the SDA (e.g., S/B=2, 2.7 or 3), the recycle DAO/Solvent flow can be determined to meet the S/B set-point at the extraction stage (in the spreadsheet using a "solver"). After running a few test cases, one can estimate the ratio of the recycled DAO/bitumen from ore in a range of 0.3-3, corresponding to: (1) S/B at the extractor of 0.7 and recycle solvent/DAO ratio 3; and (2) S/B at the Extractor of 1.7 and recycle Solvent/DAO ratio 2, respectively.

Operating Scenarios

| Parameter | | Scenario 1 | Scenario 2 | Scenario 3 |
|---|---|---|---|---|
| Bitumen feed to Extractor | mass per time | 100 | 100 | 100 |
| Recycle DAO/Solvent to Extractor from SDA | mass per time | 162 | 344 | 523 |
| Solvent:Bitumen ratio at Extractor (specified) | Setpoint | 0.7 | 1.3 | 1.7 |

-continued

| Parameter | | Scenario 1 | Scenario 2 | Scenario 3 |
|---|---|---|---|---|
| Solvent:Bitumen ratio of recycle DAO/Solvent | Scenarios | 2.0 | 2.7 | 3.0 |
| Recycle DAO to Extractor | mass per time | 54 | 93 | 131 |
| Recycle Solvent to Extractor | mass per time | 108 | 251 | 392 |
| DAO:Bitumen ratio at Extractor | Scenarios | 0.5 | 0.9 | 1.3 |
| Ratio of Recycle DAO/Solvent to Bitumen Feed | Scenarios | 1.6 | 3.4 | 5.2 |

It should be noted that various other scenarios are also possible, depending on various factors including solvent type and process configurations. For example, the $S/B_{DAO}$ ratio range for pentane can be 1.5-2.5 (instead of the 2-3 for hexane as noted above). If a mixture of paraffinic solvent species were used, the parameters could be adjusted accordingly.

Figure 20:
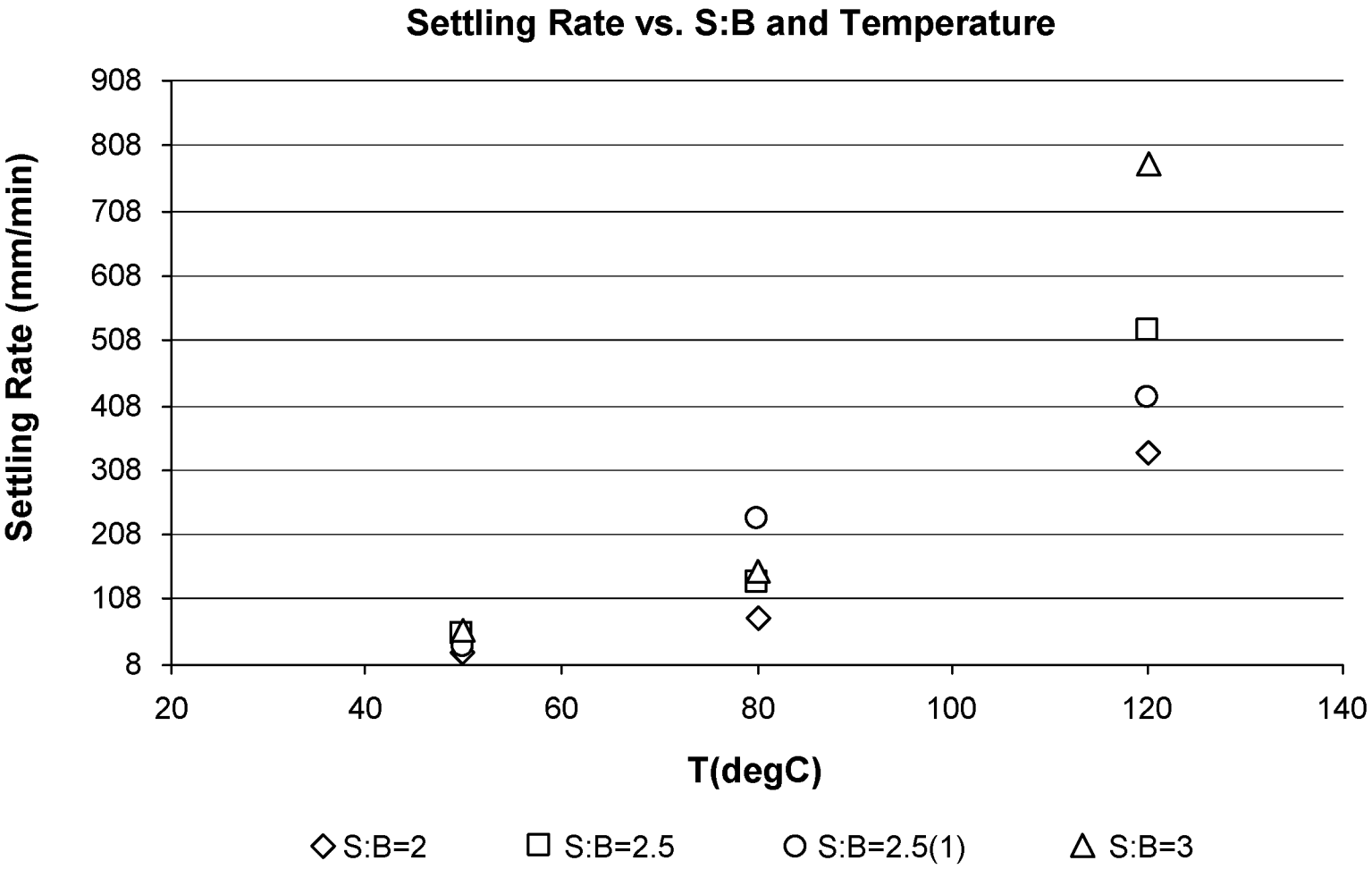
FIG. 20 is a graph of setting rate versus temperature for different S/B from benchtop SDA tests when the solvent is hexane.

Furthermore, the following table provides results based on benchtop tests of hexane solvent deasphalting of whole bitumen at different temperatures and S/B ratios. From the same tests, setting rates were determined for the SDA separation and FIG. 20 illustrates the results. The SDA stage of the processes described herein can be operated within a desired setting rate based on temperature, solvent type, S/B, and equipment features, for example. In some implementations, a settling rate of at least 200 mm/min, 250 mm/min, 300 mm/min, 350 mm/min, 400 mm/min, 450 mm/min, 500 mm/min, 600 mm/min, 700 mm/min or higher can be targeted; and/or the process can be operated within a settling rate range within any of the above mentioned values. In some implementations, the SDA stage can be operated at temperatures to promote high setting rates to facilitate smaller vessel sizing and fewer process trains for the SDA stage.

Benchtop Results Starting from 19.5 wt % Asphaltene in the Whole Bitumen

| Temperature ° C. | S/B target wt/wt | S/B in supernatant wt/wt | Asphaltene content in Bitumen wt % |
|---|---|---|---|
| 50 | 2 | 2.11 | 14.7 |
| 80 | 2 | 2.13 | 14.9 |
| 120 | 2 | 2.10 | 15.8 |
| 50 | 2.5 | 2.73 | 13.6 |
| 50 | 2.5 | 2.54 | 12.6 |
| 80 | 2.5 | 2.69 | 13.0 |
| 80 | 2.5 | 2.53 | 12.8 |
| 120 | 2.5 | 2.69 | 13.2 |
| 120 | 2.5 | 2.51 | 13.2 |
| 50 | 3 | 3.29 | 12.0 |
| 80 | 3 | 3.25 | 11.5 |
| 120 | 3 | 3.26 | 11.8 |

The invention claimed is:

1. A non-aqueous extraction process for producing bitumen from oil sands material comprising bitumen and solid mineral material, comprising:

subjecting the oil sands material to a multistage bitumen extraction step comprising a first extraction stage receiving the oil sands material and a subsequent extraction or pre-washing stage, comprising:

supplying a paraffinic solvent and a deasphalted oil at a solvent-to-bitumen ratio that is below asphaltene precipitation onset into the subsequent extraction or pre-washing stage to remove bitumen from the solid mineral material to produce a solvent-bitumen mixture and a solvent diluted tailings material; and supplying the solvent-bitumen mixture to the first extraction stage to contact the oil sands material and induce extraction of bitumen from the solid mineral material and produce a solvent diluted bitumen material and a first stage solid mineral material depleted in bitumen that is supplied to the subsequent extraction or pre-washing stage;

recovering the solvent diluted bitumen material from the multistage bitumen extraction step; and recovering the solvent diluted tailings material from the multistage bitumen extraction step.

2. The process of claim 1, wherein the deasphalted oil is a partially deasphalted oil.

3. The process of claim 2, wherein the deasphalted oil and the paraffinic solvent are added to the oil sands as a solvent diluted deasphalted hydrocarbon stream.

4. The process of claim 3, wherein the sole source of the paraffinic solvent in the multistage bitumen extraction step is the solvent diluted deasphalted hydrocarbon stream.

5. The process of claim 3, further comprising:

subjecting a first portion of the solvent diluted bitumen material to solvent deasphalting to produce a bottom asphaltene fraction and solvent diluted deasphalted bitumen; and recycling the solvent diluted deasphalted bitumen back into the multistage bitumen extraction step as the solvent diluted deasphalted hydrocarbon stream.

6. The process of claim 5, further comprising:

subjecting a second portion of the solvent diluted bitumen material to a solid/liquid separation stage to remove suspended solids and produce a clarified solvent diluted bitumen material.

7. The process of claim 6, further comprising:

recovering solvent from the clarified solvent diluted bitumen material to produce a bitumen product stream.

8. The process of claim 6, wherein the solid/liquid separation stage is a filtration stage and the clarified solvent diluted bitumen material is a filtered solvent diluted bitumen material.

9. The process of claim 5, wherein the solvent-to-bitumen ratio in the first extraction stage is maintained between 1.5 and 2 for hexane as the paraffinic solvent.

10. The process of claim 5, wherein the solvent-to-bitumen ratio in the first extraction stage is maintained sufficiently high to provide a fine mineral solids content below 0.5% in the solvent diluted bitumen material.

11. The process of claim 5, wherein a liquid-to-solids ratio in the first extraction stage is maintained at a predetermined range or value between 0.5 and 1.5.

12. The process of claim 5, wherein the multistage bitumen extraction step comprises:

the first extraction stage operated in a first vessel receiving the oil sands material, and producing a first stage tailings stream and a first stage diluted bitumen stream as the solvent diluted bitumen material; and a second extraction stage as the subsequent extraction stage and operated in a second vessel, the second extraction stage receiving the first stage tailings stream directly from the first extraction stage and also receiving the solvent diluted deasphalted bitumen, and producing a second stage tailings stream as the solvent diluted tailings material and a second stage solvent diluted bitumen stream that is supplied directly to the first extraction stage as the solvent-bitumen mixture to provide the paraffinic solvent and deasphalted bitumen to the first extraction stage.

13. The process of claim 1, further comprising:

washing the solvent diluted tailings material with a paraffinic solvent wash to produce a solvent wash liquor and a washed tailings material; and subjecting the washed tailings material to solvent recovery to produce a recovered solvent stream and a solvent recovered tailings material.

14. The process of claim 13, further comprising:

recycling the solvent wash liquor back into the solvent diluted bitumen material to increase the solvent-to-bitumen ratio and induce deasphalting thereof.

15. The process of claim 1, wherein the paraffinic solvent comprises pentane or hexane or a combination thereof.

16. The process of claim 1, wherein the multistage bitumen extraction step is performed at 25° C. to 80° C.

17. A non-aqueous extraction process for producing bitumen from oil sands material comprising bitumen and solid mineral material, comprising:

subjecting the oil sands material to a multistage bitumen extraction step comprising a first extraction stage and at least one subsequent extraction or pre-washing stage, the multistage bitumen extraction step comprising:

supplying a paraffinic solvent and a deasphalted oil into at least one of the at least one subsequent extraction or pre-washing stage at a solvent-to-bitumen ratio below asphaltene precipitation onset threshold to remove bitumen from solid mineral material to produce a solvent-bitumen mixture and a solvent diluted tailings material; and supplying the oil sands material and the solvent-bitumen mixture to the first extraction stage at a solvent-to-bitumen ratio below asphaltene precipitation onset threshold and under extraction conditions to induce extraction of bitumen from the solid mineral material and produce a solvent diluted bitumen material and a first stage solid mineral material depleted in bitumen that is supplied to the at least one subsequent extraction or pre-washing stage;

recovering the solvent diluted bitumen material and the solvent diluted tailings material;

subjecting at least a portion of the solvent diluted bitumen material to solvent deasphalting to produce a bottom asphaltene fraction and solvent diluted deasphalted bitumen; and recycling a first portion of the solvent diluted deasphalted bitumen back into the multistage bitumen extraction step as a source of the paraffinic solvent and the deasphalted oil.

18. The process of claim 17, wherein all of the solvent diluted bitumen material is subjected to the solvent deasphalting.

19. The process of claim 17, wherein the multistage bitumen extraction step is performed in two extraction vessels arranged in a counter-current configuration.

20. The process of claim 17, wherein the multistage bitumen extraction step is performed in a single extraction vessel.

21. The process of claim 17, further comprising:

subjecting a second portion of the solvent diluted deasphalted bitumen to solvent recovery to produce a recovered solvent stream and a bitumen product.

22. The process of claim 21, further comprising preheating the solvent diluted bitumen material prior to the solvent deasphalting, and wherein the recovered solvent stream is used to indirectly preheat the solvent diluted bitumen material prior to the solvent deasphalting.

23. The process of claim 17, further comprising:

subjecting the solvent diluted tailings to filtration to produce a filtered tailings and a filtrate; and subjecting the filtered tailings to washing using a solvent wash to produce a washed tailings and a solvent wash liquor.

24. The process of claim 23, wherein at least a portion of the solvent wash liquor is recycled back into the solvent diluted bitumen material to increase the solvent-to-bitumen ratio thereof and induce asphaltene precipitation in the deasphalting stage.

25. The process of claim 23, wherein the washing comprises:

a first washing stage that receives the filtered tailings and first stage solvent wash, and produces a first stage washed tailings and a first stage solvent wash liquor; and a second washing stage that receives the first stage washed tailings and a second stage solvent wash, and produces a second stage washed tailings and a second stage solvent wash liquor.

26. The process of claim 23, wherein the washed tailings are subjected to sand solvent recovery to produce a recovered solvent vapour and a solvent-lean tailings material.

27. The process of claim 17, further comprising:

subjecting at least a portion of the solvent diluted tailings material to washing to produce solvent wash liquor and washed tailings; and supplying at least a portion of the solvent wash liquor to the solvent deasphalting to induce asphaltene precipitation.

28. The process of claim 17, wherein the multistage bitumen extraction step is performed at an extraction temperature between 25° C. to 80° C., and the solvent deasphalting is performed at a deasphalting temperature that is higher than the extraction temperature and is between 50° C. and 130° C.

29. The process of claim 17, further comprising subjecting the bottom asphaltene fraction to solvent quenching.

30. The process of claim 17, further comprising:

subjecting at least a portion of the solvent diluted tailings material to washing in a washing stage to produce solvent wash liquor and washed tailings;

cooling at least a portion of the solvent wash liquor to produce a cooled solvent quench liquid;

adding the cooled solvent quench liquid to the bottom asphaltene fraction to cool the same and produce a solvent-asphaltene slurry; and supplying the solvent-asphaltene slurry to the washing stage.

31. The process of claim 30, wherein:

the multistage bitumen extraction step is performed at an extraction temperature between 25° C. to 80° C.;

the solvent deasphalting is performed at a deasphalting temperature that is higher than the extraction temperature and is between 50° C. and 130° C.;

the bottom asphaltene fraction has a bottoms temperature that is the same or within 10° C. of the deasphalting temperature upon addition of the cooled solvent quench liquid thereto;

the washing stage is performed at a washing temperature that is the same or within 10° C. of the extraction temperature;

the portion of the solvent wash liquor is cooled by at least 20° C. to produce the cooled solvent quench liquid that is added to the bottom asphaltene fraction; and the solvent-asphaltene slurry has a temperature that is the same or within 10° C. of the washing stage upon supplying thereto.

32. A non-aqueous extraction process for producing bitumen from oil sands material comprising bitumen and solid mineral material, comprising:

subjecting the oil sands material to a multistage bitumen extraction step comprising a first extraction stage and a subsequent extraction or pre-washing stage, the multistage bitumen extraction step comprising:

supplying a paraffinic solvent and a deasphalted oil into the subsequent extraction or pre-washing stage at a solvent-to-bitumen ratio below asphaltene precipitation onset threshold to remove bitumen from solid mineral material to produce a solvent-bitumen mixture and a solvent diluted tailings material; and supplying the oil sands material and the solvent-bitumen mixture to the first extraction stage at a solvent-to-bitumen ratio below asphaltene precipitation onset threshold and under extraction conditions to induce extraction of bitumen from the solid mineral material and produce a solvent diluted bitumen material and a first stage solid mineral material depleted in bitumen that is supplied to the subsequent extraction or pre-washing stage;

recovering the solvent diluted bitumen material and the solvent diluted tailings material;

subjecting a first portion of the solvent diluted bitumen material to solvent deasphalting to produce a bottom asphaltene fraction and solvent diluted deasphalted bitumen; and recycling at least a portion of the solvent diluted deasphalted bitumen back into the multistage bitumen extraction step as a source of the paraffinic solvent and the deasphalted oil.

33. The process of claim 32, further comprising subjecting a second portion of the solvent diluted bitumen material to downstream processing to produce a bitumen product.

34. The process of claim 1, further comprising subjecting at least a portion of the solvent diluted bitumen material or a material derived therefrom to solvent deasphalting to produce a bottom asphaltene fraction and solvent diluted deasphalted bitumen; and recycling at least a portion of the solvent diluted deasphalted bitumen or a stream derived therefrom back into the multistage bitumen extraction step as at least a part of the deasphalted oil.

35. The process of claim 1, further comprising maintaining a first stage solvent-to-bitumen ratio in the first extraction stage between 0.25 and 2.

* * * * *